US011211077B2

(12) United States Patent
Tsutsumi et al.

(10) Patent No.: US 11,211,077 B2
(45) Date of Patent: *Dec. 28, 2021

(54) AUDIO CODING DEVICE, AUDIO CODING METHOD, AUDIO CODING PROGRAM, AUDIO DECODING DEVICE, AUDIO DECODING METHOD, AND AUDIO DECODING PROGRAM

(71) Applicant: NTT DOCOMO, INC., Tokyo (JP)

(72) Inventors: Kimitaka Tsutsumi, Tokyo (JP); Kei Kikuiri, Tokyo (JP); Atsushi Yamaguchi, Tokyo (JP)

(73) Assignee: NTT DOCOMO, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/717,806

(22) Filed: Dec. 17, 2019

(65) Prior Publication Data

US 2020/0126576 A1 Apr. 23, 2020

Related U.S. Application Data

(63) Continuation of application No. 15/854,416, filed on Dec. 26, 2017, now Pat. No. 10,553,231, which is a (Continued)

(30) Foreign Application Priority Data

Nov. 15, 2012 (JP) ..... 2012-251646

(51) Int. Cl.
*G10L 19/125* (2013.01)
*G10L 19/09* (2013.01)
*G10L 19/005* (2013.01)

(52) U.S. Cl.
CPC ..... *G10L 19/125* (2013.01); *G10L 19/005* (2013.01); *G10L 19/09* (2013.01)

(58) Field of Classification Search
CPC ..... G10L 19/125; G10L 19/005; G10L 10/09
See application file for complete search history.

(56) References Cited

U.S. PATENT DOCUMENTS 5,327,520 A * 7/1994 Chen ..... G10L 19/12 704/219
6,862,567 B1 3/2005 Gao
(Continued)

FOREIGN PATENT DOCUMENTS

EP 1288915 A2 3/2003
EP 1 746 580 A1 1/2007
(Continued)

OTHER PUBLICATIONS

Japanese Office Action with translation, dated Aug. 25, 2020, pp. 1-8, issued in Japanese Patent Application No. P2019-215587, Japanese Patent Office, Tokyo, Japan.
(Continued)

*Primary Examiner* — Abul K Azad
(74) *Attorney, Agent, or Firm* — Crowell & Moring LLP

(57) ABSTRACT

An audio signal transmission device for encoding an audio signal includes an audio encoding unit that encodes an audio signal and a side information encoding unit that calculates and encodes side information from a look-ahead signal. An audio signal receiving device for decoding an audio code and outputting an audio signal includes: an audio code buffer that detects packet loss based on a received state of an audio packet, an audio parameter decoding unit that decodes an audio code when an audio packet is correctly received, a side information decoding unit that decodes a side information code when an audio packet is correctly received, a side information accumulation unit that accumulates side information obtained by decoding a side information code, an audio parameter missing processing unit that outputs an (Continued)

audio parameter upon detection of audio packet loss, and an audio synthesis unit that synthesizes decoded audio from the audio parameter.

7 Claims, 43 Drawing Sheets

Related U.S. Application Data continuation of application No. 15/385,458, filed on Dec. 20, 2016, now Pat. No. 9,881,627, which is a continuation of application No. 14/712,535, filed on May 14, 2015, now Pat. No. 9,564,143, which is a continuation of application No. PCT/JP2013/080589, filed on Nov. 12, 2013.

(56) References Cited

U.S. PATENT DOCUMENTS

| | | | | |
|---|---|---|---|---|
| 7,092,885 | B1 | 8/2006 | Yamaura | |
| 7,752,038 | B2 * | 7/2010 | Laaksonen | G10L 25/90 704/207 |
| 7,895,046 | B2 | 2/2011 | Andersen et al. | |
| 8,843,798 | B2 | 9/2014 | Sung | |
| 9,564,143 | B2 * | 2/2017 | Tsutsumi | G10L 19/125 |
| 9,564,343 | B2 | 2/2017 | Lee et al. | |
| 9,881,627 | B2 * | 1/2018 | Tsutsumi | G10L 19/09 |
| 10,553,231 | B2 * | 2/2020 | Tsutsumi | G10L 19/005 |
| 2002/0126222 | A1 | 9/2002 | Choi et al. | |
| 2007/0192666 | A1 | 8/2007 | Song et al. | |
| 2008/0294429 | A1 | 11/2008 | Su et al. | |
| 2009/0116486 | A1 | 5/2009 | Zhan et al. | |
| 2009/0119098 | A1 | 5/2009 | Zhan et al. | |
| 2009/0177465 | A1 * | 7/2009 | Johansson | G10L 19/24 704/219 |
| 2009/0240490 | A1 | 9/2009 | Kim et al. | |
| 2009/0292542 | A1 | 11/2009 | Zhan et al. | |
| 2009/0316598 | A1 | 12/2009 | Zhan et al. | |
| 2010/0125454 | A1 | 5/2010 | Zopf et al. | |
| 2011/0077940 | A1 * | 3/2011 | Vos | G10L 19/005 704/229 |
| 2011/0200198 | A1 | 8/2011 | Grill et al. | |
| 2012/0265523 | A1 | 10/2012 | Greer et al. | |
| 2015/0228291 | A1 | 8/2015 | Greer et al. | |
| 2016/0196827 | A1 | 7/2016 | Greer et al. | |
| 2017/0148448 | A1 | 5/2017 | Greer et al. | |
| 2017/0337925 | A1 | 11/2017 | Greer et al. | |
| 2020/0126577 | A1 | 4/2020 | Tsutsumi et al. | |

FOREIGN PATENT DOCUMENTS

| | | | |
|---|---|---|---|
| EP | 2 056 291 | A1 | 5/2009 |
| JP | 07-271391 | | 10/1995 |
| JP | 2002-268696 | A | 9/2002 |
| JP | 2003-249957 | A | 9/2003 |
| JP | 2003-533916 | A | 11/2003 |
| JP | 2004-138756 | A | 5/2004 |
| JP | 2010-507818 | A | 3/2010 |
| KR | 10-2009-0046713 | | 5/2009 |
| KR | 10-2009-0100494 | | 9/2009 |
| KR | 10-2012-0115961 | | 10/2012 |
| WO | WO 01/86637 | A1 | 11/2001 |
| WO | WO 2008/049221 | A | 5/2008 |
| WO | WO 2012/046685 | A1 | 4/2012 |
| WO | WO 2012/070370 | A1 | 5/2012 |

OTHER PUBLICATIONS

Japanese Office Action with English translation, dated Sep. 8, 2020, pp. 1-10, issued in Japanese Patent Application No. 2019-220205, Japanese Patent Office, Tokyo, Japan.

International Search Report with English translation, dated Jan. 21, 2014, pp. 1-5, issued in PCT/JP2013/080589, Japanese Patent Office, Tokyo, Japan.

ITU-T G.711, Appendix 1, A high quality low-complexity algorithm for packet loss concealment with G.711, Series G: Transmission Systems and Media, Digital Systems and Networks, Digital transmission systems—Terminal equipments—Coding of analogue signals by pulse code modulation, dated Sep. 1999, pp. 1-26, International Telecommunication Union.

ITU-T G.718, Series G: Transmission Systems and Media, Digital Systems and Networks, Digital terminal equipments—Coding of voice and audio signals, Frame error robust narrow-band and wideband embedded vaiable bit-rate coding of speech and audio from 8-32 kbit/s, dated Jun. 2008, pp. 1-257, International Telecommunication Union.

3GPP TS 26.190 V12.0.0, 3rd Generation Partnership Project; Technical Specification Group Services and System Aspects; Speech codec speech processing functions; Adaptive Multi-Rate-Wideband (AMR-WB) speech codec; Transcoding functions (Release 12), Sep. 2014, pp. 1-51, 3rd Generation Partnership Project, 35PP Organizational Partners.

3GPP TS 26.191 V12.0.0, 3rd Generation Partnership Project; Technical Specification Group Services and System Aspects; Speech codec speech processing functions; Adaptive Multi-Rate-Wideband (AMR-WB) speech codec; Error concealment of erroneous or lost frames (Release 12), Sep. 2014, pp. 1-14, 3rd Generation Partnership Project, 35PP Organizational Partners.

Taiwanese Office Action with English translation, dated Sep. 23, 2015, pp. 1-4, issued in Taiwan Patent Application No. 102141676, Taiwanese Patent Office, Taipei, Taiwan.

Japanese Office Action with English translation, dated Oct. 20, 2015, pp. 1-6, issued in Japanese Patent Application No. P2014-546993, Japanese Patent Office, Tokyo, Japan.

Korean Office Action with English translation, dated Nov. 20, 2015, pp. 1-7, issued in Korean Patent Application No. 10-2015-7009567, Korean Intellectual Property Office, Daejeon, Republic of Korea.

Extended European Search Report, pp. 1-10, dated Jun. 8, 2016, issued in European Patent Application No. 13854879.7, European Patent Office, The Hague, The Netherlands.

Editor G.729.1 Amd.3, "Draft new G.729.1 Amendment 3 G.729-based embedded variable bit-rate coder: An 8-32 kbit/s scalable wideband coder bitstream interoperable with G.729: Extension of the G.729.1 low-delay mode functionality to 14 kbit/s, and corrections to the main body and Annex B," dated Jun. 26, 2007, pp. 1-99, International Telecommunication Union, Telecommunication Standardization Sector, Study Period 2005-2008, Study Group 16, TD 279 (WP 3/16); ITU-T SG 16 Meeting, Geneva, Switzerland, XP030100454.

Deutsche Thomson-Brandt et al., "Proposed Annex C to Draft Rec. G.723—Dual Rate Speech Coder for Multimedia Communications Transmitting at 5.3 & 6.3 kbit/s," dated at least as early as Jan. 9, 1996, pp. 1-9, ITU Low Bitrate Coding Group), 12. LBC Meeting Jan. 9, 1996 to Jan. 12, 1996, Santa Josā, CR, No. LBC-96-030, XP030028725.

Korean Office Action with English translation, dated Jun. 15, 2016, pp. 1-7, issued in Korean Patent Application No. 10-2015-7009567, Korean Intellectual Property Office, Daejeon, Republic of Korea.

ITU-T G.718, dated Jun. 2008, pp. 209-211, ITU-T, Jan. 2011, Ed.1.3, E34308, retrieved from the Internet on May 9, 2016, at URL: http://www.itu.int/rec/T-REC-G.718-200806-I.

Japanese Office Action, dated May 24, 2016, pp. 1-7, issued in Japanese Patent Application No. P2014-546993, Japanese Patent Office, Tokyo, Japan.

Mexican Office Action with English translation, dated Jun. 3, 2016, pp. 1-7, issued in Mexican Patent Application No. MX/a/2015/005885 PCT, Mexican Institute of Industrial Property, Mexico City, Mexico.

Canadian Office Action, dated Apr. 3, 2017, pp. 1-5, issued in Canadian patent application No. 2,886,140, Canadian Intellectual Property Office, Gatineau, Quebec, Canada.

Japanese Office Action, dated Jun. 6, 2017, pp. 1-4, issued in Japanese Patent Application No. 2016-135137, Japanese Patent Office, Tokyo, Japan.

(56) References Cited

OTHER PUBLICATIONS

Geiser et al., "Steganographic Packet Loss Concealment for Wireless VoIP," ITG Conference on Voice Communication [8. ITG-Fachtagung], Year: 2008, pp. 1689-1692.
Korean Office Action, dated February Jan. 26, 2018, pp. 1-9, Korean Application No. 10-2017-7036234, Korean Intellectual Property Office, Daejeon, Republic of Korea.
Australian Examination Report No. 1, dated Jun. 13, 2018, pp. 1-3, issued in Australian Patent Application No. 2017208369, Offices of IP Australia, Woden ACT, Australia.
Korean Office Action, dated Jul. 16, 2018, pp. 1-9, Korean Application No. 10-2017-7036234, Korean Intellectual Property Office, Daejeon, Republic of Korea.
India Office Action, dated Oct. 31, 2018, pp. 1-6, issued in India Patent Application No. 2595/DELNP/2015, Intellectual Property India, New Delhi, India.
Korean Office Action with English translation, dated Dec. 28, 2018, pp. 1-9, issued in Korean Patent Application No. 10-2018-7029586, Korean Intellectual Property Office, Daejeon, Republic of Korea.
Indonesian Office Action with English translation, issued in Indonesian Patent Application No. P00201503548, dated Feb. 14, 2019, pp. 1-4, the Directorate General of Intellectual Property Rights of Indonesia, Jakarta Selatan, Indonesia.
Sasaki, Shigeaki, "Study on Broadband Audio Coding at around 16 kbit/s," Examination ITU-T Standard Candidate Algorithm, Acoustical Society of Japan Research Presentation Meeting Lecture, Collected Papers, Mar. 2001, pp. 1-8 with English translation.
Japanese Office Action with English translation, dated Mar. 5, 2019, pp. 1-6, issued in Japanese Application No. 2018-044180, Japanese Patent Office, Tokyo, Japan.
Japanese Office Action with English translation, dated May 21, 2019, pp. 1-6, issued in Japanese Patent Application No. 2019-027042, Japanese Patent Office, Tokyo, Japan.
Japanese Office Action with English translation, dated Jul. 30, 2019, pp. 1-6, issued in Japanese Patent Application No. 2018-044180, Japanese Patent Office, Tokyo, Japan.
Japanese Office Action with English translation, dated Sep. 10, 2019, pp. 1-4, issued in Japanese Patent Application 2019-027042, Japanese Patent Office, Tokyo, Japan.
Korean Office Action with English translation, dated Aug. 27, 2019, pp. 1-7, issued in Korean Patent Application No. 10-2018-7029586, Korean Intellectual Property Office, Daejeon, South Korea.
Canadian Office Action, dated Nov. 6, 2019, pp. 1-5, issued in Canadian Patent Application No. 2,886,140, Canadian Intellectual Property Office, Gatineau, Quebec, Canada.
Australian Examination Report No. 1, dated Nov. 28, 2019, pp. 1-3, issued in Australian Patent Application No. 2019202186, Offices of IP Australia, Woden, ACT, Australia.
Japanese Office Action with translation, dated May 12, 2020, pp. 1-6, issued in Japanese Patent Application No. 2018-44180, Japanese Patent Office, Tokyo, Japan.
Canadian Office Action, dated Jul. 13, 2020, pp. 13, issued in Canadian Patent Application No. 3,044,983, Canadian Intellectual Property Office, Gatineau, Quebec, Canada.
Office Action in Indonesia Application No. P00201904038, dated Mar. 15, 2021, 4 pages.
Notice of Allowance in U.S. Appl. No. 16/717,822 dated Jul. 26, 2021, 7 pages.
Notice of Allowance in U.S. Appl. No. 16/717,837 dated Jul. 21, 2021, 7 pages.
Office Action in Russia Application No. 2020137611, dated Apr. 20, 2021, 12 pages.
Office Action in U.S. Appl. No. 16/717,822, dated Feb. 17, 2021, 27 pages.
Berouti et al, "Reducing Signal Delay in Multipulse coding at 16 kb", 1986, p. 3043-p. 3046, Bell-Northern Research Montreal Canada, obtained/downloaded on Feb. 12, 2021, 4 pages.
Japanese Office Action dated Dec. 8, 2020, pp. 1-8, issued in Japanese Patent Application No. 2019-220205, Japanese Patent Office, Tokyo, Japan.
Korean Office Action with English Translation, dated Jan. 5, 2021, pp. 1-10, issued in Korean Patent Application No. 10-2020-7030410, Korean Patent Office, Daejeon, Republic of Korea.
Office Action in U.S. Appl. No. 16/717,837, dated Mar. 16, 2021, 28 pages.
Korean Office Action with English Translation, dated Jan. 18, 2021, pp. 1-10, issued in Korean Patent Application No. 10-2020-7030913, Korean Patent Office, Daejeon, Republic of Korea.
Office Action/Communication Pursuant to Article 94(3) EPC, in Europe Patent Application No. 19185490.0, dated Sep. 22, 2021, 4 pages.

* cited by examiner

AUDIO CODING DEVICE, AUDIO CODING METHOD, AUDIO CODING PROGRAM, AUDIO DECODING DEVICE, AUDIO DECODING METHOD, AND AUDIO DECODING PROGRAM

PRIORITY

This application is a continuation of U.S. patent application Ser. No. 15/854,416, filed Dec. 26, 2017, which is a continuation of U.S. patent application Ser. No. 15/385,458, filed Dec. 20, 2016, now U.S. Pat. No. 9,881,627, issued Jan. 30, 2018, which is a continuation of U.S. patent application Ser. No. 14/712,535, filed May 14, 2015, now U.S. Pat. No. 9,564,143, issued Feb. 7, 2017, which is a continuation of PCT/JP2013/080589, filed Nov. 12, 2013, which claims the benefit of the filing date pursuant to 35 U.S.C. § 119(e) of JP2012-251646, filed Nov. 15, 2012, all of which are incorporated herein by reference.

TECHNICAL FIELD

The present disclosure relates to error concealment for transmission of audio packets through an IP network or a mobile communication network and, more specifically, relates to an audio encoding device, an audio encoding method, an audio encoding program, an audio decoding device, an audio decoding method, and an audio decoding program for highly accurate packet loss concealment signal generation to implement error concealment.

BACKGROUND

In the transmission of audio and acoustic signals (which are collectively referred to hereinafter as "audio signal") through an IP network or a mobile communication network, the audio signal is encoded into audio packets at regular time intervals and transmitted through a communication network. At the receiving end, the audio packets are received through the communication network and decoded into a decoded audio signal by server, a MCU (Multipoint Control Unit), a terminal or the like.

The audio signal is generally collected in digital format. Specifically, it is measured and accumulated as a sequence of numerals whose number is the same as a sampling frequency per second. Each element of the sequence is called a "sample". In audio encoding, each time a predetermined number of samples of an audio signal is accumulated in a built-in buffer, the audio signal in the buffer is encoded. The above-described specified number of samples is called a "frame length", and a set of the same number of samples as the frame length is called "frame". For example, at the sampling frequency of 32 kHz, when the frame length is 20 ms, the frame length is 640 samples. Note that the length of the buffer may be more than one frame.

When transmitting audio packets through a communication network, a phenomenon (so-called "packet loss") can occur where some of the audio packets are lost, or an error can occur in part of information written in the audio packets due to congestion in the communication network or the like. In such a case, the audio packets cannot be correctly decoded at the receiving end, and therefore a desired decoded audio signal cannot be obtained. Further, the decoded audio signal corresponding to the audio packet where packet loss has occurred is detected as noise, which significantly degrades the subjective quality to a person who listens to the audio.

SUMMARY

Packet loss concealment technology can be used as a way to interpolate a part of the audio/acoustic signal that is lost by packet loss. There are two types of packet loss concealment technology: "packet loss concealment technology without using side information" where packet loss concealment is performed only at the receiving end and "packet loss concealment technology using side information" where parameters that help packet loss concealment are obtained at the transmitting end and transmitted to the receiving end, where packet loss concealment is performed using the received parameters at the receiving end.

The "packet loss concealment technology without using side information" can generate an audio signal corresponding to a part where packet loss has occurred by copying a decoded audio signal contained in a packet that has been correctly received in the past on a pitch-by-pitch basis and then multiplying the decoded audio signal by a predetermined attenuation coefficient, such as, for example, as described in ITU-T G.711 Appendix I. Because the "packet loss concealment technology without using side information" can be based on an assumption that the properties of the part of the audio where packet loss has occurred are similar to those of the audio immediately before the occurrence of loss, the concealment effect may be unsatisfactory when the part of the audio where packet loss has occurred has different properties from the audio immediately before the occurrence of loss, or when there is a sudden change in power.

On the other hand, the "packet loss concealment technology using side information" can include a technique that encodes parameters required for packet loss concealment at the transmitting end and transmits them for use in packet loss concealment at the receiving end, such as, for example, as described in ITU-T G.711 Appendix I.

In an example from ITU-T G.711 Appendix I, the audio is encoded by two encoding methods: main encoding and redundant encoding. The redundant encoding encodes the frame immediately before the frame to be encoded by the main encoding at a lower bit rate than the main encoding (see the example of FIG. 1(*a*)). For example, the Nth packet contains an audio code obtained by encoding the Nth frame by major encoding and a side information code obtained by encoding the (N−1)th frame by redundant encoding.

The receiving end waits for the arrival of two or more temporally successive packets and then decodes the temporally earlier packet and obtains a decoded audio signal. For example, to obtain a signal corresponding to the Nth frame, the receiving end waits for the arrival of the (N+1)th packet and then performs decoding. In the case where the Nth packet and the (N+1)th packet are correctly received, the audio signal of the Nth frame is obtained by decoding the audio code contained in the Nth packet (see the example of FIG. 1(*b*)). On the other hand, in the case where packet loss has occurred (when the (N+1)th packet is obtained in the condition where the Nth packet is lost), the audio signal of the Nth frame can be obtained by decoding the side information code contained in the (N+1)th packet (see the example of FIG. 1(*c*)).

According to the example described by the method of ITU-T G.711 Appendix I, after a packet to be decoded arrives, it is necessary to wait to perform decoding until one or more packet arrives, and algorithmic delay increases by one packet or more. Accordingly, in the example described by the method of ITU-T G.711 Appendix I, although the audio quality can be improved by packet loss concealment, the algorithmic delay increases to cause the degradation of the voice communication quality.

Further, in the case of applying the above-described packet loss concealment technology to CELP (Code Excited Linear Prediction) encoding, another issue could arise due to the characteristics of the operation of CELP. Because CELP is an audio model based on linear prediction and is able to encode an audio signal with high accuracy and with a high compression ratio, it is used in many international standards.

In CELP, an audio signal can be synthesized by filtering an excitation signal e(n) using an all-pole synthesis filter. Specifically, an audio signal s(n) is synthesized according to the following equation:

$$s(n) = e(n) - \sum_{i=1}^{P} a(i) \cdot s(n-1) \quad \text{Equation 1}$$

where a(i) is a linear prediction coefficient (LP coefficient), and a value such as P=16, for example, is used as a degree.

In CELP, the excitation signal can be accumulated in a buffer called an adaptive codebook. When synthesizing the audio for a new frame, an excitation signal is newly generated by adding an adaptive codebook vector read from the adaptive codebook and a fixed codebook vector representing a change in excitation signal over time based on position information called a pitch lag. The newly generated excitation signal can be accumulated in the adaptive codebook and can also be filtered by the all-pole synthesis filter, and thereby a decoded signal is synthesized.

In CELP, an LP coefficient is calculated for all frames. In the calculation of the LP coefficient, a look-ahead signal of about 10 ms can be used. Specifically, in addition to a frame to be encoded, a look-ahead signal can be accumulated in the buffer, and then the LP coefficient calculation and the subsequent processing can be performed (see the example of FIG. 2). Each frame can be divided into about four sub-frames, and processing such as the above-described pitch lag calculation, adaptive codebook vector calculation, fixed codebook vector calculation and adaptive codebook update can be performed in each sub-frame. In the processing of each sub-frame, the LP coefficient can also be interpolated so that the coefficient varies from sub-frame to sub-frame. Further, for quantization and interpolation, the LP coefficient can be encoded after being converted into an ISP (Immittance Spectral Pair) parameter and an ISF (Immittance Spectral Frequency) parameter, which can be considered as equivalent representation(s) of the LP coefficient(s). An example of a procedure for the inter-conversion of the LP coefficient(s) and the ISP parameter and the ISF parameter is described in 3GPP TS26-191.

In an example of CELP coding, encoding and decoding are performed based on the assumption that both the encoding end and the decoding end have adaptive codebooks, and those adaptive codebooks are always synchronized with each other. Although the adaptive codebook at the encoding end and the adaptive codebook at the decoding end can be synchronized under conditions where packets are correctly received and decoded, once packet loss has occurred, the synchronization of the adaptive codebooks may not be achieved.

For example, if a value that is used as a pitch lag is different between the encoding end and the decoding end, a time lag occurs between the adaptive codebook vectors. Because the adaptive codebook is updated with those adaptive codebook vectors, even if the next frame is correctly received, the adaptive codebook vector calculated at the encoding end and the adaptive codebook vector calculated at the decoding end do not coincide, and the synchronization of the adaptive codebooks may not be recovered. Due to such inconsistency of the adaptive codebooks, the degradation of the audio quality can occur for several frames after the frame where packet loss has happened.

In the packet loss concealment in CELP encoding, an example of a more advanced technique is described in Japanese Unexamined Patent Application Publication No. 2010-507818. An index of a transition mode codebook can be transmitted instead of a pitch lag or an adaptive codebook gain in a specific frame that is largely affected by packet loss, such as, described in the example of Japanese Unexamined Patent Application Publication No. 2010-507818. The example technique of Japanese Unexamined Patent Application Publication No. 2010-507818 focuses attention on a transition frame (transition from a silent audio segment to a sound audio segment, or transition between two vowels) as the frame that is largely affected by packet loss. By generating an excitation signal using the transition mode codebook in this transition frame, it is possible to generate an excitation signal that is not dependent on the past adaptive codebook and thereby recover from the inconsistency of the adaptive codebooks due to the past packet loss.

However, because the example method of Japanese Unexamined Patent Application Publication No. 2010-507818 does not use the transition frame codebook in a frame where a long vowel continues, for example, it is not possible to recover from the inconsistency of the adaptive codebooks in such a frame. Further, in the case where the packet containing the transition frame codebook is lost, packet loss affects the frames after the loss. This is the same when the next packet after the packet containing the transition frame codebook is lost.

Although it is feasible to apply a codebook to all frames that is not dependent on the past frames, such as the transition frame codebook, because the encoding efficiency is significantly degraded, it is not possible to achieve a low bit rate and high audio quality under these circumstances.

After the arrival of a packet to be decoded, decoding may not be started before the arrival of the next packet, such as, for example, as described in Japanese Unexamined Patent Application Publication No. 2010-507818. Therefore, although the audio quality is improved by packet loss concealment, the algorithmic delays increases, which can cause the degradation of the voice communication quality.

In the event of packet loss in CELP encoding, the degradation of the audio quality can occur due to the inconsistency of the adaptive codebooks between the encoding unit and the decoding unit. Although the method as described in the example of Japanese Unexamined Patent Application Publication No. 2010-507818 can allow for recovery from the inconsistency of the adaptive codebooks, the method is not sufficient to allow recovery when a frame different from the frame immediately before the transition frame is lost.

An audio coding system to solve the above problems can include an audio encoding device, an audio encoding method, an audio encoding program, an audio decoding device, an audio decoding method, and an audio decoding program that recover audio quality without increasing algorithmic delay in the event of packet loss in audio encoding.

Embodiments of the audio coding system can include an audio encoding device for encoding an audio signal, which includes an audio encoding unit configured to encode an audio signal, and a side information encoding unit configured to calculate side information from a look-ahead signal and encode the side information.

The side information may be indicative of a pitch lag in a look-ahead signal, indicative of a pitch gain in a look-ahead signal, or indicative of to a pitch lag and a pitch gain in a look-ahead signal. Further, the side information may contain information indicative of availability of the side information.

The side information encoding unit may calculate side information for a look-ahead signal part and encode the side information, and also generate a concealment signal, and the audio encoding device may further include an error signal encoding unit configured to encode an error signal between an input audio signal and a concealment signal output from the side information encoding unit, and a main encoding unit configured to encode an input audio signal.

Further, embodiments of the audio coding system can include an audio decoding device for decoding an audio code and outputting an audio signal, which includes an audio code buffer configured to detect packet loss based on a received state of an audio packet, an audio parameter decoding unit configured to decode an audio code when an audio packet is correctly received, a side information decoding unit configured to decode a side information code when an audio packet is correctly received, a side information accumulation unit configured to accumulate side information obtained by decoding a side information code, an audio parameter missing processing unit configured to output an audio parameter when audio packet loss is detected, and an audio synthesis unit configured to synthesize a decoded audio from an audio parameter.

The side information may be indicative of a pitch lag in a look-ahead signal, indicative of a pitch gain in a look-ahead signal, or indicative of a pitch lag and a pitch gain in a look-ahead signal. Further, the side information may contain information indicative of the availability of side information.

The side information decoding unit may decode a side information code and output side information, and may further output a concealment signal related to a look-ahead part by using the side information, and the audio decoding device may further include an error decoding unit configured to decode a code indicative of an error signal between an audio signal and a concealment signal, a main decoding unit configured to decode a code indicative of an audio signal, and a concealment signal accumulation unit configured to accumulate a concealment signal output from the side information decoding unit.

When an audio packet is correctly received, a part of a decoded signal may be generated by adding a concealment signal read from the concealment signal accumulation unit and a decoded error signal output from the error decoding unit, and the concealment signal accumulation unit may be updated with a concealment signal output from the side information decoding unit.

When audio packet loss is detected, a concealment signal read from the concealment signal accumulation unit may be used as a part, or a whole, of a decoded signal.

When audio packet loss is detected, a decoded signal may be generated by using an audio parameter predicted by the audio parameter missing processing unit, and the concealment signal accumulation unit may be updated by using a part of the decoded signal.

When audio packet loss is detected, the audio parameter missing processing unit may use side information read from the side information accumulation unit as a part of a predicted value of an audio parameter.

When audio packet loss is detected, the audio synthesis unit may correct an adaptive codebook vector, which is one of the audio parameters, by using side information read from the side information accumulation unit.

The audio coding system can also provide an audio encoding method performed by an audio encoding device for encoding an audio signal, which includes an audio encoding step of encoding an audio signal, and a side information encoding step of calculating side information from a look-ahead signal and encoding the side information.

The audio coding system can also provide an audio decoding method performed by an audio decoding device for decoding an audio code and outputting an audio signal, which includes an audio code buffer step of detecting packet loss based on a received state of an audio packet, an audio parameter decoding step of decoding an audio code when an audio packet is correctly received, a side information decoding step of decoding a side information code when an audio packet is correctly received, a side information accumulation step of accumulating side information obtained by decoding a side information code, an audio parameter missing processing step of outputting an audio parameter when audio packet loss is detected, and an audio synthesis step of synthesizing a decoded audio from an audio parameter.

The audio coding system may also execute an audio encoding program that causes a computer (processor) to function as an audio encoding unit to encode an audio signal, and a side information encoding unit to calculate side information from a look-ahead signal and encode the side information.

The audio coding system may also execute an audio decoding program that causes a computer to function as an audio code buffer to detect packet loss based on a received state of an audio packet, an audio parameter decoding unit to decode an audio code when an audio packet is correctly received, a side information decoding unit to decode a side information code when an audio packet is correctly received, a side information accumulation unit to accumulate side information obtained by decoding a side information code, an audio parameter missing processing unit to output an audio parameter when audio packet loss is detected, and an audio synthesis unit to synthesize a decoded audio from an audio parameter.

With the audio coding system described herein, it is possible to recover audio quality without increasing algorithmic delay in the event of packet loss in audio encoding. Particularly, in CELP encoding, using the audio coding system, it is possible to reduce degradation of an adaptive codebook that occurs when packet loss happens and thereby improve audio quality in the event of packet loss.

DESCRIPTION OF EMBODIMENTS

Figure 1:
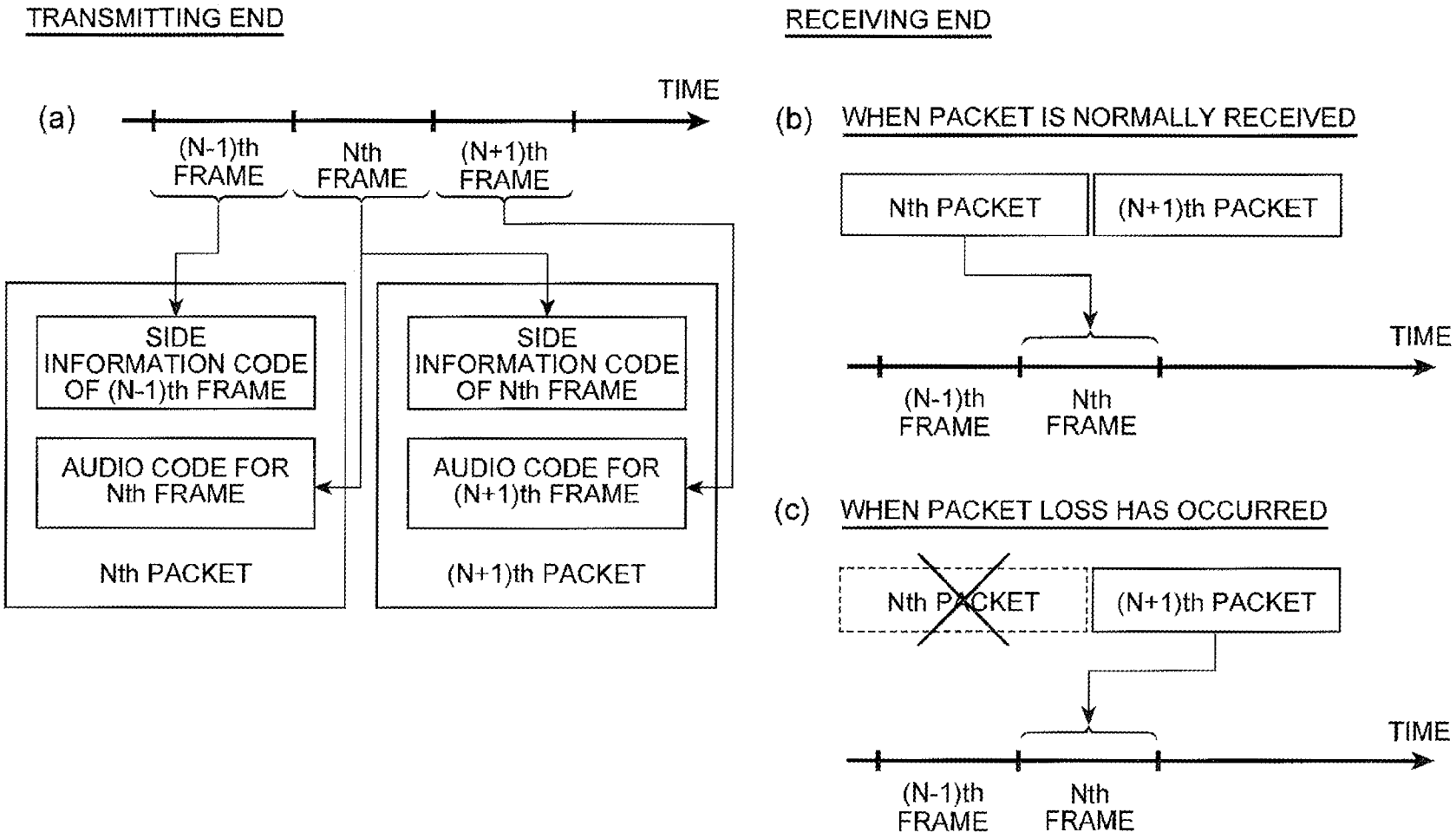
FIG. 1 is a view showing an example of a temporal relationship between packets and a decoded signal.
Figure 2:
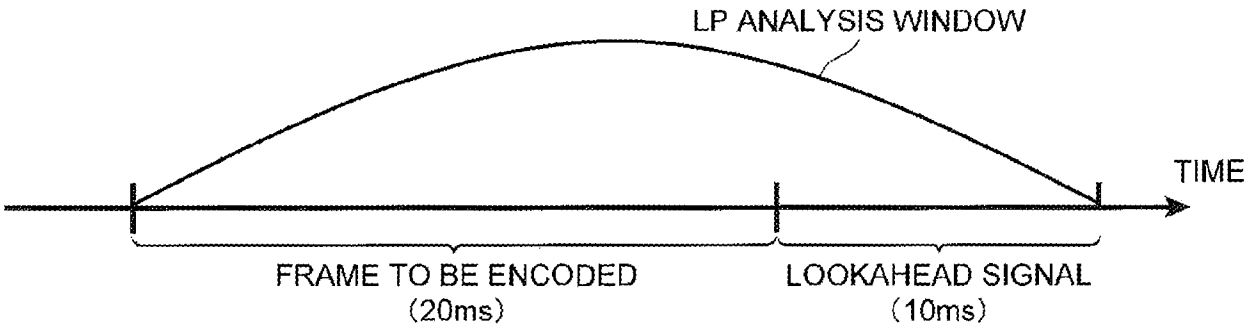
FIG. 2 is a view showing an example of a temporal relationship between an LP analysis target signal and a look-ahead signal in CELP encoding.

Embodiments of the audio coding system are described hereinafter with reference to the attached drawings. Note that, where possible, the same elements are denoted by the same reference numerals and redundant description thereof is omitted.

An embodiment of the audio coding system relates to an encoder and a decoder that implement "packet loss concealment technology using side information" that encodes and transmits side information calculated on the encoder side for use in packet loss concealment on the decoder side.

Figure 3:
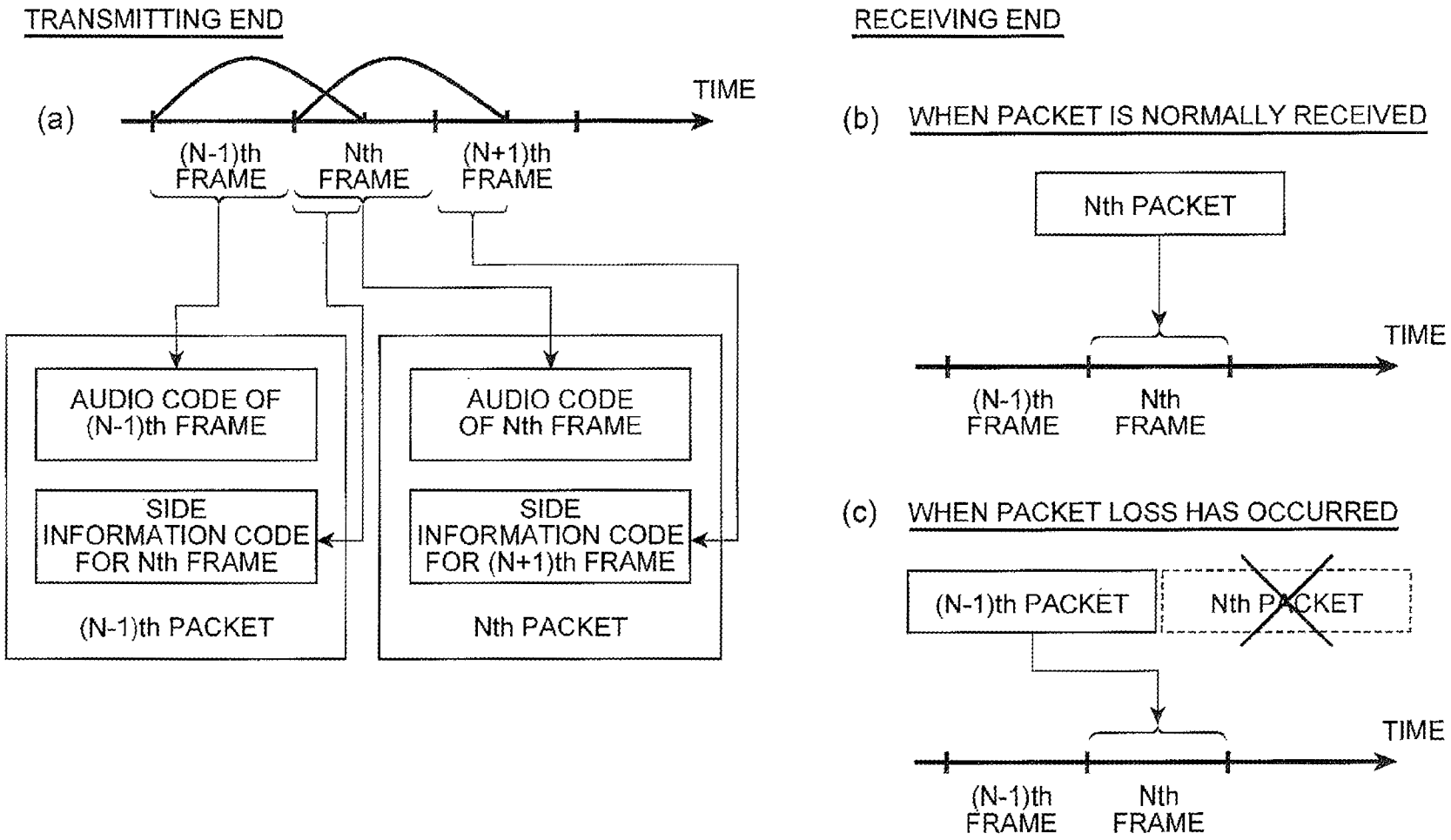
FIG. 3 is a view showing an example of a temporal relationship between packets and a decoded signal.

In the embodiments of the audio coding system, the side information that is used for packet loss concealment is contained in a previous packet. FIG. 3 shows an example of a temporal relationship between an audio code and a side information code contained in a packet. As illustrated in FIG. 3, in examples the side information can be parameters (pitch lag, adaptive codebook gain, etc.) that are calculated for a look-ahead signal in CELP encoding.

Because the side information is contained in a previous packet, it is possible to perform decoding without waiting for a packet that arrives after a packet to be decoded. Further, when packet loss is detected, because the side information for a frame to be concealed is obtained from the previous packet, it is possible to implement highly accurate packet loss concealment without waiting for the next packet.

In addition, by transmitting parameters for CELP encoding in a look-ahead signal as the side information, it is possible to reduce the inconsistency of adaptive codebooks even in the event of packet loss.

Figure 4:
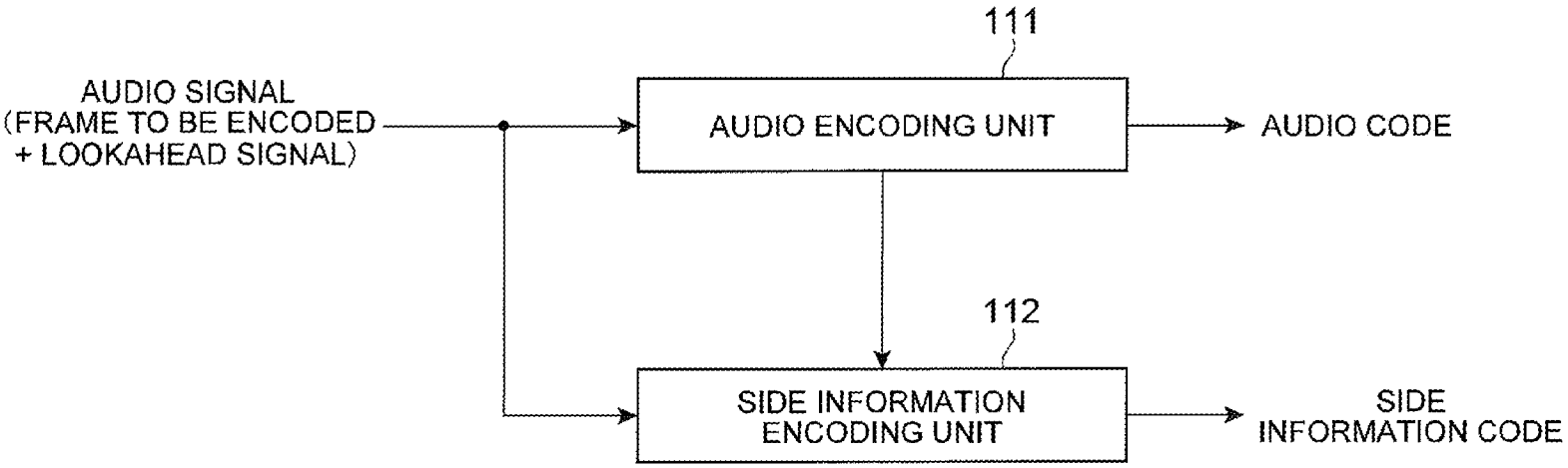
FIG. 4 is a view showing a functional configuration example of an audio signal transmitting device in an example 1 (first example) of the audio coding system.
Figure 5:
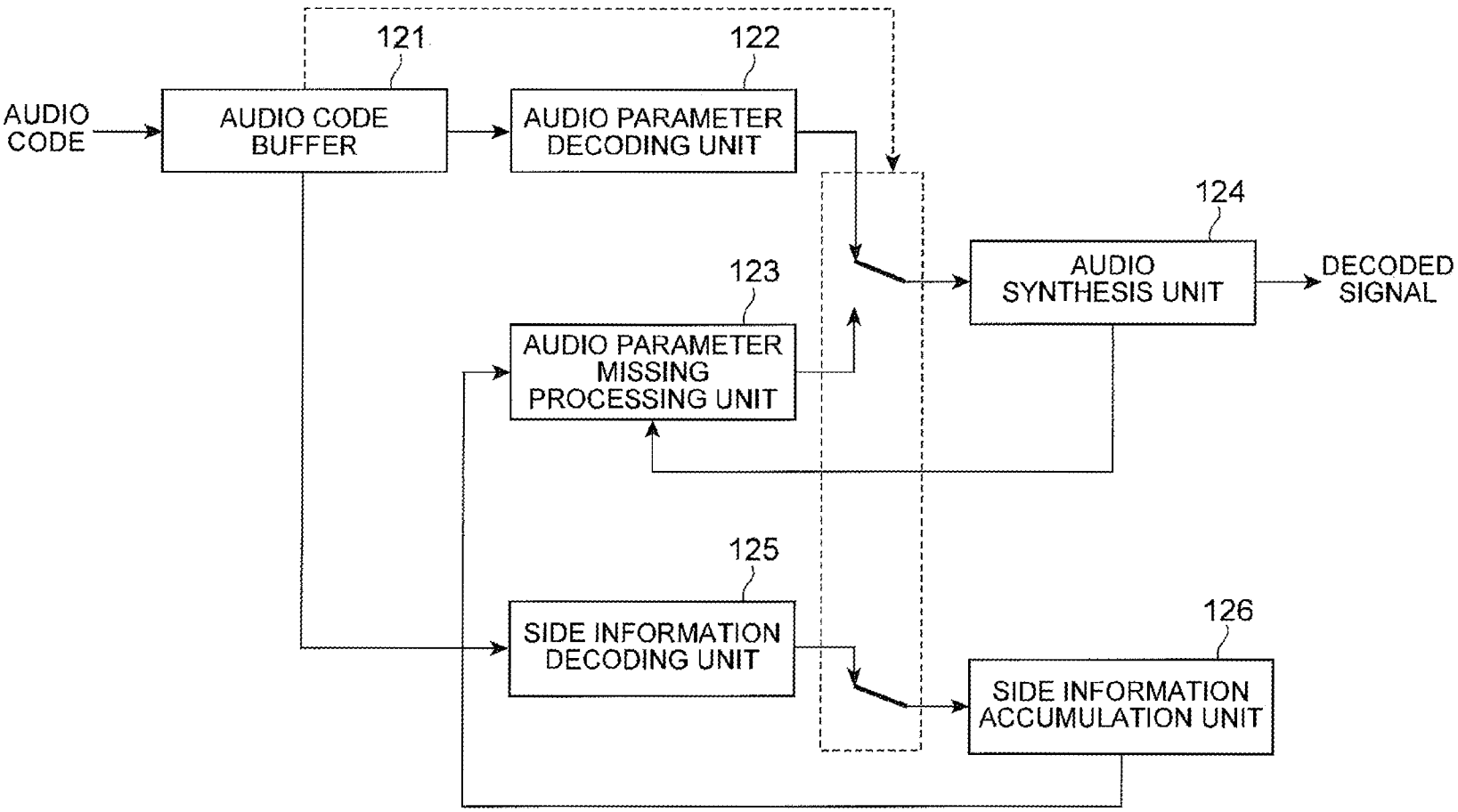
FIG. 5 is a view showing a functional configuration example of an audio signal receiving device in the example 1.
Figure 6:
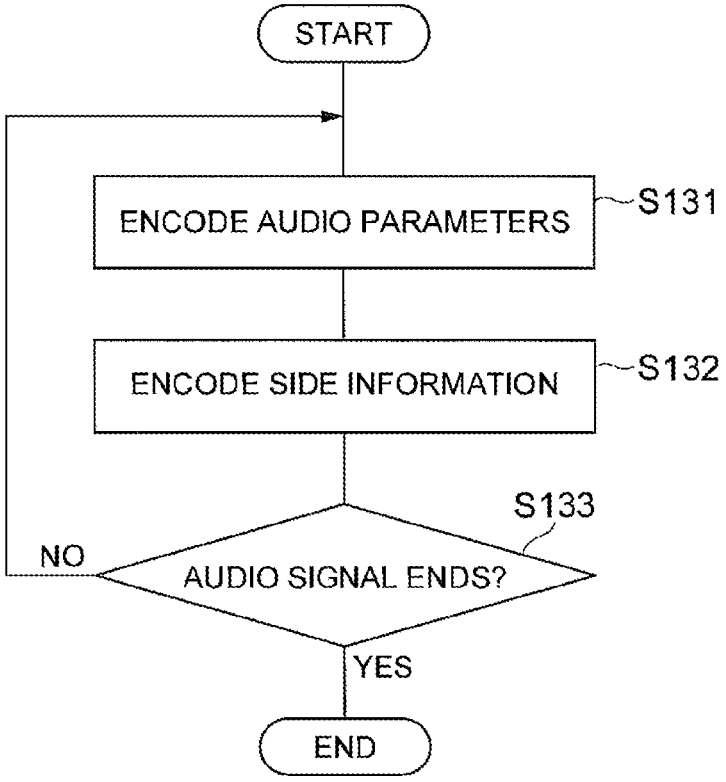
FIG. 6 is a view showing an example procedure of the audio signal transmitting device in the example 1.
Figure 7:
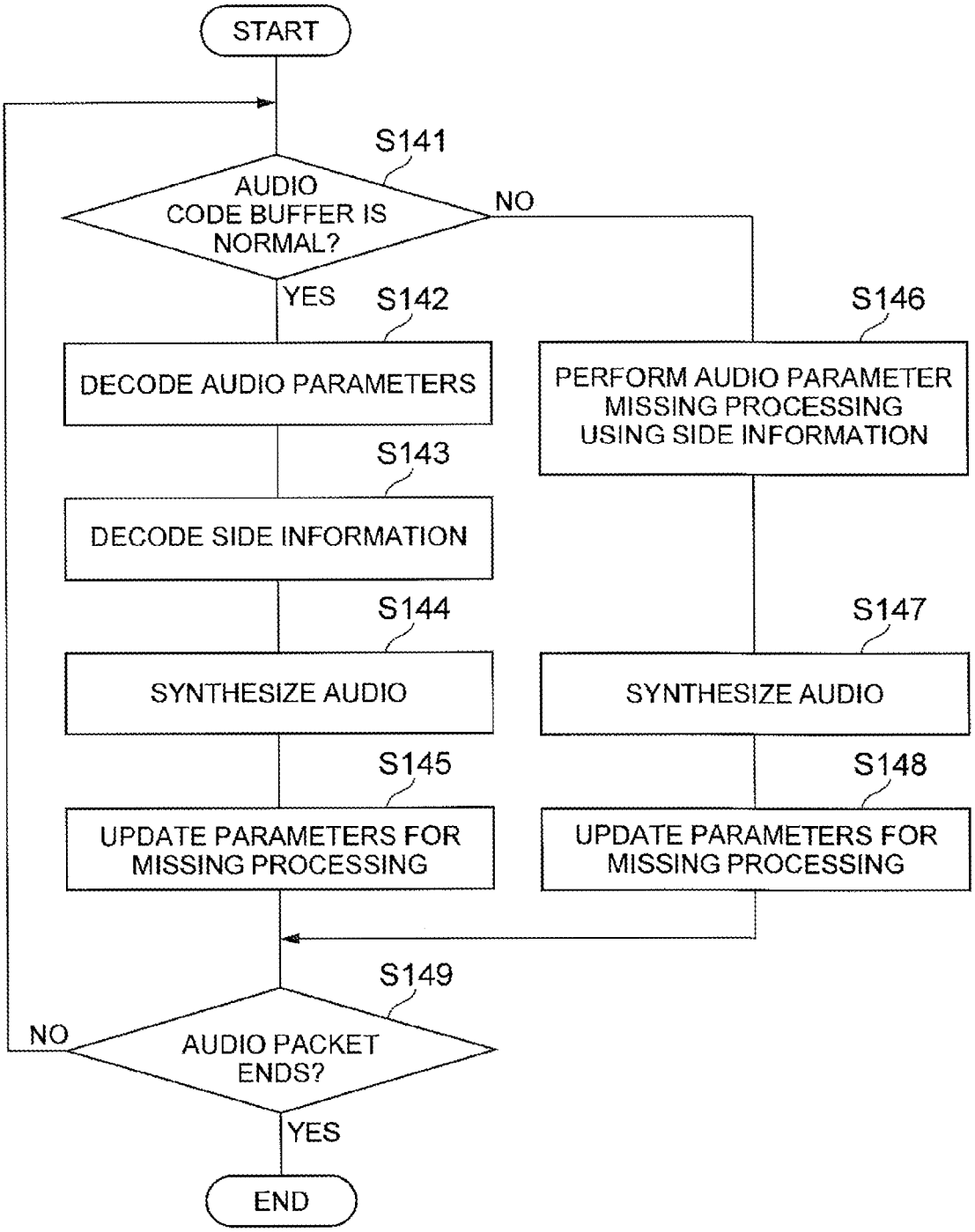
FIG. 7 is a view showing an example procedure of the audio signal receiving device in the example 1.

The embodiments of the audio coding system can include an audio signal transmitting device (audio encoding device) and an audio signal receiving device (audio decoding device). A functional configuration example of an audio signal transmitting device (such as an audio encoding device) is shown in FIG. 4, and an example procedure of the same is shown in FIG. 6. Further, a functional configuration example of an audio signal receiving device (such as an audio decoder device) is shown in FIG. 5, and an example procedure of the same is shown in FIG. 7.

As shown in FIG. 4, the audio signal transmitting device includes an audio encoding unit 111 and a side information encoding unit 112. As shown in FIG. 5, the audio signal receiving device includes an audio code buffer 121, an audio parameter decoding unit 122, an audio parameter missing processing unit 123, an audio synthesis unit 124, a side information decoding unit 125, and a side information accumulation unit 126. As used herein, the term "unit" describes hardware that may also execute software to perform the described functionality. The audio signal transmitting device may be a computing device or computer, including circuitry in the form of hardware, or a combination of hardware and software, capable of performing the described functionality. The audio signal transmitting device may be one or more separate systems or devices included in the audio coding system, or may be combined with other systems or devices within the audio coding system. In other examples, fewer or additional units may be used to illustrate the functionality of the audio signal transmitting device.

The audio signal transmitting device encodes an audio signal for each frame and can transmit the audio signal by the example procedure shown in FIG. 6.

The audio encoding unit 111 can calculate audio parameters for a frame to be encoded and output an audio code (Step S131 in FIG. 6).

The side information encoding unit 112 can calculate audio parameters for a look-ahead signal and output a side information code (Step S132 in FIG. 6).

It is determined whether the audio signal ends, and the above steps can be repeated until the audio signal ends (Step S133 in FIG. 6).

The audio signal receiving device decodes a received audio packet and outputs an audio signal by the example procedure shown in FIG. 7.

The audio code buffer 121 waits for the arrival of an audio packet and accumulates an audio code. When the audio packet has correctly arrived, the processing is switched to the audio parameter decoding unit 122. On the other hand, when the audio packet has not correctly arrived, the processing is switched to the audio parameter missing processing unit 123 (Step S141 in FIG. 7).

<When Audio Packet is Correctly Received>

The audio parameter decoding unit 122 decodes the audio code and outputs audio parameters (Step S142 in FIG. 7).

The side information decoding unit 125 decodes the side information code and outputs side information. The outputted side information is sent to the side information accumulation unit 126 (Step S143 in FIG. 7).

The audio synthesis unit 124 synthesizes an audio signal from the audio parameters output from the audio parameter decoding unit 122 and outputs the synthesized audio signal (Step S144 in FIG. 7).

The audio parameter missing processing unit 123 accumulates the audio parameters output from the audio parameter decoding unit 122 in preparation for packet loss (Step S145 in FIG. 7).

The audio code buffer 121 determines whether the transmission of audio packets has ended, and when the transmission of audio packets has ended, stops the processing. While the transmission of audio packets continues, the above Steps S141 to S146 are repeated (Step S147 in FIG. 7).

<When Audio Packet is Lost>

The audio parameter missing processing unit 123 reads the side information from the side information accumulation unit 126 and carries out prediction for the parameter(s) not contained in the side information and thereby outputs the audio parameters (Step S146 in FIG. 7).

The audio synthesis unit 124 synthesizes an audio signal from the audio parameters output from the audio parameter missing processing unit 123 and outputs the synthesized audio signal (Step S144 in FIG. 7).

The audio parameter missing processing unit 123 accumulates the audio parameters output from the audio parameter missing processing unit 123 in preparation for packet loss (Step S145 in FIG. 7).

The audio code buffer 121 determines whether the transmission of audio packets has ended, and when the transmission of audio packets has ended, stops the processing. While the transmission of audio packets continues, the above Steps S141 to S146 are repeated (Step S147 in FIG. 7).

Example 1

In this example of a case where a pitch lag is transmitted as the side information, the pitch lag can be used for generation of a packet loss concealment signal at the decoding end.

The functional configuration example of the audio signal transmitting device is shown in FIG. 4, and the functional configuration example of the audio signal receiving device is shown in FIG. 5. An example of the procedure of the audio signal transmitting device is shown in FIG. 6, and an example of the procedure of the audio signal receiving device is shown in FIG. 7.

<Transmitting End>

In the audio signal transmitting device, an input audio signal is sent to the audio encoding unit 111.

The audio encoding unit 111 encodes a frame to be encoded by CELP encoding (Step 131 in FIG. 6). For the details of CELP encoding, the method described in 3GPP TS26-190 can be used, for example. The details of the procedure of CELP encoding are omitted. Note that, in the CELP encoding, local decoding is performed at the encoding end. The local decoding is to decode an audio code also at the encoding end and obtain parameters (ISP parameter and corresponding ISF parameter, pitch lag, long-term prediction parameter, adaptive codebook, adaptive codebook gain, fixed codebook gain, fixed codebook vector, etc.) required for audio synthesis. The parameters obtained by the local decoding include: at least one or both of the ISP parameter and the ISF parameter, the pitch lag, and the adaptive codebook, which are sent to the side information encoding unit 112. In an example case where the audio encoding as described in ITU-T G.718ITU-T G.718 is used in the audio encoding unit 111, an index representing the characteristics of a frame to be encoded may also be sent to the side information encoding unit 112. In embodiments, encoding different from CELP encoding may be used in the audio encoding unit 111. In embodiments using different encoding, at least one or both of the ISP parameter and the ISF parameter, the pitch lag, and the adaptive codebook can be separately calculated from an input signal, or a decoded signal obtained by the local decoding, and sent to the side information encoding unit 112.

Figure 8:
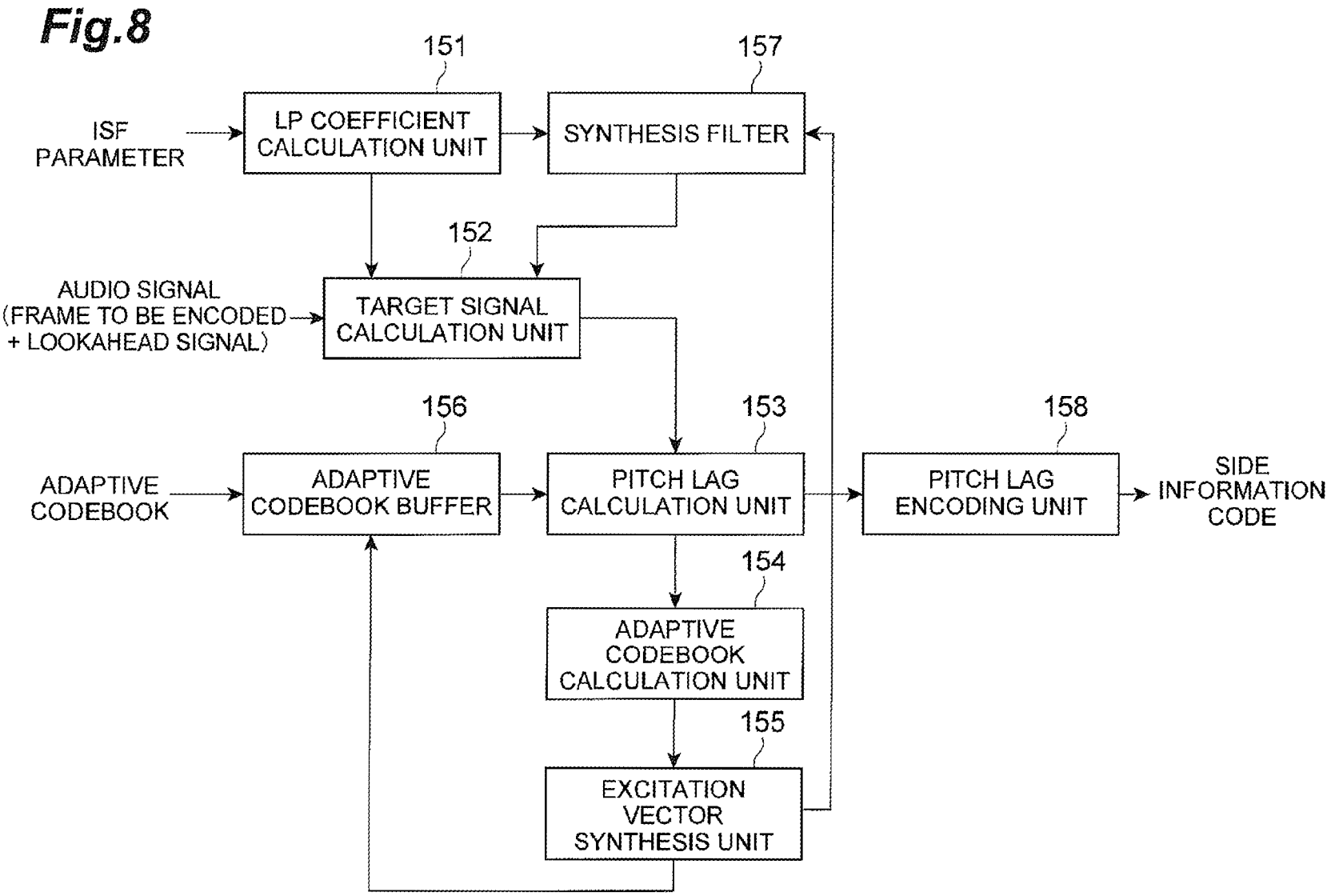
FIG. 8 is a view showing a functional configuration example of a side information encoding unit in the example 1.

The side information encoding unit 112 calculates a side information code using the parameters calculated by the audio encoding unit 111 and the look-ahead signal (Step 132 in FIG. 6). As shown in the example of FIG. 8, the side information encoding unit 112 includes an LP coefficient calculation unit 151, a target signal calculation unit 152, a pitch lag calculation unit 153, an adaptive codebook calculation unit 154, an excitation vector synthesis unit 155, an adaptive codebook buffer 156, a synthesis filter 157, and a pitch lag encoding unit 158. An example procedure in the side information encoding unit is shown in FIG. 9.

Figure 9:
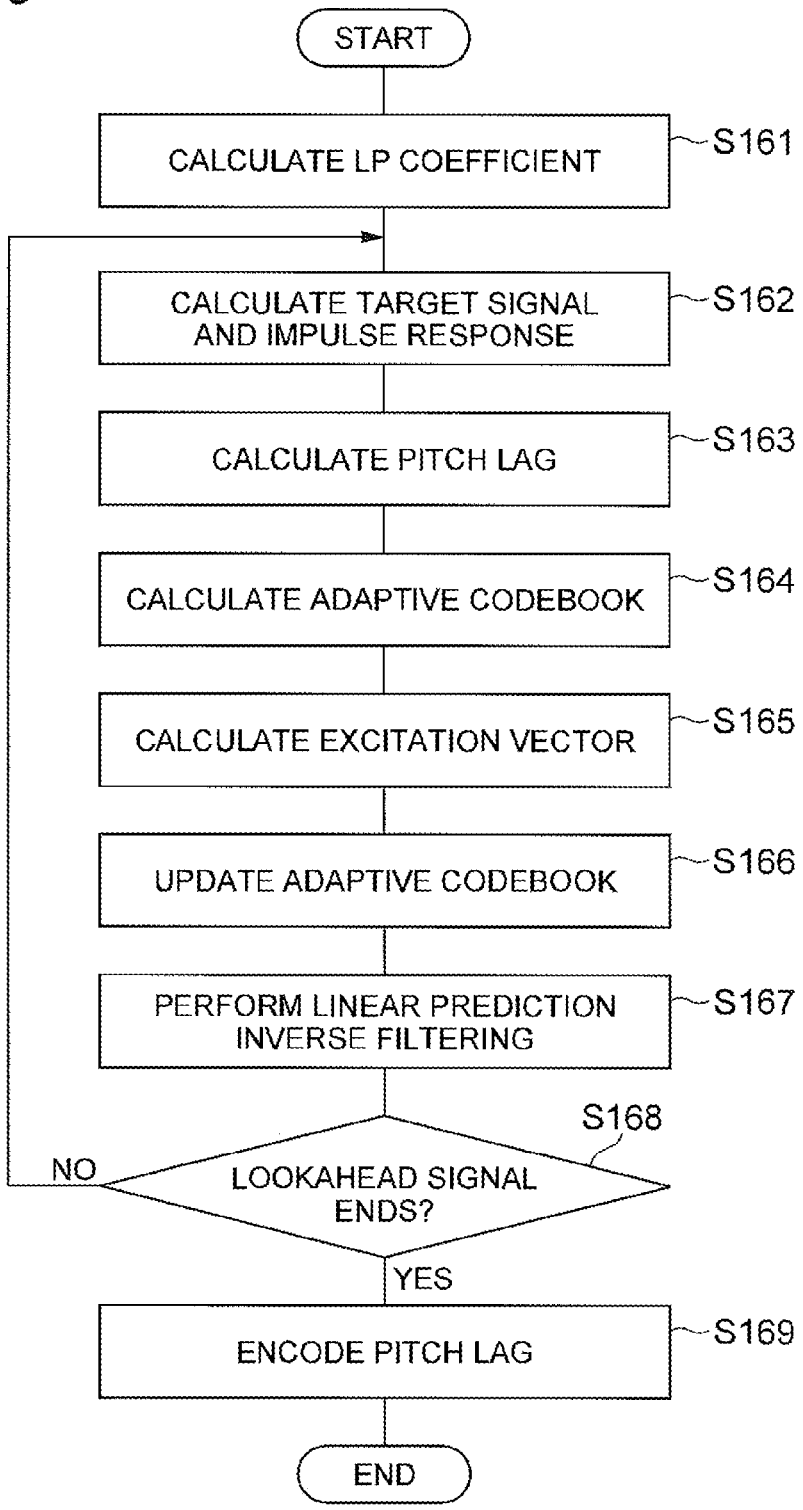
FIG. 9 is a view showing an example procedure of the side information encoding unit in the example 1.

The LP coefficient calculation unit 151 calculates an LP coefficient using the ISF parameter calculated by the audio encoding unit 111 and the ISF parameter calculated in the past several frames (Step 161 in FIG. 9). The procedure of the LP coefficient calculation unit 151 is shown in FIG. 10.

Figure 10:
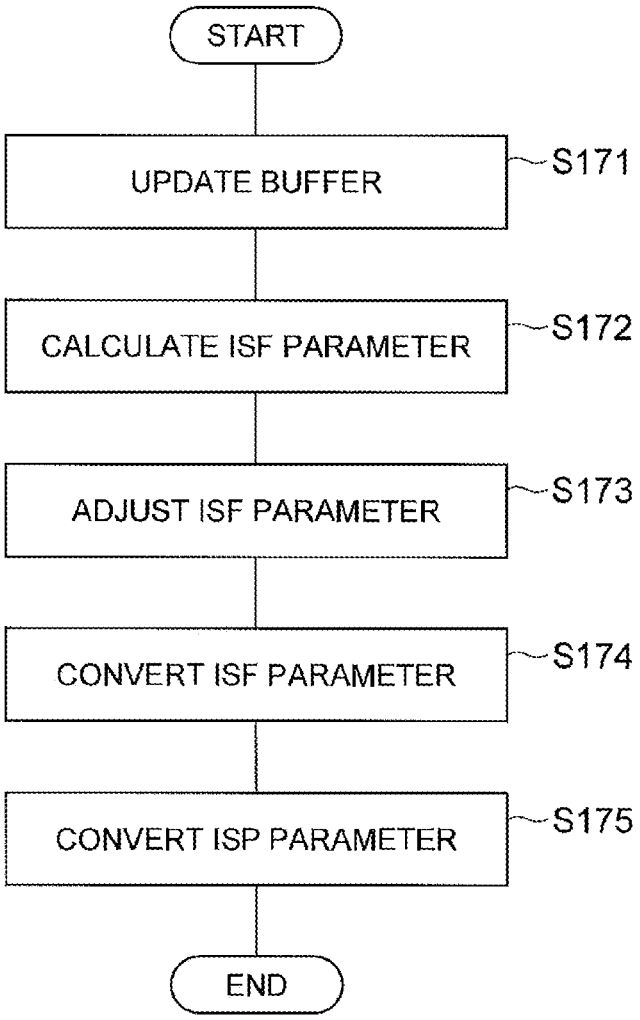
FIG. 10 is a view showing an example procedure of an LP coefficient calculation unit in the example 1.

First, the buffer is updated using the ISF parameter obtained from the audio encoding unit 111 (Step 171 in FIG. 10). Next, the ISF parameter $\dot{\omega}_i$ in the look-ahead signal is calculated. The ISF parameter $\dot{\omega}_i$ is calculated by the following equation (Step 172 in FIG. 10).

$$\dot{\omega}_i = \alpha\omega_i^{(-1)} + (1-\alpha)\vec{\omega}_i \quad \text{Equation 2}$$

$$\vec{\omega}_i = \beta\omega_i^C + (1-\beta)\frac{\omega_i^{(-3)} + \omega_i^{(-2)} + \omega_i^{(-1)}}{3} \quad \text{Equation 3}$$

where $\omega_i^{(-j)}$ is the ISF parameter, stored in the buffer, which is for the frame preceding by j-number of frames. Further, $\omega_i^C$ is the ISF parameter during the speech period that is calculated in advance by learning or the like. β is a constant, and it may be a value such as 0.75, for example, though not limited thereto. Further, α is also constant, and it may be a value such as 0.9, for example, though not limited thereto. $\omega_i^C$, α and β may be varied by the index representing the characteristics of the frame to be encoded as in the ISF concealment described in ITU-T G.718, for example.

In addition, the values of i are arranged so that $\dot{\omega}_i$ satisfies $0<\dot{\omega}_0<\dot{\omega}_1<\ldots\dot{\omega}_{14}$, and the values of $\dot{\omega}_i$ can be adjusted so that the adjacent $\omega_i$ is not too close. As a procedure to adjust the value of $\dot{\omega}_i$, ITU-T G.718 (Equation 151) may be used, for example (Step 173 in FIG. 10).

After that, the ISF parameter $\dot{\omega}_i$ is converted into an ISP parameter and interpolation can be performed for each sub-frame. As an example method of calculating the ISP parameter from the ISF parameter, the method described in the section 6.4.4 in ITU-T G.718 may be used, and as a method of interpolation, the procedure described in the section 6.8.3 in ITU-T G.718 may be used (Step 174 in FIG. 10).

Then, the ISP parameter for each sub-frame is converted into an LP coefficient $\dot{\alpha}_j^i$ ($0<i\leq P$, $0\leq j<M_{la}$). The number of sub-frames contained in the look-ahead signal is $M_{la}$. For the conversion from the ISP parameter to the LP coefficient, in an example, the procedure described in the section 6.4.5 in ITU-T G.718 may be used (Step 175 in FIG. 10).

The target signal calculation unit 152 calculates a target signal x(n) and an impulse response h(n) by using the LP coefficient $\dot{\alpha}_j^i$ (Step 162 in FIG. 9). An example process to obtain the target signal is described in section 6.8.4.1.3 of ITU-T G.718, where the target signal is obtained by applying an perceptual weighting filter to a linear prediction residual signal (FIG. 11).

Figure 11:
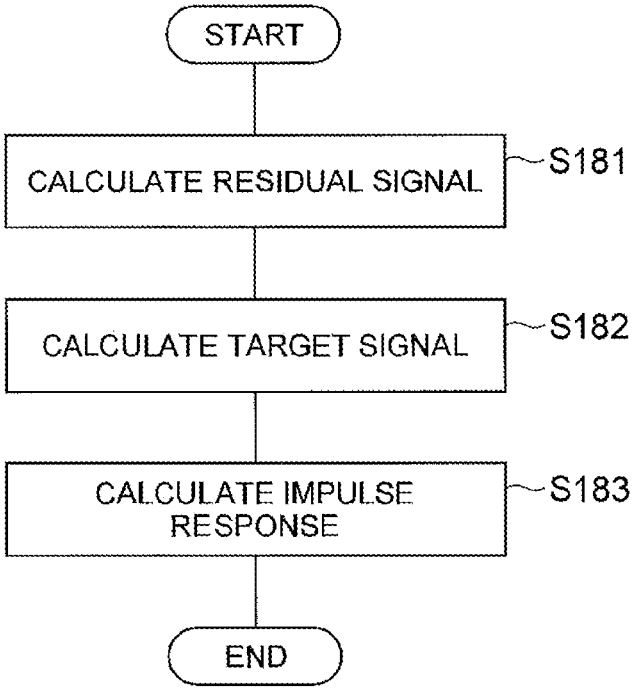
FIG. 11 is a view showing an example procedure of a target signal calculation unit in the example 1.

First, a residual signal r(n) of the look-ahead signal $S_{pre}^l(n)$ ($0\leq n<L'$) is calculated using the LP coefficient according to the following equation (Step 181 in FIG. 11).

$$r(n) = s_{pre}^l(n) + \sum_{i=1}^{P} \dot{\alpha}_i^j \cdot s_{pre}^l(n-i) \quad \text{Equation 4}$$

Note that L' indicates the number of samples of a sub-frame, and L indicates the number of samples of a frame to be encoded $s_{pre}(n)$ ($0\leq n<L$). Then, $s_{pre}^l(n-p)=s_{pre}(n+L-p)$ is satisfied.

In addition, the target signal x(n) ($0\leq n<L'$) is calculated by the following equations (Step 182 in FIG. 11).

$$e(n) = r(n) + \sum_{i=1}^{P} \dot{\alpha}_i^j \cdot e(n-i)(0 \leq n < L') \quad \text{Equation 5}$$

$$e(n) = s(n+L-1) - \hat{s}(n+L-1)(-P \leq n < 0) \quad \text{Equation 6}$$

$$\dot{e}(n) = r(n) + \sum_{i=1}^{P} \dot{\alpha}_i^j \cdot \dot{e}(n-i) \quad \text{Equation 7}$$

$$x(n) = e(n) + \gamma \cdot e(n-1) \quad \text{Equation 8}$$

where an perceptual weighting filter γ=0.68. The value of the perceptual weighting filter may be a different value according to the design policy of audio encoding.

Then, the impulse response h(n) ($0\leq n<L'$) is calculated by the following equations (Step 183 in FIG. 11).

$$\dot{h}(n) = \dot{\alpha}_i^j + \sum_{i=1}^{P} \dot{\alpha}_i^j \cdot \dot{h}(n-i) \quad \text{Equation 9}$$

$$h(n) = \dot{h}(n) + \gamma \cdot \dot{h}(n-1) \quad \text{Equation 10}$$

The pitch lag calculation unit 153 calculates a pitch lag for each sub-frame by calculating k that maximizes the following equation (Step 163 in FIG. 9). Note that, in order to reduce the amount of calculations, the above-described target signal calculation (Step 182 in FIG. 11) and the impulse response calculation (Step 183 in FIG. 11) may be omitted, and the residual signal may be used as the target signal.

$$T_p = \operatorname{argmax} T_k$$

$$T_k = \frac{\sum_{n=0}^{L'-1} x(n)y_k(n)}{\sqrt{\sum_{n=0}^{L'-1} y_k(n)y_k(n)}} \quad \text{Equation 11}$$

$$y_k(n) = \sum_{i=0}^{n} v'(i) \cdot h(n-i) \quad \text{Equation 12}$$

$$v'(n) = \sum_{i=-1}^{l} \mathrm{Int}(i) \cdot u(n + N_{adapt} - T_p + i) \quad \text{Equation 13}$$

Note that $y_k(n)$ is obtained by convoluting the impulse response with the linear prediction residual. Int(i) indicates an interpolation filter. The details of an example of an interpolation filter are described in the section 6.8.4.1.4.1 in ITU-T G.718. As a matter of course, $v'(n)=u(n+N_{adapt}-T_p+i)$ may be employed without using the interpolation filter.

Although the pitch lag can be calculated as an integer by the above-described calculation method, the accuracy of the pitch lag may be increased to after the decimal point accuracy by interpolating the above $T_k$.

A procedure to calculate the pitch lag after the decimal point by interpolation can be performed, such as by the processing method described in the section 6.8.4.1.4.1 in ITU-T G.718.

The adaptive codebook calculation unit 154 calculates an adaptive codebook vector v'(n) and a long-term prediction parameter from the pitch lag $T_p$ and the adaptive codebook u(n) stored in the adaptive codebook buffer 156 according to the following equation (Step 164 in FIG. 9).

$$v'(n) = \sum_{i=-1}^{l} \mathrm{Int}(i) \cdot u(n + N_{adapt} - T_p + i) \quad \text{Equation 14}$$

For the details of an example of the procedure to calculate the long-term parameter, the method described in the section 5.7 in 3GPP TS26-190 may be used.

The excitation vector synthesis unit 155 multiplies the adaptive codebook vector v'(n) by a predetermined adaptive codebook gain $g_p^C$ and outputs an excitation signal vector according to the following equation (Step 165 in FIG. 9).

$$e(n)=g_p^C \cdot v'(n) \quad \text{Equation 15}$$

Although the value of the adaptive codebook gain $g_p^C$ may be 1.0 or the like, for example, a value obtained in advance by learning may be used, or it may be varied by the index representing the characteristics of the frame to be encoded.

Then, the state of the adaptive codebook u(n) stored in the adaptive codebook buffer 156 is updated by the excitation signal vector according to the following equations (Step 166 in FIG. 9).

$$u(n)=u(n+L)(0 \le n < N-L) \quad \text{Equation 16}$$

$$u(n+N-L)=e(n)(0 \le n < L) \quad \text{Equation 17}$$

The synthesis filter 157 synthesizes a decoded signal according to the following equation by linear prediction inverse filtering using the excitation signal vector as an excitation source (Step 167 in FIG. 9).

$$\hat{s}(n) = e(n) - \sum_{i=1}^{P} \hat{a}_i \cdot \hat{s}(n-i) \quad \text{Equation 18}$$

The above-described Steps 162 to 167 in FIG. 9 are repeated for each sub-frame until the end of the look-ahead signal (Step 168 in FIG. 9).

The pitch lag encoding unit 158 encodes the pitch lag $T_p^{(j)}$ $(0 \le j < M_{la})$ that is calculated in the look-ahead signal (Step 169 in FIG. 9). The number of sub-frames contained in the look-ahead signal is $M_{la}$.

Encoding may be performed by a method such as one of the following methods, for example, although any method may be used for encoding.

1. A method that performs binary encoding, scalar quantization, vector quantization or arithmetic encoding on a part or the whole of the pitch lag $T_p^{(j)}$ $(0 \le j < M_{la})$ and transmits the result.
2. A method that performs binary encoding, scalar quantization, vector quantization or arithmetic encoding on a part or the whole of a difference $T_p^{(j)} - T_p^{(j-1)}$ $(0 \le j < M_{la})$ from the pitch lag of the previous sub-frame and transmits the result, where $T_p^{(-1)}$ is the pitch lag of the last sub-frame in the frame to be encoded.
3. A method that performs vector quantization or arithmetic encoding on either of a part, or the whole, of the pitch lag $T_p^{(j)}$ $(0 \le j < M_{la})$ and a part or the whole of the pitch lag calculated for the frame to be encoded and transmits the result.
4. A method that selects one of a number of predetermined interpolation methods based on a part or the whole of the pitch lag $T_p^{(j)}$ $(0 \le j < M_{la})$ and transmits an index indicative of the selected interpolation method. At this time, the pitch lag of a plurality of sub-frames used for audio synthesis in the past also may be used for selection of the interpolation method.

For scalar quantization and vector quantization, a codebook determined empirically or a codebook calculated in advance by learning may be used. Further, a method that performs encoding after adding an offset value to the above pitch lag may also be included.

<Decoding End>

As shown in FIG. 5, an example of the audio signal receiving device includes the audio code buffer 121, the audio parameter decoding unit 122, the audio parameter missing processing unit 123, the audio synthesis unit 124, the side information decoding unit 125, and the side information accumulation unit 126. The procedure of the audio signal receiving device is as shown in the example of FIG. 7. The audio signal receiving device may be a computing device or computer, including circuitry in the form of hardware, or a combination of hardware and software, capable of performing the described functionality. The audio signal receiving device may be one or more separate systems or devices included in the audio coding system, or may be combined with other systems or devices within the audio coding system. In other examples, fewer or additional units may be used to illustrate the functionality of the audio signal receiving device.

The audio code buffer 121 determines whether a packet is correctly received or not. When the audio code buffer 121 determines that a packet is correctly received, the processing is switched to the audio parameter decoding unit 122 and the side information decoding unit 125. On the other hand, when the audio code buffer 121 determines that a packet is not correctly received, the processing is switched to the audio parameter missing processing unit 123 (Step 141 in FIG. 7).

<When Packet is Correctly Received>

The audio parameter decoding unit 122 decodes the received audio code and calculates audio parameters required to synthesize the audio for the frame to be encoded (ISP parameter and corresponding ISF parameter, pitch lag, long-term prediction parameter, adaptive codebook, adaptive codebook gain, fixed codebook gain, fixed codebook vector etc.) (Step 142 in FIG. 7).

The side information decoding unit 125 decodes the side information code, calculates a pitch lag $\hat{T}_p^{(j)}$ $(0 \le j < M_{la})$ and stores it in the side information accumulation unit 126. The side information decoding unit 125 decodes the side information code by using the decoding method corresponding to the encoding method used at the encoding end (Step 143 in FIG. 7).

Figure 15:
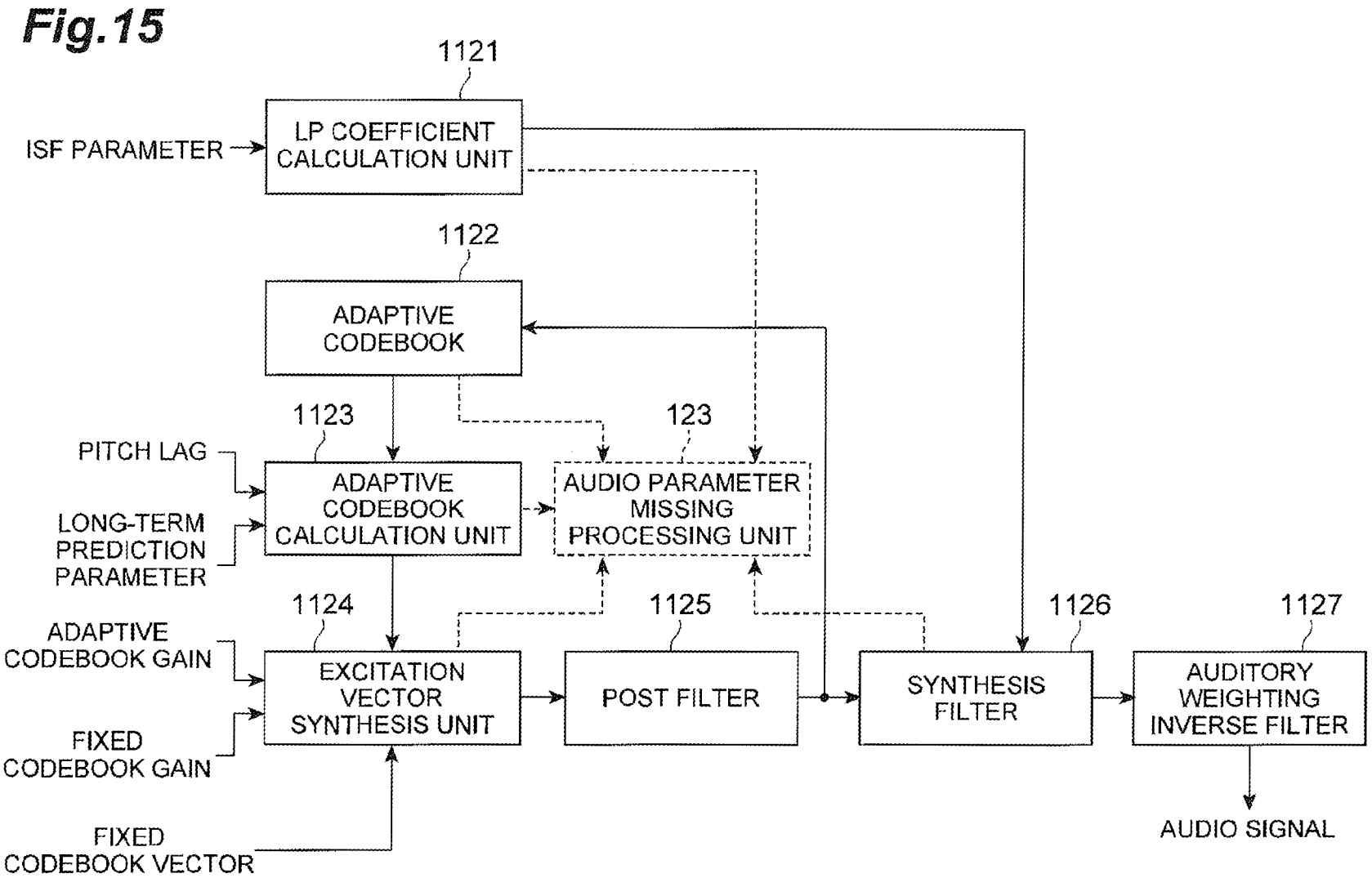
FIG. 15 is a view showing a functional configuration example of an audio synthesis unit in the example 1.
Figure 16:
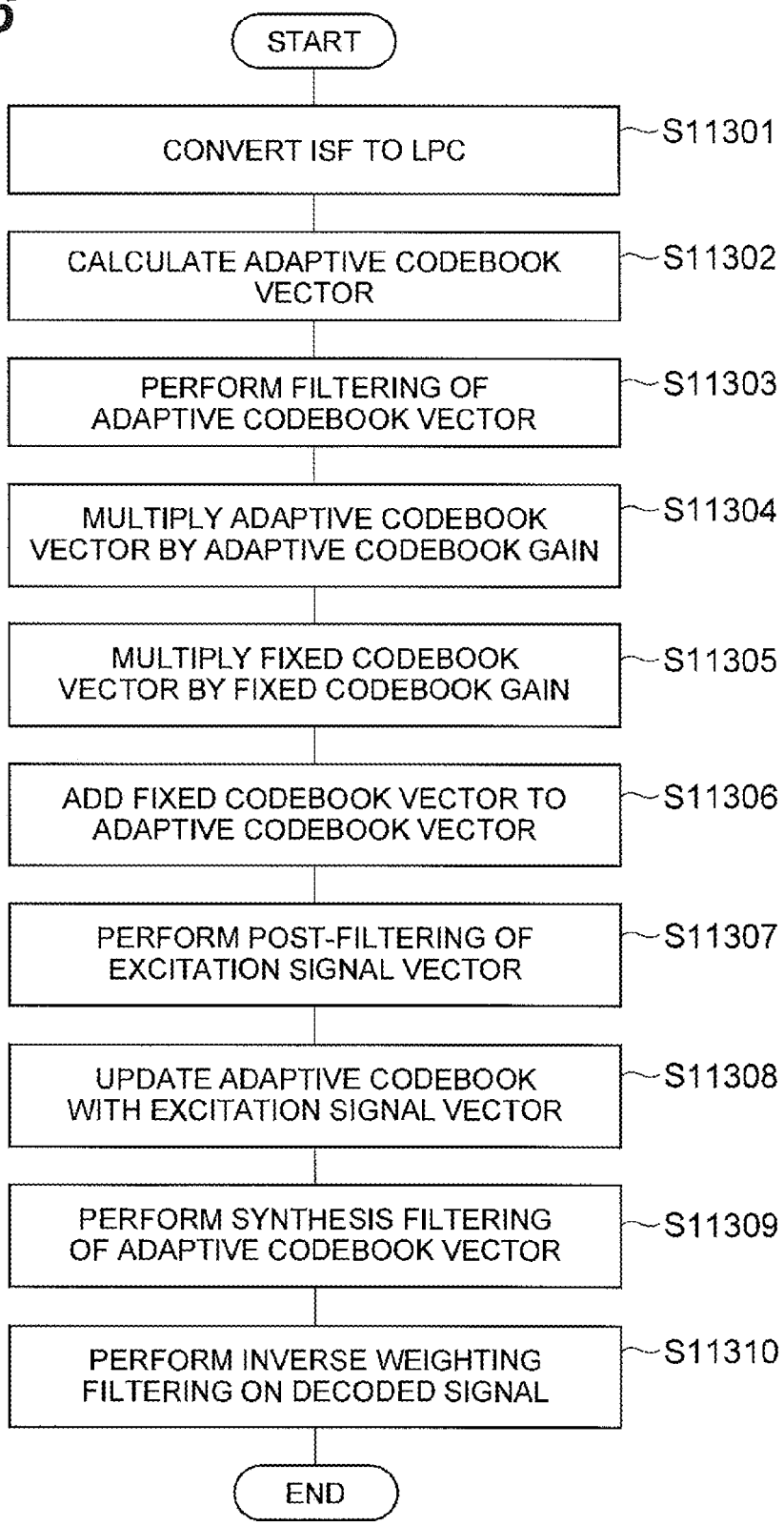
FIG. 16 is a view showing an example procedure of the audio synthesis unit in the example 1.

The audio synthesis unit 124 synthesizes the audio signal corresponding to the frame to be encoded based on the parameters output from the audio parameter decoding unit 122 (Step 144 in FIG. 7). The functional configuration example of the audio synthesis unit 124 is shown in FIG. 15, and an example procedure of the audio synthesis unit 124 is shown in FIG. 16. Note that, although the audio parameter missing processing unit 123 is illustrated to show the flow of the signal, the audio parameter missing processing unit 123 is not included in the functional configuration of the audio synthesis unit 124.

An LP coefficient calculation unit 1121 converts an ISF parameter into an ISP parameter and then performs interpolation processing, and thereby obtains an ISP coefficient for each sub-frame. The LP coefficient calculation unit 1121 then converts the ISP coefficient into a linear prediction coefficient (LP coefficient) and thereby obtains an LP coefficient for each sub-frame (Step 11301 in FIG. 16). For the interpolation of the ISP coefficient and the ISP-LP coefficient, the method described in, for example, section 6.4.5 in ITU-T G.718 may be used.

An adaptive codebook calculation unit 1123 calculates an adaptive codebook vector by using the pitch lag, a long-term prediction parameter and an adaptive codebook 1122 (Step 11302 in FIG. 16). An adaptive codebook vector v'(n) is calculated from the pitch lag $\hat{T}_p^{(j)}$ and the adaptive codebook u(n) according to the following equation.

$$v'(n) = \sum_{i=-1}^{l} \mathrm{Int}(i) \cdot u\left(n + N_{adapt} - \hat{T}_p^{(j)} + i\right)(0 \le n < L') \quad \text{Equation 19}$$

The adaptive codebook vector is calculated by interpolating the adaptive codebook u(n) using FIR filter Int(i). The length of the adaptive codebook is $N_{adapt}$. The filter Int(i) that is used for the interpolation is the same as the interpolation filter of $$v'(n) = \sum_{i=-1}^{l} \mathrm{Int}(i) \cdot u(n + N_{adapt} - T_p + i). \quad \text{Equation 20}$$

This is the FIR filter with a predetermined length 2 l+1. L' is the number of samples of the sub-frame. It is not necessary to use a filter for the interpolation, whereas at the encoder end a filter is used for the interpolation.

The adaptive codebook calculation unit 1123 carries out filtering on the adaptive codebook vector according to the value of the long-term prediction parameter (Step 11303 in FIG. 16). When the long-term prediction parameter has a value indicating the activation of filtering, filtering is performed on the adaptive codebook vector by the following equation.

$$v'(n)=0.18v'(n-1)+0.64v'(n)+0.18v'(n+1) \quad \text{Equation 21}$$

On the other hand, when the long-term prediction parameter has a value indicating no filtering is needed, filtering is not performed, and v(n)=v'(n) is established.

An excitation vector synthesis unit 1124 multiplies the adaptive codebook vector by an adaptive codebook gain $g_p$ (Step 11304 in FIG. 16). Further, the excitation vector synthesis unit 1124 multiplies a fixed codebook vector c(n) by a fixed codebook gain $g_c$ (Step 11305 in FIG. 16). Furthermore, the excitation vector synthesis unit 1124 adds the adaptive codebook vector and the fixed codebook vector together and outputs an excitation signal vector (Step 11306 in FIG. 16).

$$e(n)=g_p \cdot v'(n)+g_c \cdot c(n) \quad \text{Equation 22}$$

A post filter 1125 performs post processing such as pitch enhancement, noise enhancement and low-frequency enhancement, for example, on the excitation signal vector.

An example of details of techniques such as pitch enhancement, noise enhancement and low-frequency enhancement are described in the section 6.1 in 3GPP TS26-190. (Step 11307 in FIG. 16).

The adaptive codebook 1122 updates the state by an excitation signal vector according to the following equations (Step 11308 in FIG. 16).

$$u(n)=u(n+L)(0 \le n < N-L) \quad \text{Equation 23}$$

$$u(n+N-L)=e(n)(0 \le n < L) \quad \text{Equation 24}$$

A synthesis filter 1126 synthesizes a decoded signal according to the following equation by linear prediction inverse filtering using the excitation signal vector as an excitation source (Step 11309 in FIG. 16).

$$\hat{s}(n) = e(n) - \sum_{i=1}^{P} \hat{a}(i) \cdot \hat{s}(n-i) \quad \text{Equation 25}$$

An perceptual weighting inverse filter 1127 applies an perceptual weighting inverse filter to the decoded signal according to the following equation (Step 11310 in FIG. 16).

$$\hat{s}(n)=\hat{s}(n)+\beta \cdot \hat{s}(n-1) \quad \text{Equation 26}$$

The value of β is typically 0.68 or the like, though not limited to this value.

The audio parameter missing processing unit 123 stores the audio parameters (ISF parameter, pitch lag, adaptive codebook gain, fixed codebook gain) used in the audio synthesis unit 124 into the buffer (Step 145 in FIG. 7).

<When Packet Loss is Detected>

Figure 12:
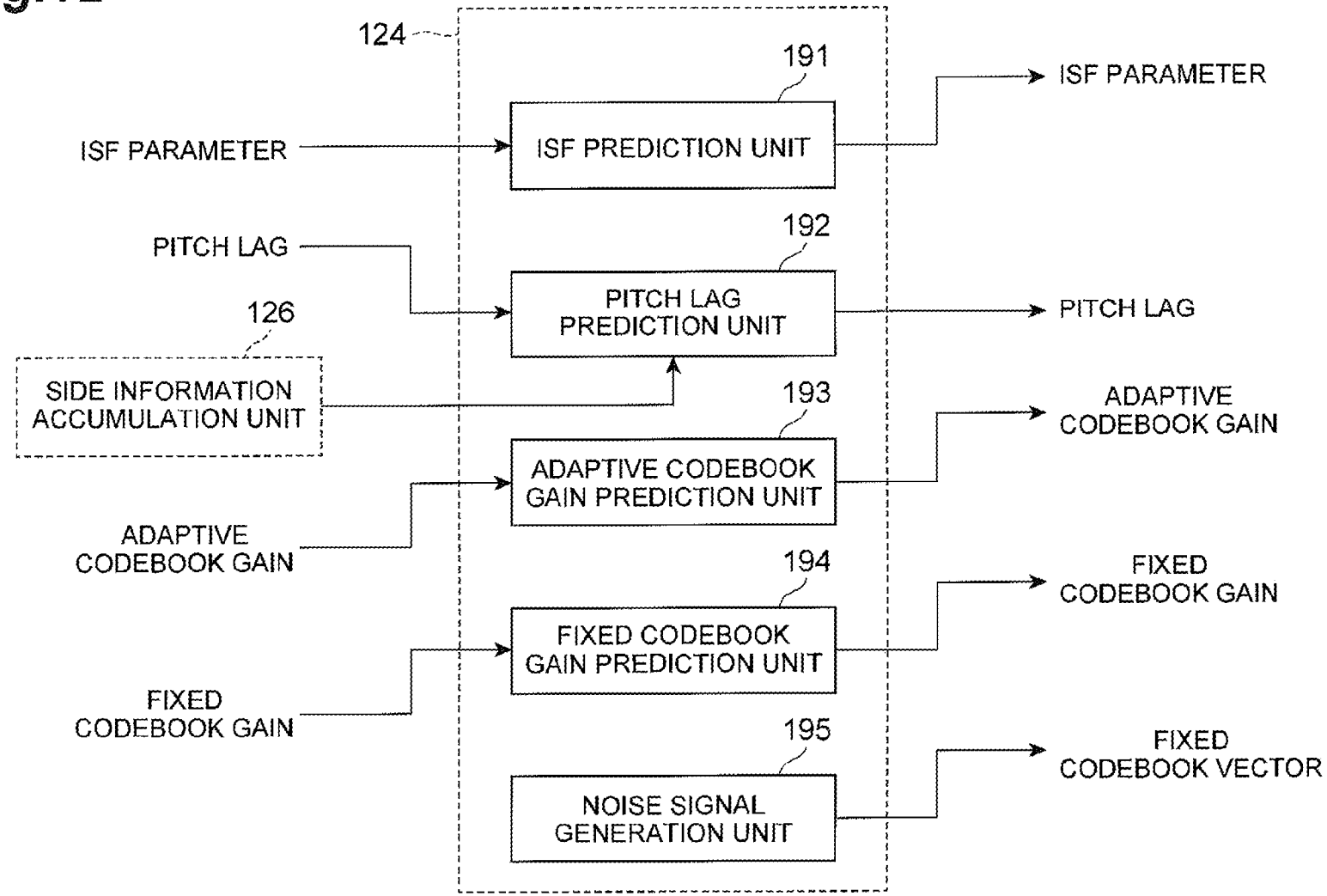
FIG. 12 is a view showing a functional configuration example of an audio parameter missing processing unit in the example 1.

The audio parameter missing processing unit 123 reads a pitch lag $\hat{T}_p^{(j)}$ ($0 \le j < M_{la}$) from the side information accumulation unit 126 and predicts audio parameters. The functional configuration example of the audio parameter missing processing unit 123 is shown in the example of FIG. 12, and an example procedure of audio parameter prediction is shown in FIG. 13.

Figure 13:
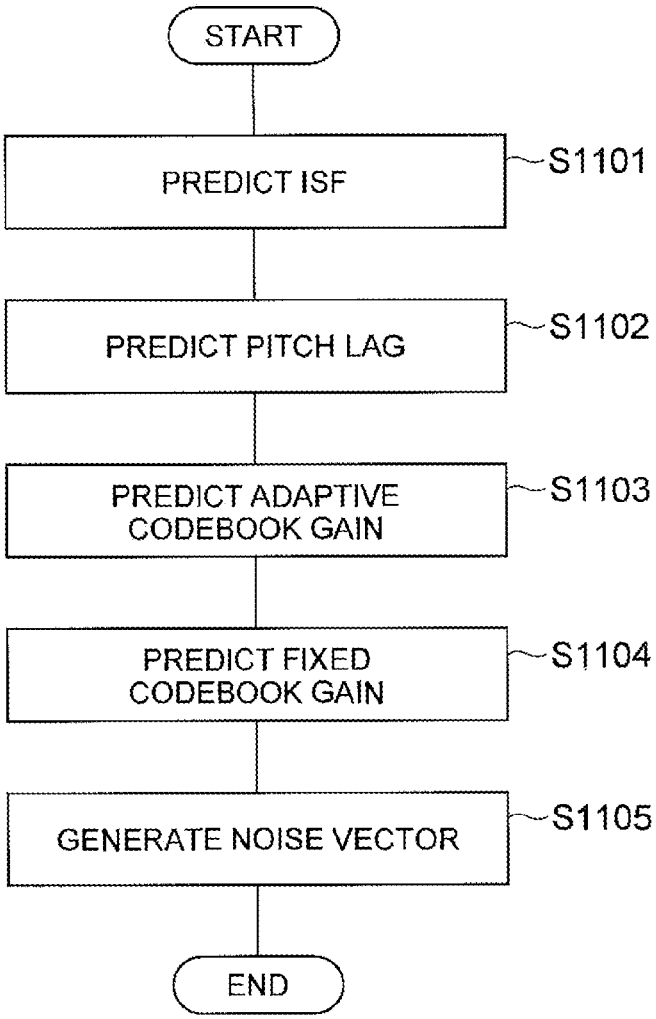
FIG. 13 is a view showing an example procedure of audio parameter prediction in the example 1.

An ISF prediction unit 191 calculates an ISF parameter using the ISF parameter for the previous frame and the ISF parameter calculated for the past several frames (Step 1101 in FIG. 13). The procedure of the ISF prediction unit 191 is shown in FIG. 10.

First, the buffer is updated using the ISF parameter of the immediately previous frame (Step 171 in FIG. 10). Next, the ISF parameter $\dot{\omega}_i$ is calculated according to the following equation (Step 172 in FIG. 10).

$$\dot{\omega}_i = \alpha\omega_i^{(-1)} + (1-\alpha)\bar{\omega}_i \quad \text{Equation 27}$$

$$\bar{\omega}_i = \beta\omega_i^{C} + (1-\beta)\frac{\omega_i^{(-3)} + \omega_i^{(-2)} + \omega_i^{(-1)}}{3} \quad \text{Equation 28}$$

where $\omega_i^{(-j)}$ is the ISF parameter, stored in the buffer, which is for the frame preceding by j-number of frames. Further, $\omega_i^{C}$, α and β are the same values as those used at the encoding end.

In addition, the values of i are arranged so that $\dot{\omega}_i$ satisfies $0<\dot{\omega}_0<\dot{\omega}_1<\ldots\dot{\omega}_{14}$, and values of $\dot{\omega}_i$ are adjusted so that the adjacent $\dot{\omega}_i$ is not too close. As an example procedure to adjust the value of $\dot{\omega}_i$, ITU-T G.718 (Equation 151) may be used (Step 173 in FIG. 10).

A pitch lag prediction unit 192 decodes the side information code from the side information accumulation unit 126 and thereby obtains a pitch lag $\hat{T}_p^{(i)}$ ($0 \le i < M_{la}$). Further, by using a pitch lag $\hat{T}_p^{(-j)}$ ($0 \le j < J$) used for the past decoding, the pitch lag prediction unit 192 outputs a pitch lag $\hat{T}_p^{(i)}$ ($M_{la} \le i < M$). The number of sub-frames contained in one frame is M, and the number of pitch lags contained in the side information is $M_{la}$. For the prediction of the pitch lag $\hat{T}_p^{(i)}$ ($M_{la} \le i < M$), the procedure described in, for example, section 7.11.1.3 in ITU-T G.718 may be used (Step 1102 in FIG. 13).

An adaptive codebook gain prediction unit 193 outputs an adaptive codebook gain $g_p^{(i)}$ ($M_{la} \le i < M$) by using a predetermined adaptive codebook gain $g_p^C$ and an adaptive codebook gain $g_p^{(j)}$ ($0 \le j < J$) used in the past decoding. The number of sub-frames contained in one frame is M, and the number of pitch lags contained in the side information is $M_{la}$. For the prediction of the adaptive codebook gain $g_p^{(i)}$ ($M_{la} \le i < M$), the procedure described in, for example, section 7.11.2.5.3 in ITU-T G.718 may be used (Step 1103 in FIG. 13).

A fixed codebook gain prediction unit 194 outputs a fixed codebook gain $g_c^{(i)}$ ($0 \le i < M$) by using a fixed codebook gain $g_c^{(j)}$ ($0 \le j < J$) used in the past decoding. The number of sub-frames contained in one frame is M. For the prediction of the fixed codebook gain $g_c^{(i)}$ ($0 \le i < M$), the procedure described in the section 7.11.2.6 in ITU-T G.718 may be used, for example (Step 1104 in FIG. 13).

A noise signal generation unit 195 outputs a noise vector, such as a white noise, with a length of L (Step 1105 in FIG. 13). The length of one frame is L.

The audio synthesis unit 124 synthesizes a decoded signal based on the audio parameters output from the audio parameter missing processing unit 123 (Step 144 in FIG. 7). The operation of the audio synthesis unit 124 is the same as the operation of the audio synthesis unit <When audio packet is correctly received> and not redundantly described in detail (Step 144 in FIG. 7).

The audio parameter missing processing unit 123 stores the audio parameters (ISF parameter, pitch lag, adaptive codebook gain, fixed codebook gain) used in the audio synthesis unit 124 into the buffer (Step 145 in FIG. 7).

Although the case of encoding and transmitting the side information for all sub-frames contained in the look-ahead signal is described in the above example, the configuration that transmits only the side information for a specific sub-frame may be employed.

Alternative Example 1-1

As an alternative example of the previously discussed example 1, an example that adds a pitch gain to the side information is described hereinafter. A difference between the alternative example 1-1 and the example 1 is the operation of the excitation vector synthesis unit 155, and therefore description of the other parts is omitted.

<Encoding End>

Figure 14:
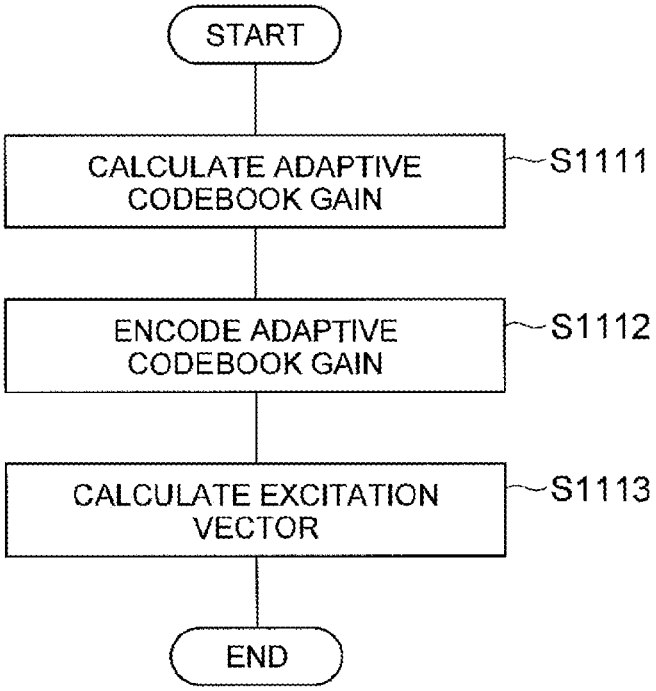
FIG. 14 is a view showing an example procedure of an excitation vector synthesis unit in an alternative example 1-1 of the example 1.

The procedure of the excitation vector synthesis unit 155 is shown in the example of FIG. 14.

An adaptive codebook gain $g_p^C$ is calculated from the adaptive codebook vector v'(n) and the target signal x(n) according to the following equation (Step 1111 in FIG. 14).

$$g_p = \frac{\sum_{n=0}^{L'-1} x(n)y(n)}{\sum_{n=0}^{L'-1} y(n)y(n)}, \text{ bounded by } 0 \le g_p \le 1.2, \quad \text{Equation 29}$$

where y(n) is a signal y(n)=v(n)*h(n) that is obtained by convoluting the impulse response with the adaptive codebook vector.

The calculated adaptive codebook gain is encoded and contained in the side information code (Step 1112 in FIG. 14). For the encoding, scalar quantization using a codebook obtained in advance by learning may be used, although any other technique may be used for the encoding.

By multiplying the adaptive codebook vector by an adaptive codebook gain $\hat{g}_p$ obtained by decoding the code calculated in the encoding of the adaptive codebook gain, an excitation vector is calculated according to the following equation (Step 1113 in FIG. 14).

$$e(n)=\hat{g}_p \cdot v'(n) \quad \text{Equation 30}$$

<Decoding End>

The excitation vector synthesis unit 155 multiplies the adaptive codebook vector v'(n) by an adaptive codebook gain $\hat{g}_p$ obtained by decoding the side information code and outputs an excitation signal vector according to the following equation (Step 165 in FIG. 9).

$$e(n)=\hat{g}_p \cdot v'(n) \quad \text{Equation 31}$$

Alternative Example 1-2

As an alternative example of the example 1, an example that adds a flag for determination of use of the side information to the side information is described hereinafter.

<Encoding End>

Figure 17:
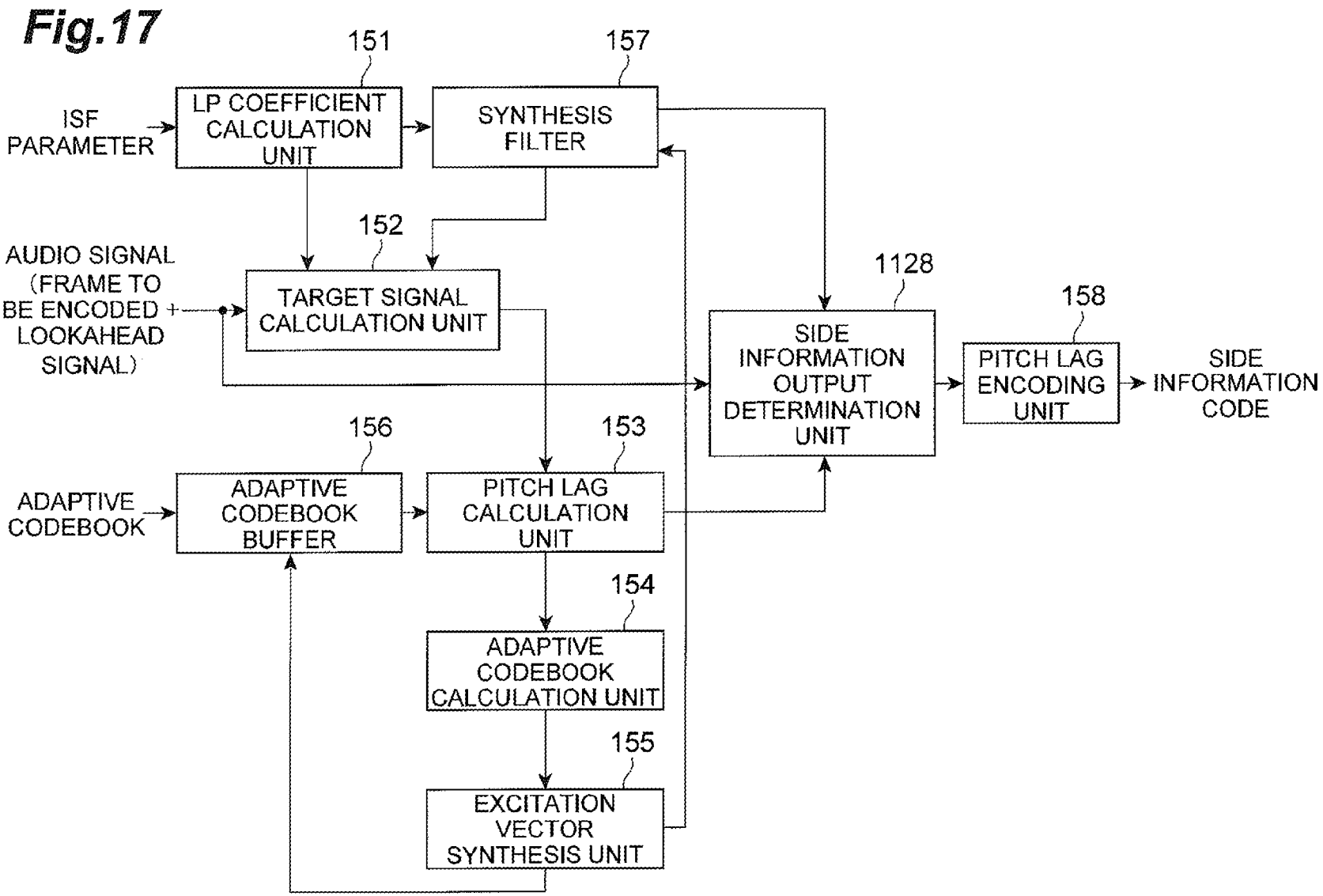
FIG. 17 is a view showing a functional configuration example of a side information encoding unit (when a side information output determination unit is included) in an alternative example 1-2 of the example 1.
Figure 18:
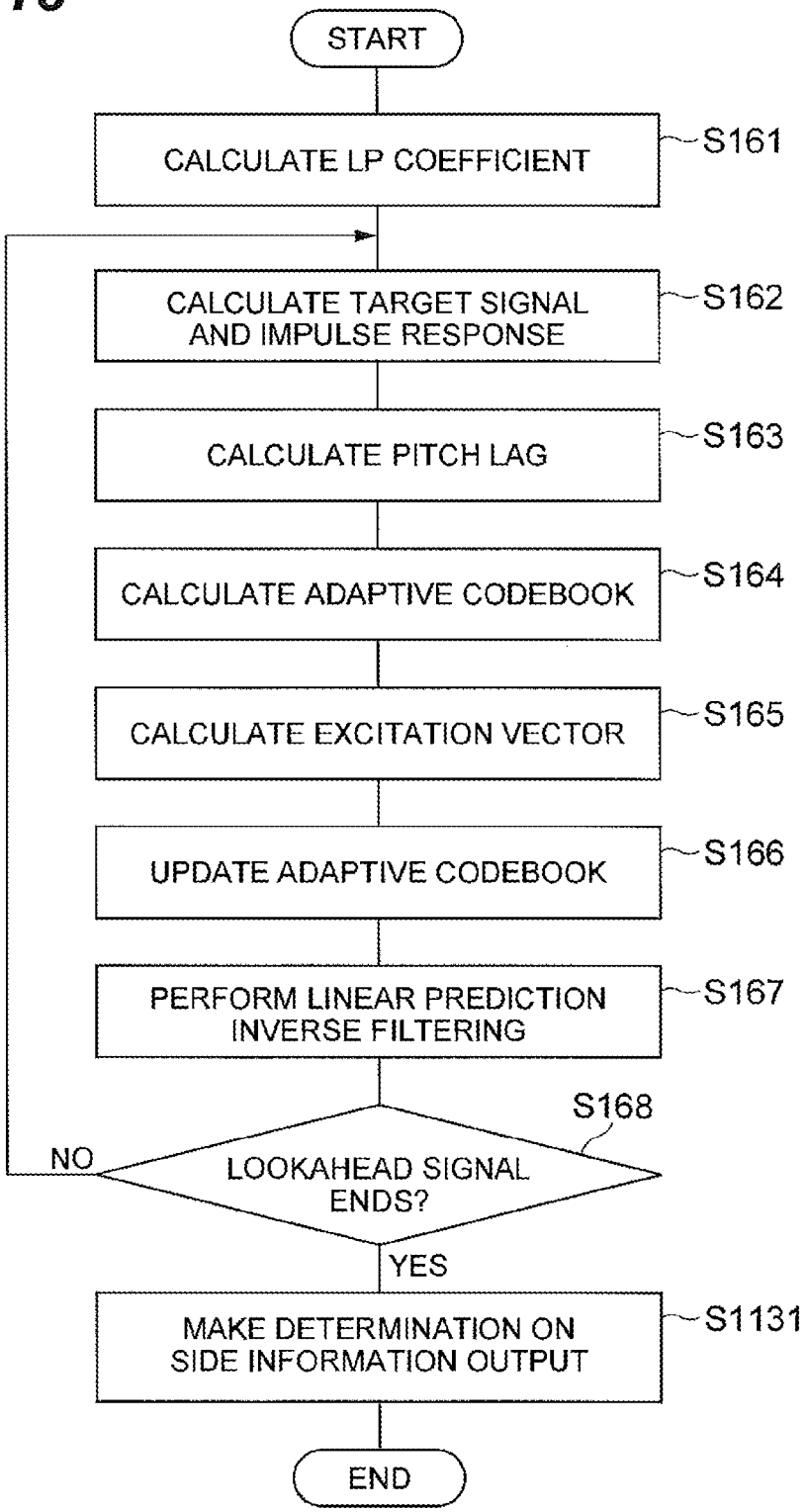
FIG. 18 is a view showing a procedure of the side information encoding unit (when the side information output determination unit is included) in the alternative example 1-2 of the example 1.

The functional configuration example of the side information encoding unit is shown in FIG. 17, and the procedure of the side information encoding unit is shown in the example of FIG. 18. A difference from the example 1 is only a side information output determination unit 1128 (Step 1131 in FIG. 18), and therefore description of the other parts is omitted.

The side information output determination unit 1128 calculates segmental SNR of the decoded signal and the look-ahead signal according to the following equation, and only when segmental SNR exceeds a threshold, sets the value of the flag to ON and adds it to the side information.

$$segSNR = \frac{\sum_{n=0}^{L'-1} \hat{s}^2(n)}{\sum_{n=0}^{L'-1} (s(n) - \hat{s}(n))^2} \quad \text{Equation 32}$$

On the other hand, when segmental SNR does not exceed a threshold, the side information output determination unit 1128 sets the value of the flag to OFF and adds it to the side information (Step 1131 in FIG. 18). Note that, the amount of bits of the side information may be reduced by adding the side information such as a pitch lag and a pitch gain to the flag and transmitting the added side information only when the value of the flag is ON, and transmitting only the value of the flag when the value of the flag is OFF.

<Decoding End>

Figure 19:
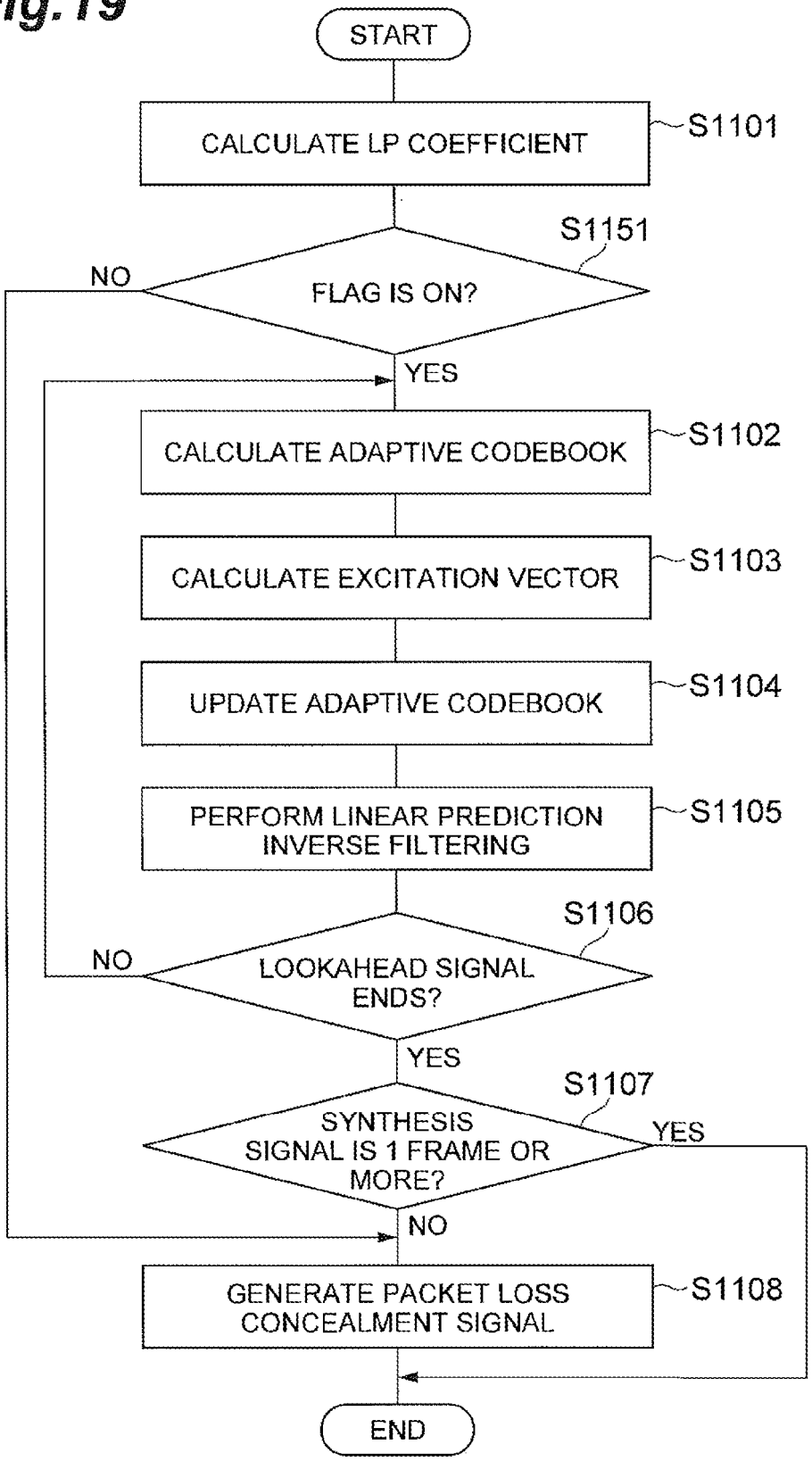
FIG. 19 is a view showing a procedure of audio parameter prediction in the alternative example 1-2 of the example 1.

The side information decoding unit decodes the flag contained in the side information code. When the value of the flag is ON, the audio parameter missing processing unit calculates a decoded signal by the same procedure as in the example 1. On the other hand, when the value of the flag is OFF, it calculates a decoded signal by the packet loss concealment technique without using side information (Step 1151 in FIG. 19).

Example 2

In this example, the decoded audio of the look-ahead signal part is also used when a packet is correctly received.

For purposes of this discussion, the number of sub-frames contained in one frame is M sub-frames, and the length of the look-ahead signal is M' sub-frame(s).

<Encoding End>

Figure 20:
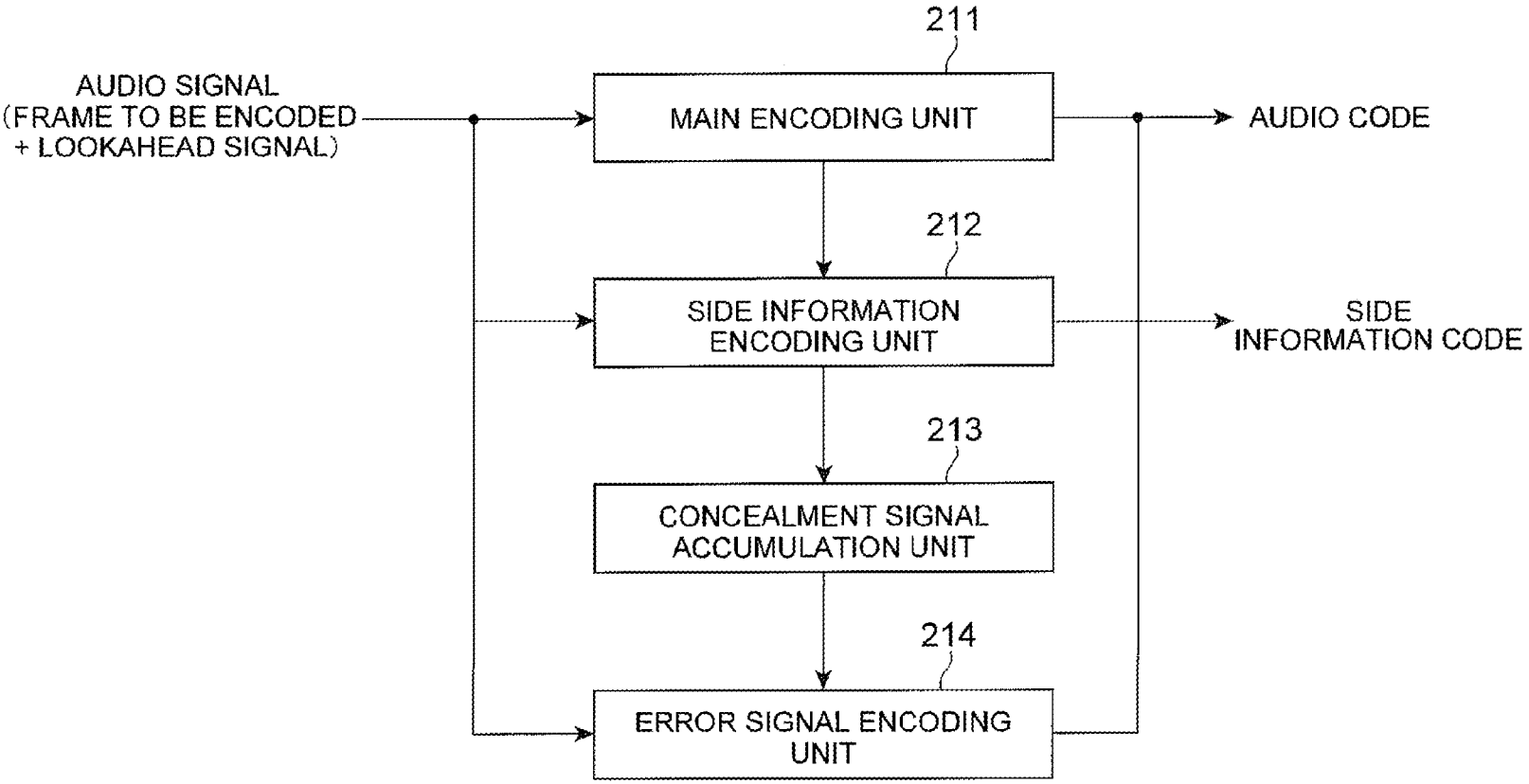
FIG. 20 is a view showing a functional configuration example of an audio signal transmitting device in an example 2 of the audio coding system.

As shown in the example of FIG. 20, the audio signal transmitting device includes a main encoding unit 211, a side information encoding unit 212, a concealment signal accumulation unit 213, and an error signal encoding unit 214. The procedure of the audio signal transmitting device is shown in FIG. 22.

Figure 22:
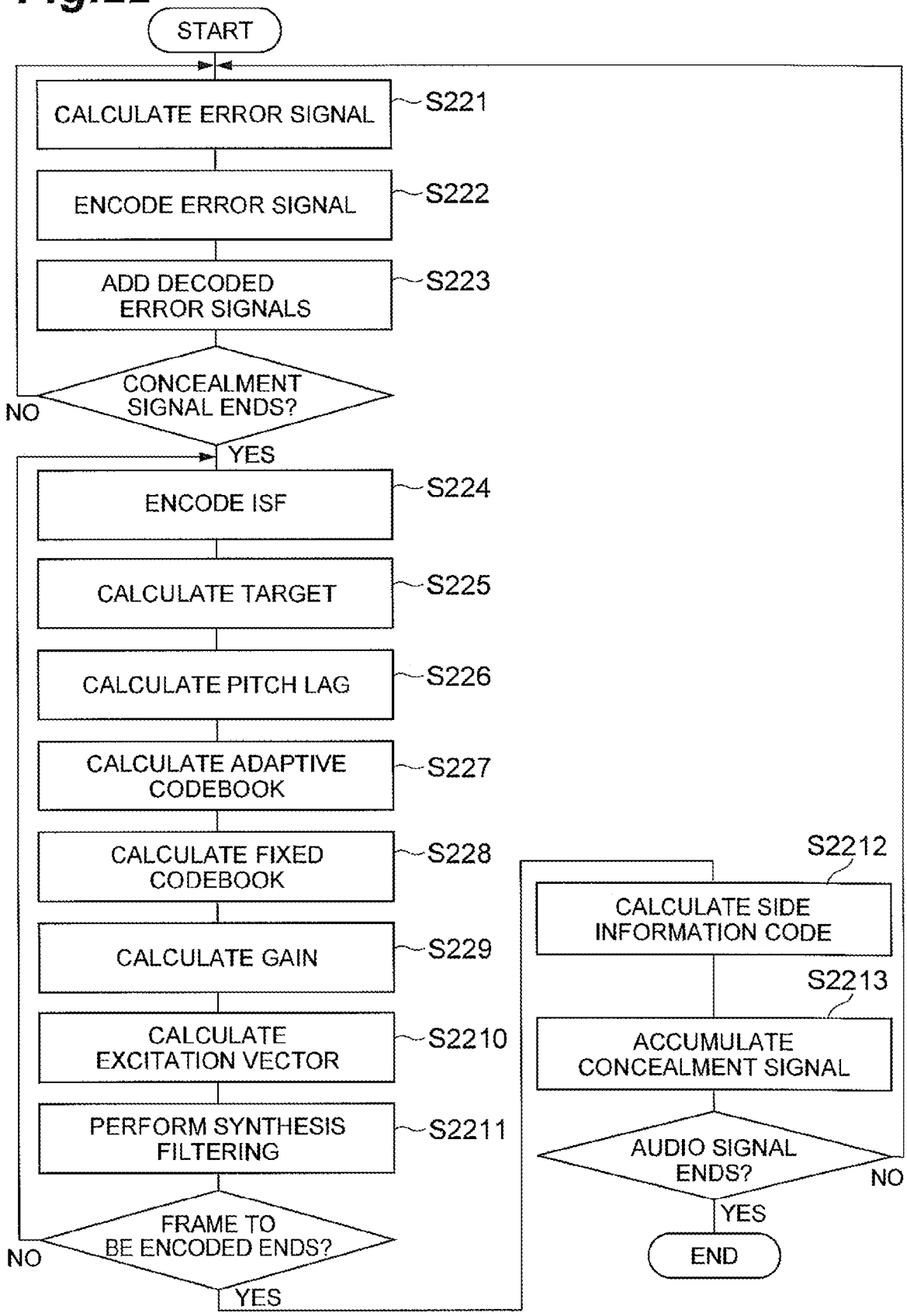
FIG. 22 is a view showing an example procedure of the audio signal transmitting device in the example 2.

The error signal encoding unit 214 reads a concealment signal for one sub-frame from the concealment signal accumulation unit 213, subtracts it from the audio signal and thereby calculates an error signal (Step 221 in FIG. 22).

The error signal encoding unit 214 encodes the error signal. As a specific example procedure, AVQ described in the section 6.8.4.1.5 in ITU-T G.718, can be used. In the encoding of the error signal, local decoding is performed, and a decoded error signal is output (Step 222 in FIG. 22).

By adding the decoded error signal to the concealment signal, a decoded signal for one sub-frame is output (Step 223 in FIG. 22).

The above Steps 221 to 223 are repeated for M' sub-frames until the end of the concealment signal.

Figure 21:
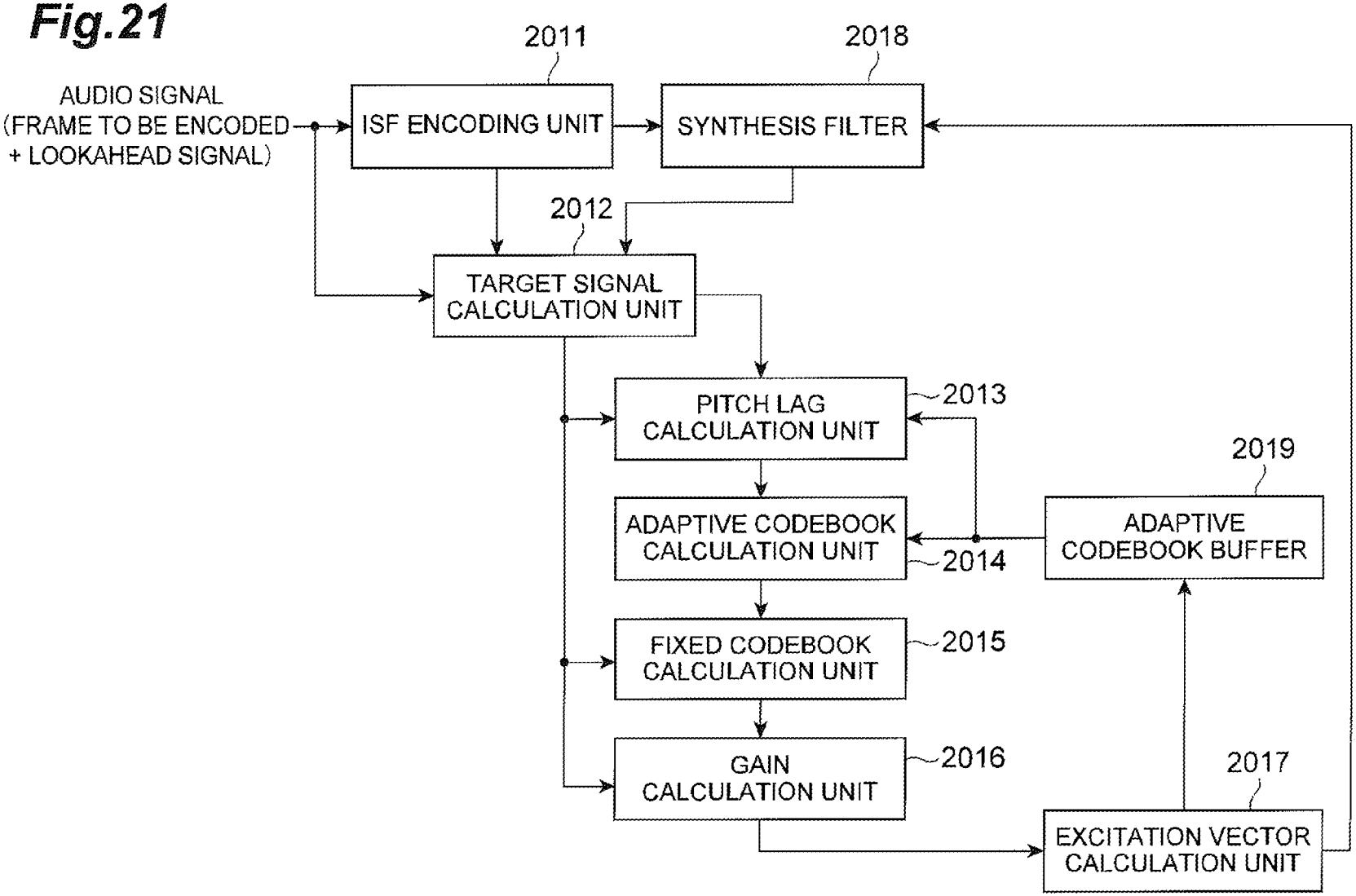
FIG. 21 is a view showing a functional configuration example of a main encoding unit in the example 2.

An example functional configuration of the main encoding unit 211 is shown in FIG. 21. The main encoding unit 211 includes an ISF encoding unit 2011, a target signal calculation unit 2012, a pitch lag calculation unit 2013, an adaptive codebook calculation unit 2014, a fixed codebook calculation unit 2015, a gain calculation unit 2016, an excitation vector calculation unit 2017, a synthesis filter 2018, and an adaptive codebook buffer 2019.

The ISF encoding unit 2011 obtains an LP coefficient by applying the Levinson-Durbin method to the frame to be encoded and the look-ahead signal. The ISF encoding unit 2011 then converts the LP coefficient into an ISF parameter and encodes the ISF parameter. The ISF encoding unit 2011 then decodes the code and obtains a decoded ISF parameter. Finally, the ISF encoding unit 2011 interpolates the decoded ISF parameter and obtains a decoded LP coefficient for each sub-frame. The procedures of the Levinson-Durbin method and the conversion from the LP coefficient to the ISF parameter are the same as in the example 1. Further, for the encoding of the ISF parameter, the procedure described in, for example, section 6.8.2 in ITU-T G.718 can be used. An index obtained by encoding the ISF parameter, the decoded ISF parameter, and the decoded LP coefficient (which is obtained by converting the decoded ISF parameter into the LP coefficient) can be obtained by the ISF encoding unit 2011 (Step 224 in FIG. 22).

The detailed procedure of the target signal calculation unit 2012 is the same as in Step 162 in FIG. 9 in the example 1 (Step 225 in FIG. 22).

The pitch lag calculation unit 2013 refers to the adaptive codebook buffer and calculates a pitch lag and a long-term prediction parameter by using the target signal. The detailed procedure of the calculation of the pitch lag and the long-term prediction parameter is the same as in the example 1 (Step 226 in FIG. 22).

The adaptive codebook calculation unit 2014 calculates an adaptive codebook vector by using the pitch lag and the long-term prediction parameter calculated by the pitch lag calculation unit 2013. The detailed procedure of the adaptive codebook calculation unit 2014 is the same as in the example 1 (Step 227 in FIG. 22).

The fixed codebook calculation unit 2015 calculates a fixed codebook vector and an index obtained by encoding the fixed codebook vector by using the target signal and the adaptive codebook vector. The detailed procedure is the same as the procedure of AVQ used in the error signal encoding unit 214 (Step 228 in FIG. 22).

The gain calculation unit 2016 calculates an adaptive codebook gain, a fixed codebook gain and an index obtained by encoding these two gains using the target signal, the adaptive codebook vector and the fixed codebook vector. A detailed procedure which can be used is described in, for example, section 6.8.4.1.6 in ITU-T G.718 (Step 229 in FIG. 22).

The excitation vector calculation unit 2017 calculates an excitation vector by adding the adaptive codebook vector and the fixed codebook vector to which the gain is applied. The detailed procedure is the same as in example 1. Further, the excitation vector calculation unit 2017 updates the state of the adaptive codebook buffer 2019 by using the excitation vector. The detailed procedure is the same as in the example 1 (Step 2210 in FIG. 22).

The synthesis filter 2018 synthesizes a decoded signal by using the decoded LP coefficient and the excitation vector (Step 2211 in FIG. 22).

The above Steps 224 to 2211 are repeated for M-M' sub-frames until the end of the frame to be encoded.

The side information encoding unit 212 calculates the side information for the look-ahead signal M' sub-frame. A specific procedure is the same as in the example 1 (Step 2212 in FIG. 22).

In addition to the procedure of the example 1, the decoded signal output by the synthesis filter 157 of the side information encoding unit 212 is accumulated in the concealment signal accumulation unit 213 in the example 2 (Step 2213 in FIG. 22).

<Decoding Unit>

Figure 23:
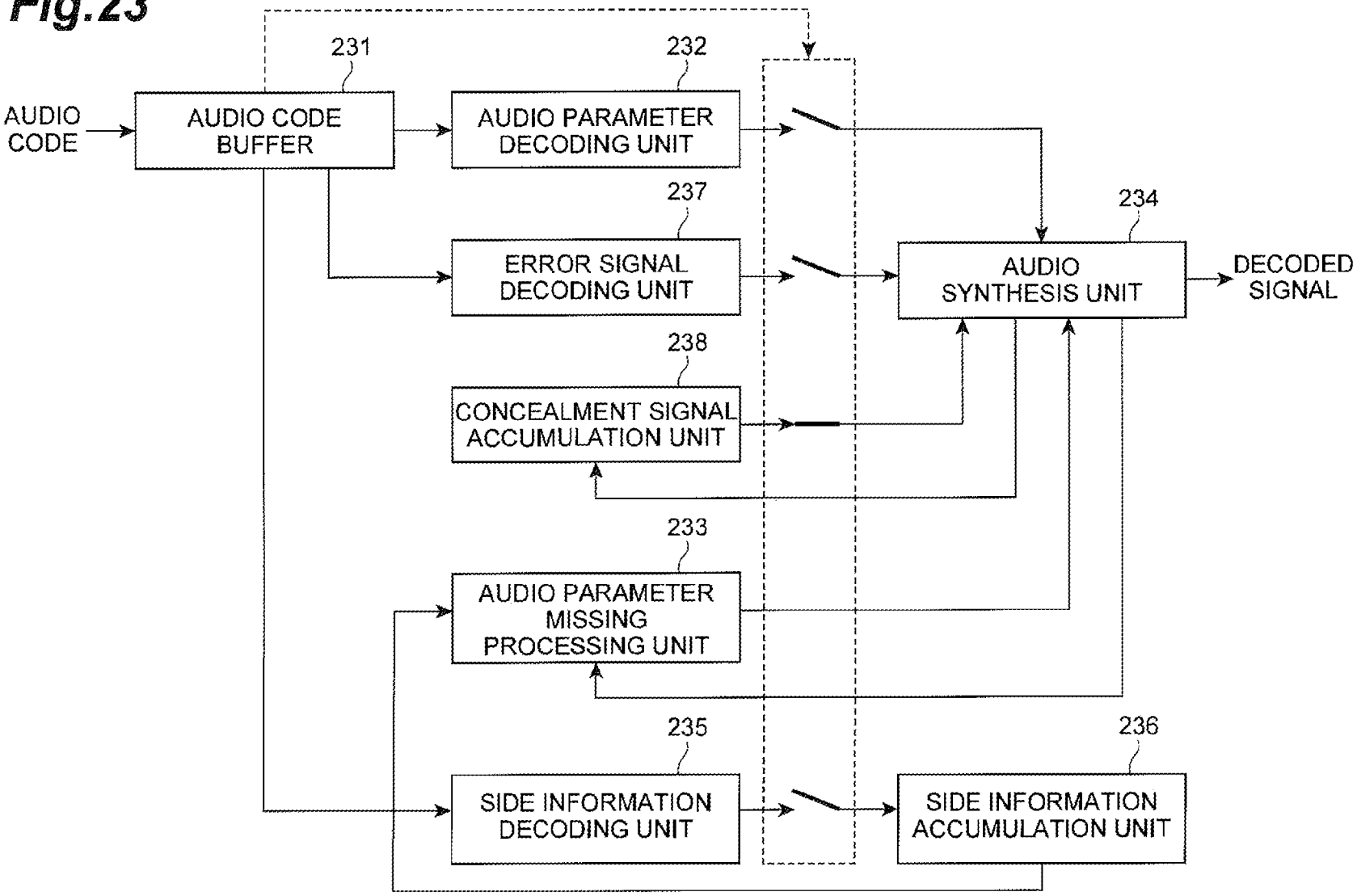
FIG. 23 is a view showing a functional configuration example of an audio signal receiving device in the example 2.
Figure 24:
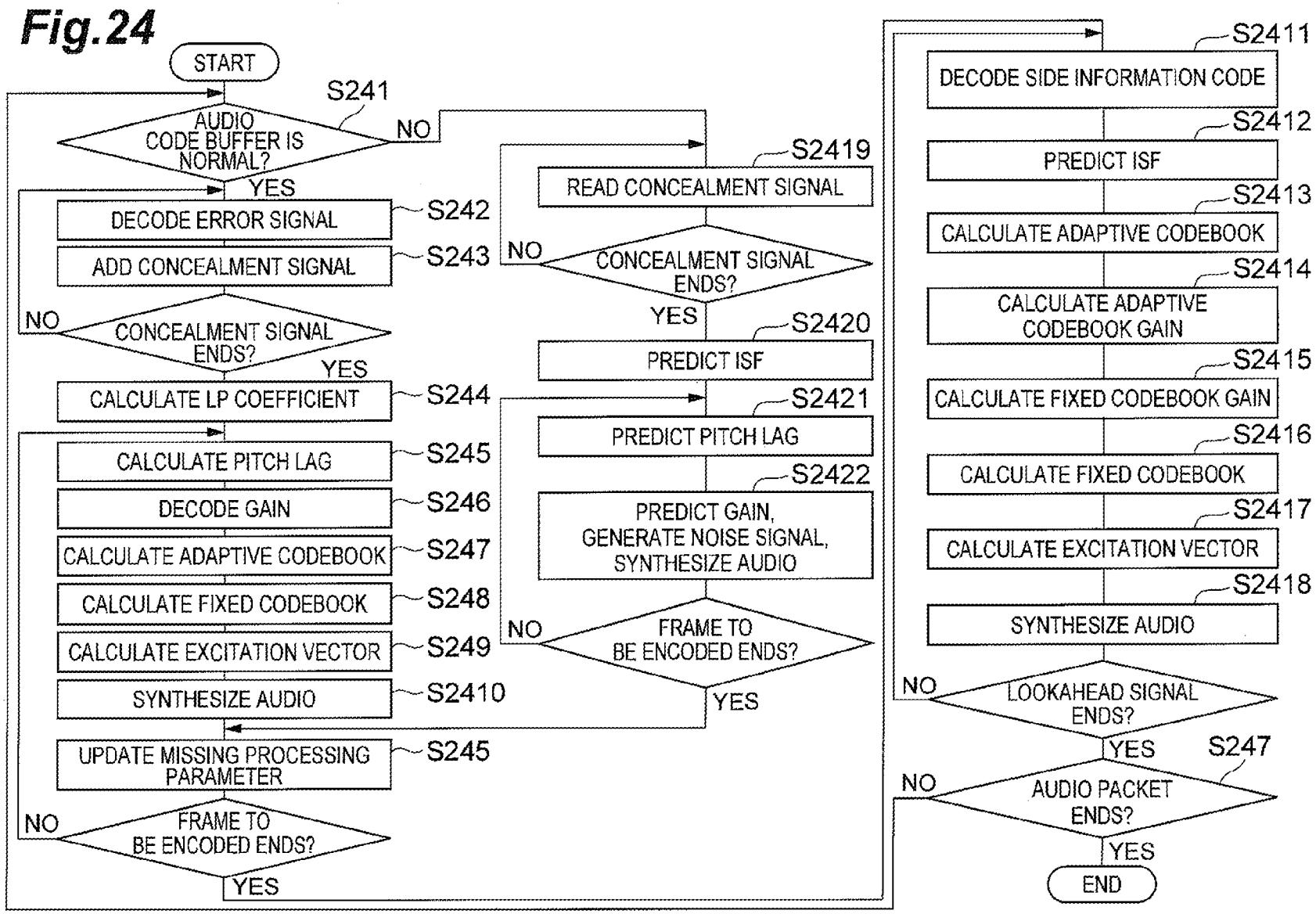
FIG. 24 is a view showing an example procedure of the audio signal receiving device in the example 2e.
Figure 25:
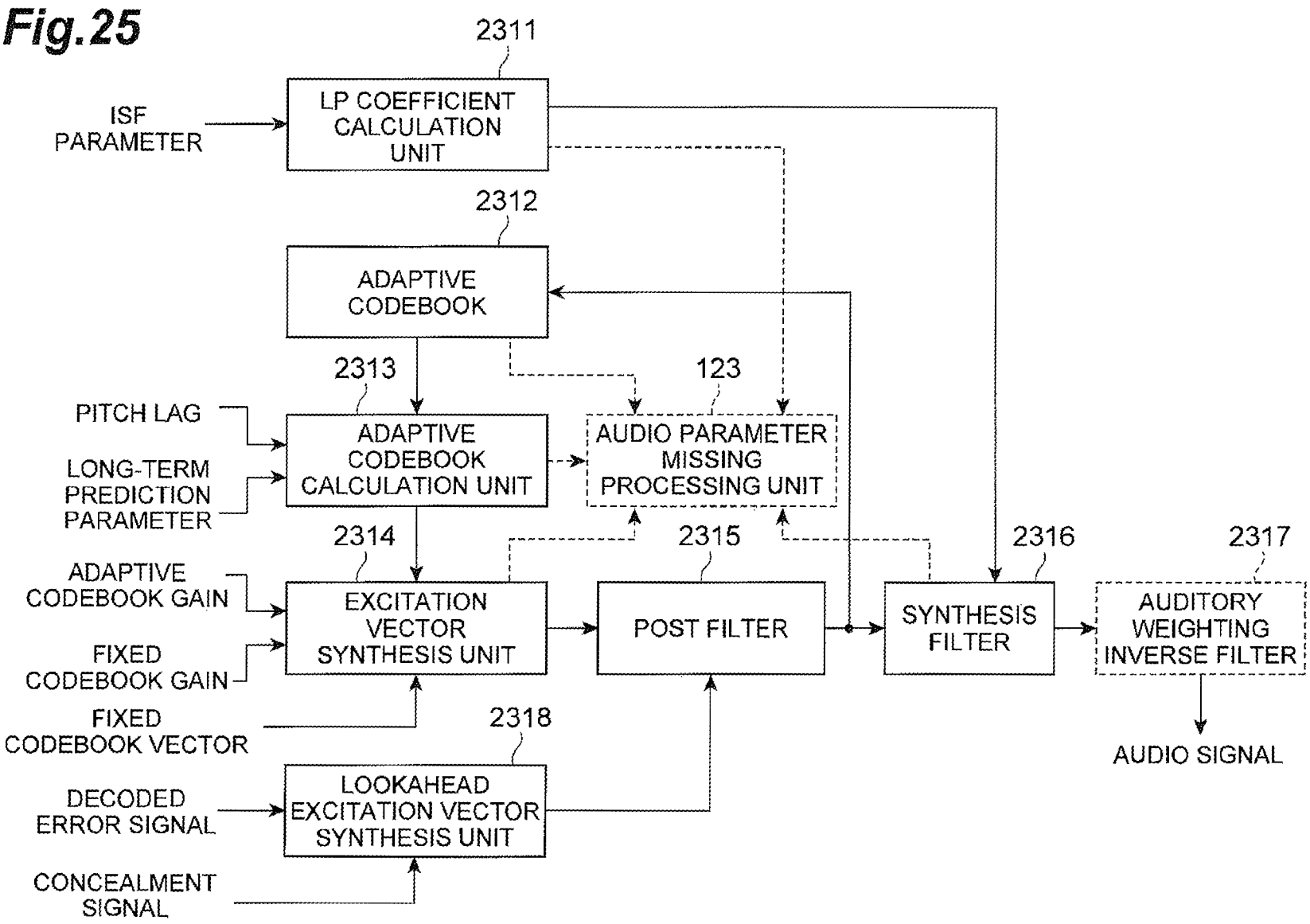
FIG. 25 is a view showing a functional configuration example of an audio synthesis unit in the example 2.

As shown in FIG. 23, an example of the audio signal receiving device includes an audio code buffer 231, an audio parameter decoding unit 232, an audio parameter missing processing unit 233, an audio synthesis unit 234, a side information decoding unit 235, a side information accumulation unit 236, an error signal decoding unit 237, and a concealment signal accumulation unit 238. An example procedure of the audio signal receiving device is shown in FIG. 24. An example functional configuration of the audio synthesis unit 234 is shown in FIG. 25.

The audio code buffer 231 determines whether a packet is correctly received or not. When the audio code buffer 231 determines that a packet is correctly received, the processing is switched to the audio parameter decoding unit 232, the side information decoding unit 235 and the error signal decoding unit 237. On the other hand, when the audio code buffer 231 determines that a packet is not correctly received, the processing is switched to the audio parameter missing processing unit 233 (Step 241 in FIG. 24).

<When Packet is Correctly Received>

The error signal decoding unit 237 decodes an error signal code and obtains a decoded error signal. As a specific example procedure, a decoding method corresponding to the method used at the encoding end, such as AVQ described in the section 7.1.2.1.2 in ITU-T G.718 can be used (Step 242 in FIG. 24).

A look-ahead excitation vector synthesis unit 2318 reads a concealment signal for one sub-frame from the concealment signal accumulation unit 238 and adds the concealment signal to the decoded error signal, and thereby outputs a decoded signal for one sub-frame (Step 243 in FIG. 24).

The above Steps 241 to 243 are repeated for M' sub-frames until the end of the concealment signal.

Figure 26:
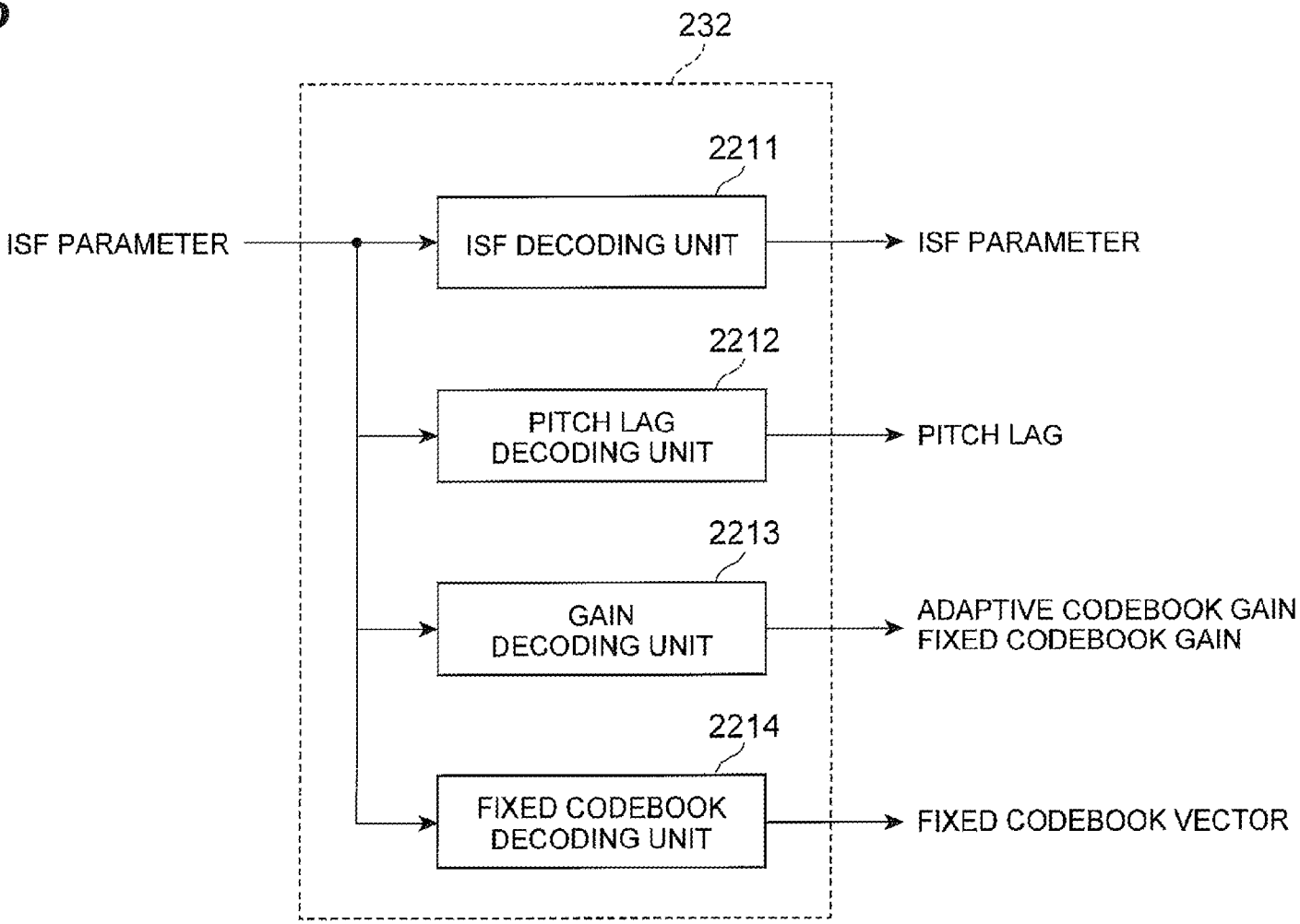
FIG. 26 is a view showing a functional configuration example of an audio parameter decoding unit in the example 2.

The audio parameter decoding unit 232 includes an ISF decoding unit 2211, a pitch lag decoding unit 2212, a gain decoding unit 213, and a fixed codebook decoding unit 2214. The functional configuration example of the audio parameter decoding unit 232 is shown in FIG. 26.

The ISF decoding unit 2211 decodes the ISF code and converts it into an LP coefficient and thereby obtains a decoded LP coefficient. For example, the procedure described in the section 7.1.1 in ITU-T G.718 is used (Step 244 in FIG. 24).

The pitch lag decoding unit 2212 decodes a pitch lag code and obtains a pitch lag and a long-term prediction parameter (Step 245 in FIG. 24).

The gain decoding unit 2213 decodes a gain code and obtains an adaptive codebook gain and a fixed codebook gain. An example detailed procedure is described in the section 7.1.2.1.3 in ITU-T G.718 (Step 246 in FIG. 24).

An adaptive codebook calculation unit 2313 calculates an adaptive codebook vector by using the pitch lag and the long-term prediction parameter. The detailed procedure of the adaptive codebook calculation unit 2313 is as described in the example 1 (Step 247 in FIG. 24).

The fixed codebook decoding unit 2214 decodes a fixed codebook code and calculates a fixed codebook vector. The detailed procedure is as described in the section 7.1.2.1.2 in ITU-T G.718 (Step 248 in FIG. 24).

An excitation vector synthesis unit 2314 calculates an excitation vector by adding the adaptive codebook vector and the fixed codebook vector to which the gain is applied. Further, an excitation vector calculation unit updates the adaptive codebook buffer by using the excitation vector (Step 249 in FIG. 24). The detailed procedure is the same as in the example 1.

A synthesis filter 2316 synthesizes a decoded signal by using the decoded LP coefficient and the excitation vector (Step 2410 in FIG. 24). The detailed procedure is the same as in the example 1.

The above Steps 244 to 2410 are repeated for M-M' sub-frames until the end of the frame to be encoded.

The functional configuration of the side information decoding unit 235 is the same as in the example 1. The side information decoding unit 235 decodes the side information code and calculates a pitch lag (Step 2411 in FIG. 24).

The functional configuration of the audio parameter missing processing unit 233 is the same as in the example 1.

The ISF prediction unit 191 predicts an ISF parameter using the ISF parameter for the previous frame and converts the predicted ISF parameter into an LP coefficient. The procedure is the same as in Steps 172, 173 and 174 of the example 1 shown in FIG. 10 (Step 2412 in FIG. 24).

The adaptive codebook calculation unit 2313 calculates an adaptive codebook vector by using the pitch lag output from the side information decoding unit 235 and an adaptive codebook 2312 (Step 2413 in FIG. 24). The procedure is the same as in Steps 11301 and 11302 in FIG. 16.

The adaptive codebook gain prediction unit 193 outputs an adaptive codebook gain. A specific procedure is the same as in Step 1103 in FIG. 13 (Step 2414 in FIG. 24).

The fixed codebook gain prediction unit 194 outputs a fixed codebook gain. A specific procedure is the same as in Step 1104 in FIG. 13 (Step 2415 in FIG. 24).

The noise signal generation unit 195 outputs a noise, such as a white noise as a fixed codebook vector. The procedure is the same as in Step 1105 in FIG. 13 (Step 2416 in FIG. 24).

The excitation vector synthesis unit 2314 applies gain to each of the adaptive codebook vector and the fixed codebook vector and adds them together and thereby calculates an excitation vector. Further, the excitation vector synthesis unit 2314 updates the adaptive codebook buffer using the excitation vector (Step 2417 in FIG. 24).

The synthesis filter 2316 calculates a decoded signal using the above-described LP coefficient and the excitation vector. The synthesis filter 2316 then updates the concealment signal accumulation unit 238 using the calculated decoded signal (Step 2418 in FIG. 24).

The above steps are repeated for M' sub-frames, and the decoded signal is output as the audio signal.

<When a Packet is Lost>

A concealment signal for one sub-frame is read from the concealment signal accumulation unit and is used as the decoded signal (Step 2419 in FIG. 24).

The above is repeated for M' sub-frames.

The ISF prediction unit 191 predicts an ISF parameter (Step 2420 in FIG. 24). As the procedure, Step 1101 in FIG. 13 can be used.

The pitch lag prediction unit 192 outputs a predicted pitch lag by using the pitch lag used in the past decoding (Step 2421 in FIG. 24). The procedure used for the prediction is the same as in Step 1102 in FIG. 13.

The operations of the adaptive codebook gain prediction unit 193, the fixed codebook gain prediction unit 194, the noise signal generation unit 195 and the audio synthesis unit 234 are the same as in the example 1 (Step 2422 in FIG. 24).

The above steps are repeated for M sub-frames, and the decoded signal for M-M' sub-frames is output as the audio signal, and the concealment signal accumulation unit 238 is updated by the decoded signal for the remaining M' sub-frames.

Example 3

A case of using glottal pulse synchronization in the calculation of an adaptive codebook vector is described hereinafter.

<Encoding End>

The functional configuration of the audio signal transmitting device is the same as in example 1. The functional configuration and the procedure are different only in the side information encoding unit, and therefore only the operation of the side information encoding unit is described below.

Figure 27:
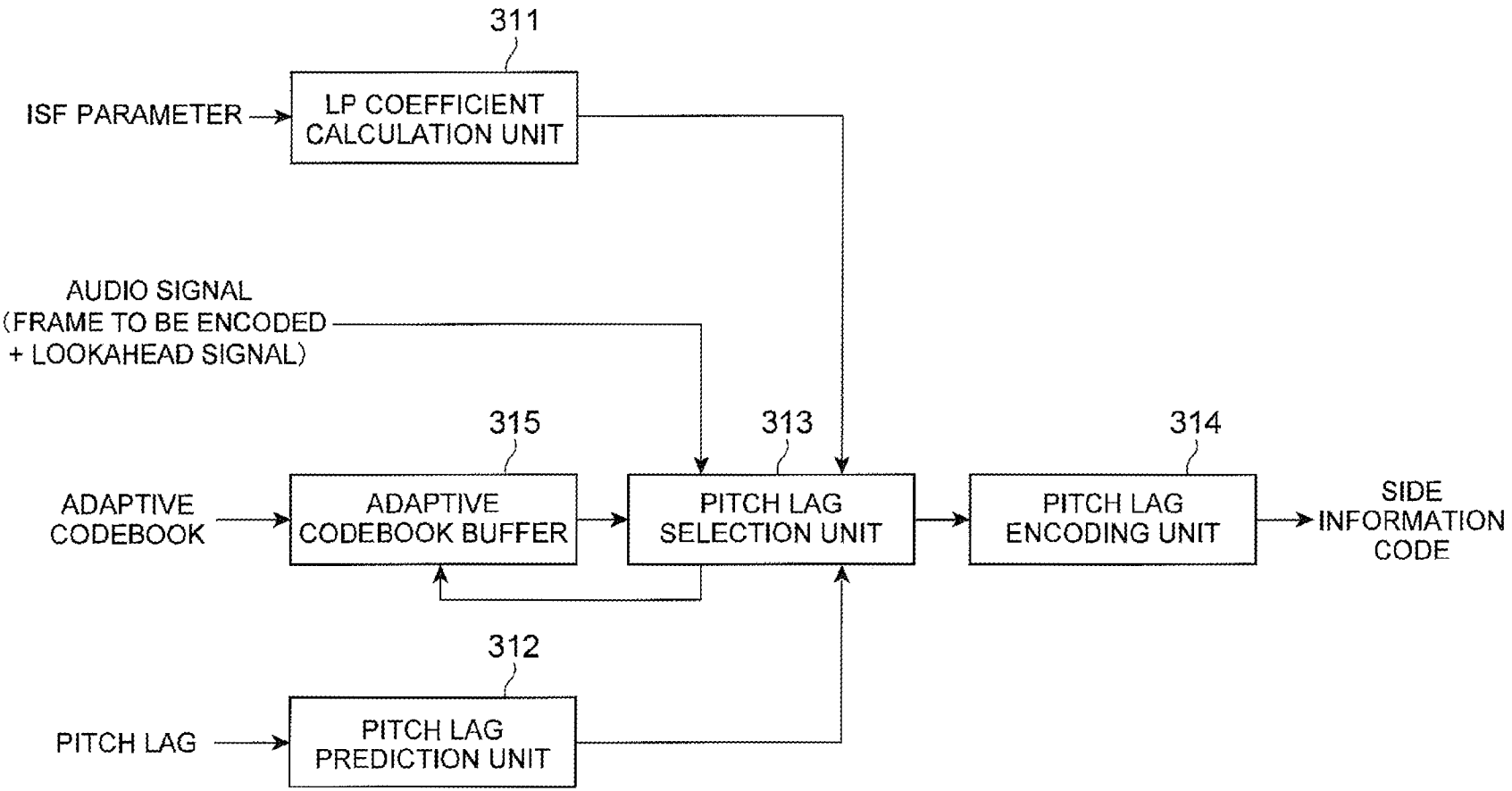
FIG. 27 is a view showing a functional configuration example of a side information encoding unit in an example 3 of the audio coding system.

The side information encoding unit includes an LP coefficient calculation unit 311, a pitch lag prediction unit 312, a pitch lag selection unit 313, a pitch lag encoding unit 314, and an adaptive codebook buffer 315. The functional configuration of an example of the side information encoding unit is shown in FIG. 27, and an example procedure of the side information encoding unit is shown in the example of FIG. 28.

Figure 28:
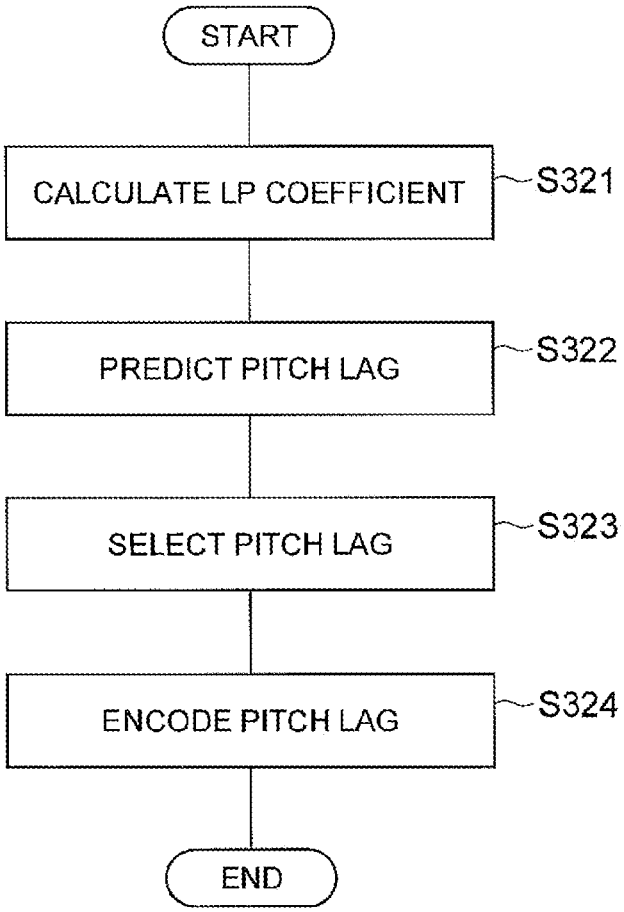
FIG. 28 is a view showing an example procedure of the side information encoding unit in the example 3.

The LP coefficient calculation unit 311 is the same as the LP coefficient calculation unit in example 1 and thus will not be redundantly described (Step 321 in FIG. 28).

The pitch lag prediction unit 312 calculates a pitch lag predicted value $\hat{T}_p$ using the pitch lag obtained from the audio encoding unit (Step 322 in FIG. 28). The specific processing of the prediction is the same as the prediction of the pitch lag $\hat{T}_p^{(i)}$ ($M_{la} \leq i < M$) in the pitch lag prediction unit 192 in the example 1 (which is the same as in Step 1102 in FIG. 13).

Then, the pitch lag selection unit 313 determines a pitch lag to be transmitted as the side information (Step 323 in FIG. 28). The detailed procedure of the pitch lag selection unit 313 is shown in the example of FIG. 29.

Figure 29:
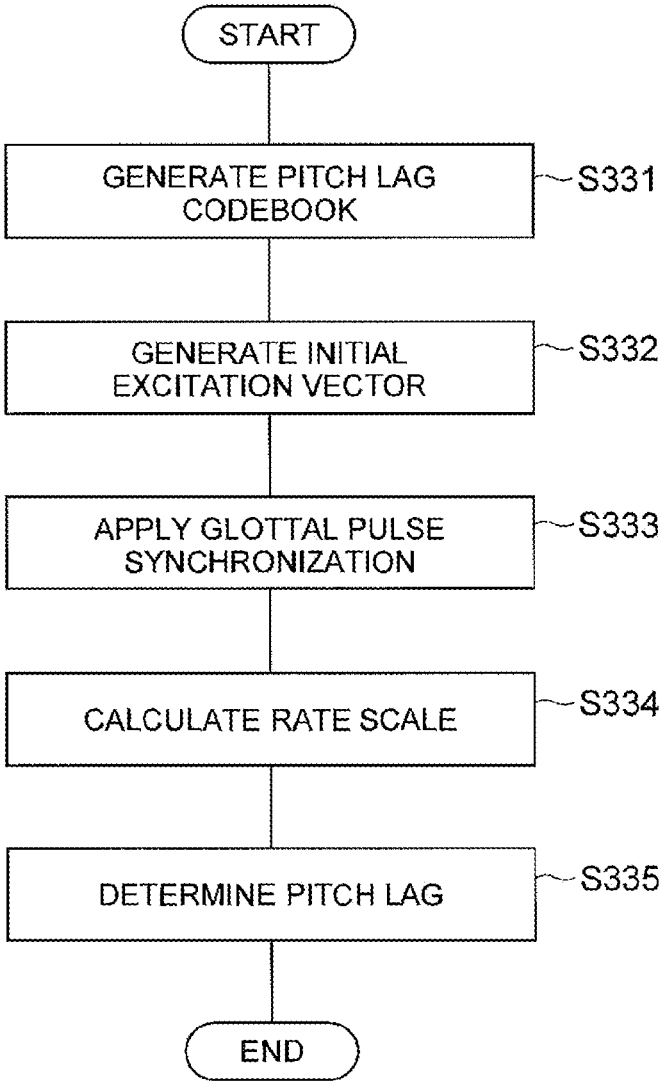
FIG. 29 is a view showing an example procedure of a pitch lag selection unit in the example 3.

First, a pitch lag codebook is generated from the pitch lag predicted value $\hat{T}_p$ and the value of the past pitch lag $\hat{T}_p^{(-j)}$ ($0 \le j < J$) according to the following equations (Step 331 in FIG. 29).

$$< \text{When } \hat{T}_p - \hat{T}_p^{(-1)} \ge 0 >$$

$$\hat{T}_C^j = \begin{cases} \hat{T}_p(j=0) \\ \hat{T}_p^{(-1)} - j \cdot \delta_j + \rho(0 < j < I) \end{cases} \quad \text{Equation 33}$$

$$< \text{When } \hat{T}_p - \hat{T}_p^{(-1)} < 0 >$$

$$\hat{T}_C^j = \begin{cases} \hat{T}_p(j=0) \\ \hat{T}_p^{(-1)} + j \cdot \delta_j + \rho(0 < j < I) \end{cases} \quad \text{Equation 34}$$

The value of the pitch lag for one sub-frame before is $\hat{T}_p^{(-1)}$. Further, the number of indexes of the codebook is I. $\delta_j$ is a predetermined step width, and p is a predetermined constant.

Then, by using the adaptive codebook and the pitch lag predicted value $\hat{T}_p$, an initial excitation vector $u_0(n)$ is generated according to the following equation (Step 332 in FIG. 29).

$$u_0(n) = \begin{cases} 0.18u_0(n - \hat{T}_p - 1) + 0.64u_0(n - \hat{T}_p) + \\ 0.18u_0(n - \hat{T}_p + 1)(0 \le n < \hat{T}_p) \\ u_0(n - \hat{T}_p)(\hat{T}_p \le n < L) \end{cases} \quad \text{Equation 35}$$

The procedure of calculating the initial excitation vector can be, for example, similar to equations (607) and (608) in ITU-T G.718.

Then, glottal pulse synchronization is applied to the initial excitation vector by using all candidate pitch lags $\hat{T}_C^j$ ($0 \le j < J$) in the pitch lag codebook to thereby generate a candidate adaptive codebook vector $u^j(n)$ ($0 \le j < I$) (Step 333 in FIG. 29). For the glottal pulse synchronization, a similar procedure can be used as in the example of the case described in section 7.11.2.5 in ITU-T G.718 where a pulse position is not available. Note, however, that u(n) in ITU-T G.718 can correspond to: $u_0(n)$ in the described embodiment(s), extrapolated pitch corresponds to $\hat{T}_C^j$ in the described embodiment(s), and the last reliable pitch($T_c$) corresponds to $\hat{T}_p^{(-1)}$ in the described embodiment(s).

For the candidate adaptive codebook vector $u^j(n)$ ($0 \le j < I$), a rate scale is calculated (Step 334 in FIG. 29). In the case of using segmental SNR as the rate scale, a signal is synthesized by inverse filtering using the LP coefficient, and segmental SNR is calculated with the input signal according to the following equation.

$$\hat{s}_j(n) = u^j(n) - \sum_{i=1}^{P} \hat{a}(i) \cdot \hat{s}_j(n-i) \quad \text{Equation 35}$$

$$segSNR_j = \frac{\sum_{n=0}^{L'-1} \hat{s}_j^2(n)}{\sum_{n=0}^{L'-1} (s(n) - \hat{s}_j(n))^2} \quad \text{Equation 36}$$

Instead of performing inverse filtering, segmental SNR may be calculated in the region of the adaptive codebook vector by using a residual signal according to the following equation.

$$r(n) = s(n) + \sum_{i=1}^{P} \hat{a}(i) \cdot s(n-i) \quad \text{Equation 37}$$

$$segSNR_j = \frac{\sum_{n=0}^{L'-1} u^j(n)}{\sum_{n=0}^{L'-1} (r(n) - u^j(n))^2} \quad \text{Equation 38}$$

In this case, a residual signal r(n) of the look-ahead signal s(n)($0 \le n < L'$) is calculated by using the LP coefficient (Step 181 in FIG. 11).

An index corresponding to the largest rate scale calculated in Step 334 is selected, and a pitch lag corresponding to the index is calculated (Step 335 in FIG. 29).

$$\underset{j}{\operatorname{argmax}}[segSNR_j] \quad \text{Equation 39}$$

<Decoding End>

The functional configuration of the audio signal receiving device is the same as in the example 1. Differences from the example 1 are the functional configuration and the procedure of the audio parameter missing processing unit 123, the side information decoding unit 125 and the side information accumulation unit 126, and only those are described hereinbelow.

<When Packet is Correctly Received>

The side information decoding unit 125 decodes the side information code and calculates a pitch lag $\hat{T}_C^{idx}$ and stores it into the side information accumulation unit 126. The example procedure of the side information decoding unit 125 is shown in FIG. 30.

Figure 30:
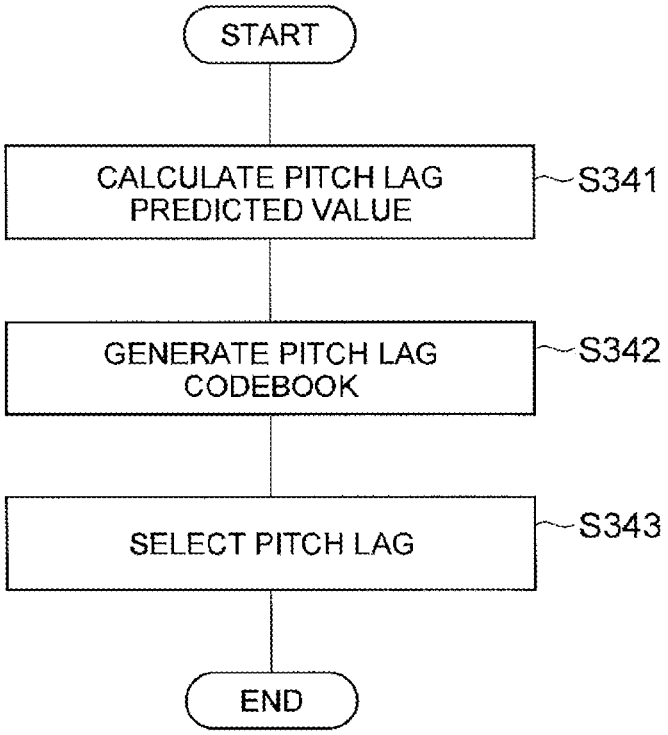
FIG. 30 is a view showing an example procedure of a side information decoding unit in the example 3.

In the calculation of the pitch lag, the pitch lag prediction unit 312 first calculates a pitch lag predicted value $\hat{T}_p$ by using the pitch lag obtained from the audio decoding unit (Step 341 in FIG. 30). The specific processing of the prediction is the same as in Step 322 of FIG. 28 in the example 3.

Then, a pitch lag codebook is generated from the pitch lag predicted value $\hat{T}_p$, and the value of the past pitch lag $\hat{T}_p^{(-j)}$ ($0 \le j < J$), according to the following equations (Step 342 in FIG. 30).

$$< \text{When } \hat{T}_p - \hat{T}_p^{(-1)} \ge 0 >$$

$$\hat{T}_C^j = \begin{cases} \hat{T}_p(j=0) \\ \hat{T}_p^{(-1)} - j \cdot \delta_j + \rho(0 < j < I) \end{cases} \quad \text{Equation 40}$$

$$< \text{When } \hat{T}_p - \hat{T}_p^{(-1)} < 0 >$$

$$\hat{T}_C^j = \begin{cases} \hat{T}_p(j=0) \\ \hat{T}_p^{(-1)} + j \cdot \delta_j + \rho(0 < j < I) \end{cases} \quad \text{Equation 41}$$

The procedure is the same as in Step 331 in FIG. 29. The value of the pitch lag for one sub-frame before is $\hat{T}_p^{(-1)}$. Further, the number of indexes of the codebook is I. $\delta_j$ is a predetermined step width, and ρ is a predetermined constant.

Then, by referring to the pitch lag codebook, a pitch lag $\hat{T}_C^{idx}$ corresponding to the index idx transmitted as part of the side information is calculated and stored in the side information accumulation unit 126 (Step 343 in FIG. 30).

<When Packet Loss is Detected>

Although the functional configuration of the audio synthesis unit is also the same as in the example 1 (which is the same as in FIG. 15), only the adaptive codebook calculation unit 1123 that operates differently from that in the example 1 is described hereinbelow.

The audio parameter missing processing unit 123 reads the pitch lag from the side information accumulation unit 126 and calculates a pitch lag predicted value according to the following equation, and uses the calculated pitch lag predicted value instead of the output of the pitch lag prediction unit 192.

$$\hat{T}_p = \hat{T}_p^{(-1)} + \kappa \cdot (\hat{T}_C^{idx} - \hat{T}_p^{(-1)}) \quad \text{Equation 42}$$

where κ is a predetermined constant.

Then, by using the adaptive codebook and the pitch lag predicted value $\hat{T}_p$, an initial excitation vector $u_0(n)$ is generated according to the following equation (Step 332 in FIG. 29).

$$u_0(n) = \begin{cases} 0.18u_0(n - \hat{T}_p^{(-1)} - 1) + 0.64u_0(n - \hat{T}_p^{(-1)}) + \\ 0.18u_0(n - \hat{T}_p^{(-1)} + 1)(0 \le n < \hat{T}_p^{(-1)}) \\ u_0(n - \hat{T}_p^{(-1)})(\hat{T}_p^{(-1)} \le n < L) \end{cases} \quad \text{Equation 43}$$

Then, glottal pulse synchronization is applied to the initial excitation vector by using the pitch lag $\hat{T}_C^{idx}$ to thereby generate an adaptive codebook vector u(n). For the glottal pulse synchronization, the same procedure as in Step 333 of FIG. 29 is used.

Figure 31:
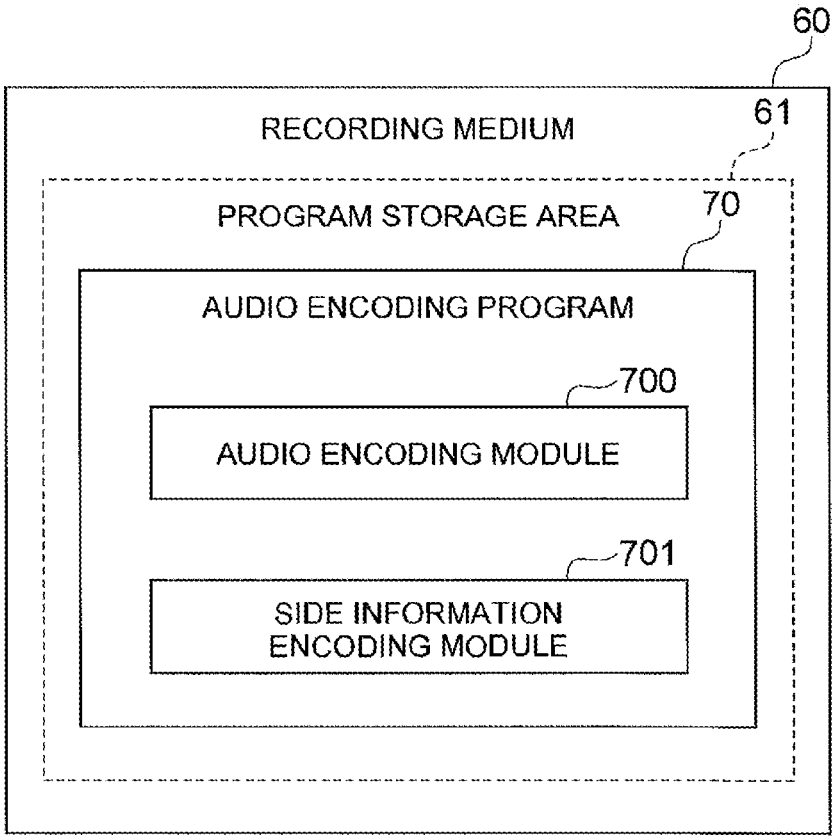
FIG. 31 is a view showing an example configuration of an audio encoding program and a storage medium according to an embodiment.

Hereinafter, an audio encoding program 70 that causes a computer having a processor to execute at least part of the above-described processing by the audio signal transmitting device is described. As shown in FIG. 31, the audio encoding program 70 is stored in a program storage area 61 formed in a recording medium 60, such as a computer readable medium, that is other than a transitory signal and can be inserted into a computer or other computing device, and accessed, or included in a computer or other computing device.

The audio encoding program 70 includes functionality for an audio encoding module 700 and a side information encoding module 701. The functions implemented by executing the audio encoding module 700 and the side information encoding module 701 with a processor and/or other circuitry can be the same as at least some of the functions of the audio encoding unit 111 and the side information encoding unit 112 in the audio signal transmitting device described above, respectively.

Note that a part or the whole of the audio encoding program 70 may be transmitted through a transmission medium such as a communication line, received and stored (including being installed) by another device. Further, each module of the audio encoding program 70 may be installed in computer readable medium, not in one computer but in any of a plurality of computers. In this case, the above-described processing of the audio encoding program 70 is performed by a computer system composed of the plurality of computers and corresponding processors.

Figure 32:
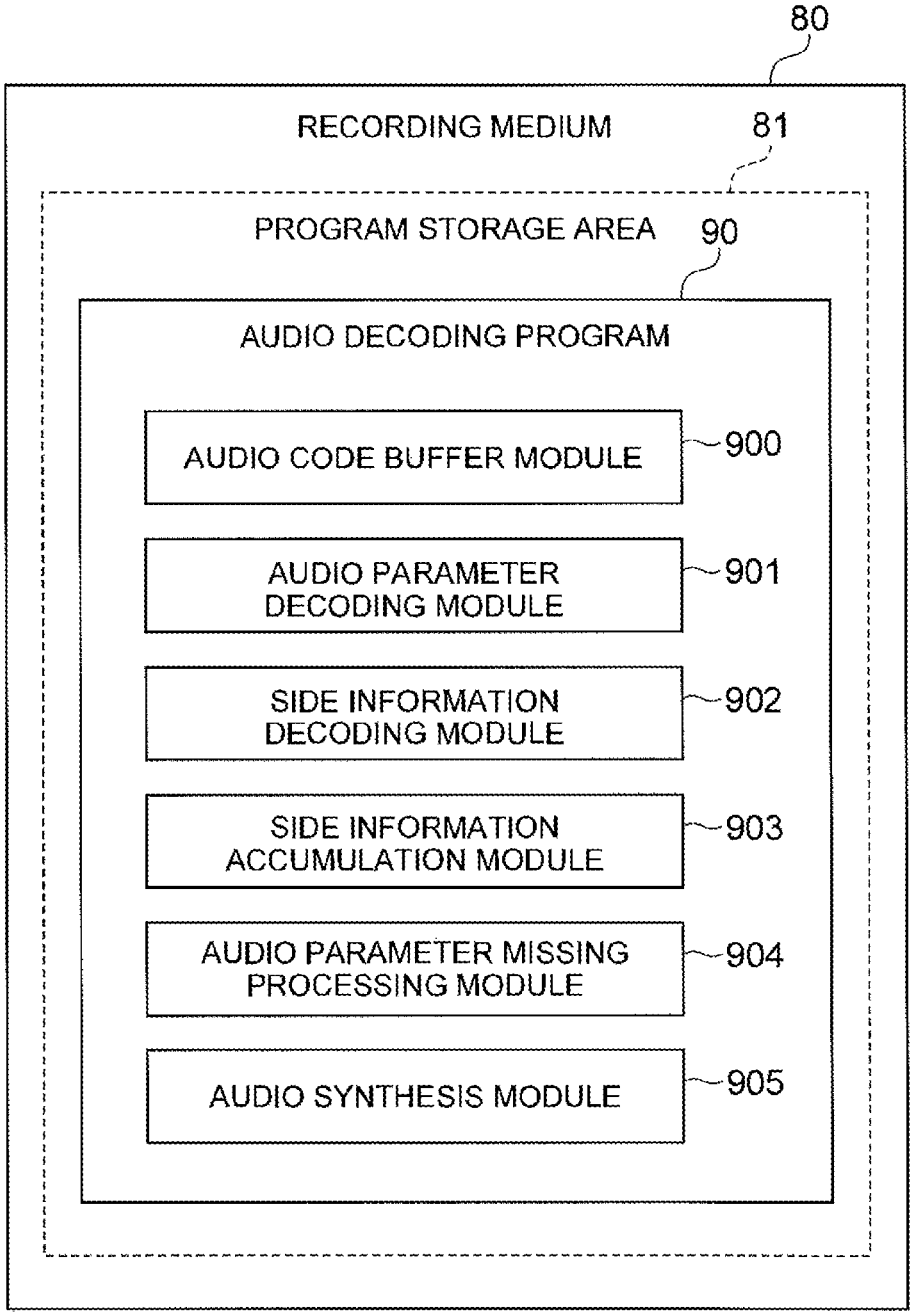
FIG. 32 is a view showing a configuration of an audio decoding program and a storage medium according to an embodiment.

Hereinafter, an audio decoding program 90 that causes a computer having a processor to execute at least part of the above-described processing by the audio signal receiving device is described. As shown in FIG. 32, the audio decoding program 90 is stored in a program storage area 81 formed in a recording medium 80, such as a computer readable medium, that is other than a transitory signal and can be inserted into a computer or other computing device, and accessed, or included in a computer or other computing device.

The audio decoding program 90 includes functionality for an audio code buffer module 900, an audio parameter decoding module 901, a side information decoding module 902, a side information accumulation module 903, an audio parameter missing processing module 904, and an audio synthesis module 905. The functions implemented by executing the audio code buffer module 900, the audio parameter decoding module 901, the side information decoding module 902, the side information accumulation module 903, an audio parameter missing processing module 904 and the audio synthesis module 905 with a processor and/or other circuitry can be the same as at least some of the functions of the audio code buffer 231, the audio parameter decoding unit 232, the side information decoding unit 235, the side information accumulation unit 236, the audio parameter missing processing unit 233 and the audio synthesis unit 234 described above, respectively.

Note that a part or the whole of the audio decoding program 90 may be transmitted through a transmission medium such as a communication line, received and stored (including being installed) by another device. Further, each module of the audio decoding program 90 may be installed in computer readable medium, not in one computer but in any of a plurality of computers. In this case, the above-described processing of the audio decoding program 90 is performed by a computer system composed of the plurality of computers and corresponding processors.

Example 4

An example that uses side information for pitch lag prediction at the decoding end is described hereinafter.

<Encoding End>

The functional configuration of the audio signal transmitting device is the same as in the example 1. The functional configuration and the procedure are different only in the side information encoding unit 112, and therefore the operation of the side information encoding unit 112 only is described hereinbelow.

Figure 33:
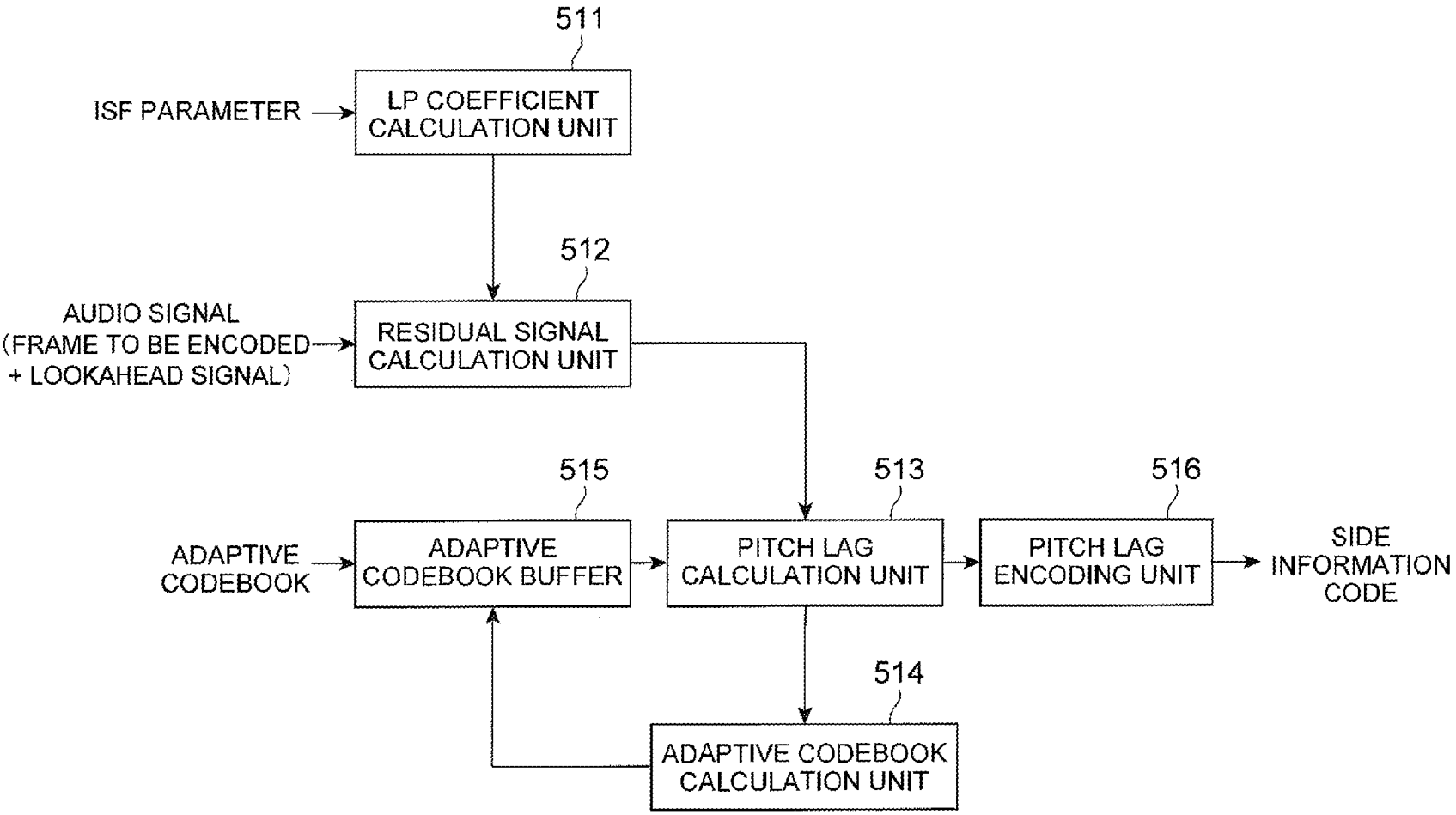
FIG. 33 is a view showing a functional configuration example of a side information encoding unit in an example 4 of the audio coding system.
Figure 34:
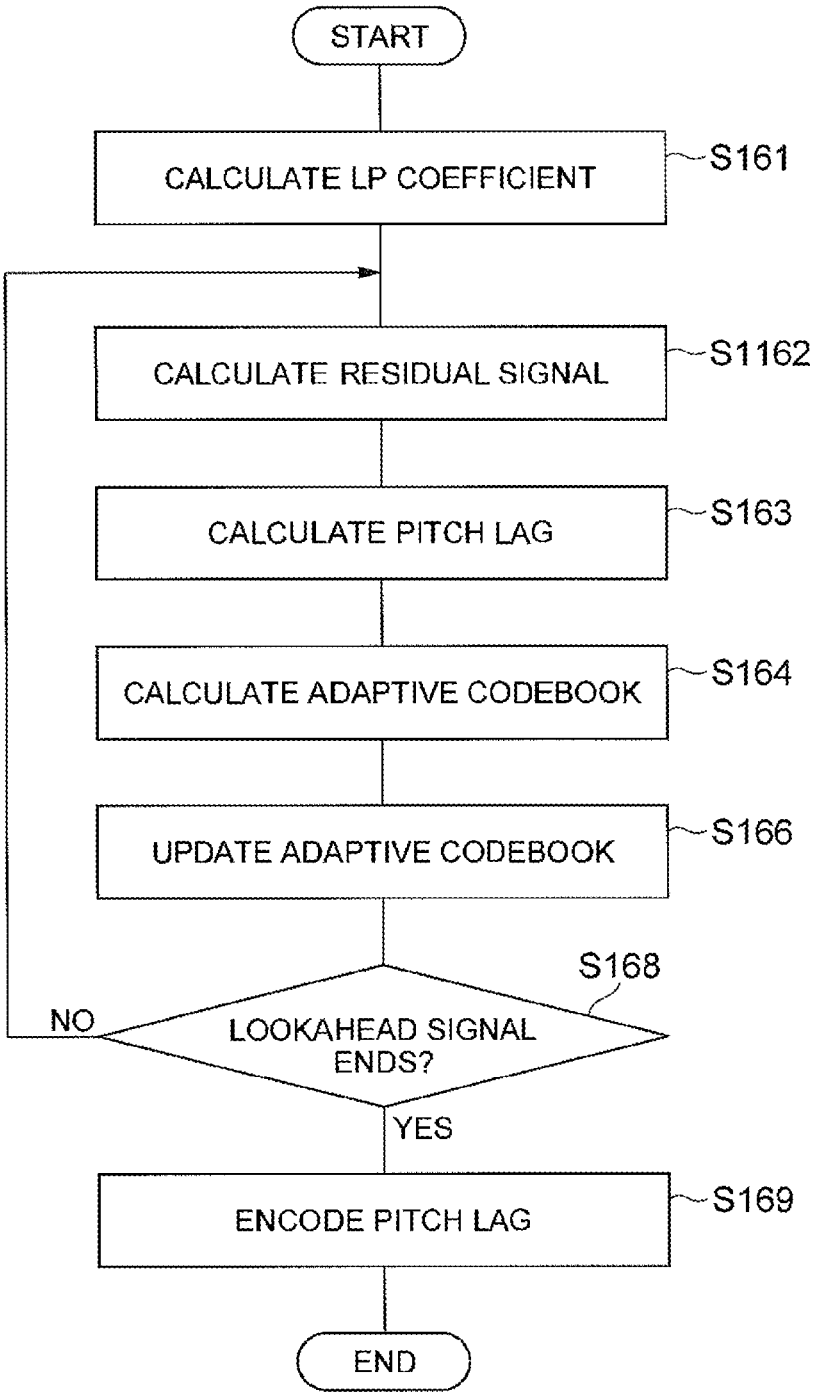
FIG. 34 is a view showing an example procedure of the side information encoding unit in the example 4.

The functional configuration of an example of the side information encoding unit 112 is shown in FIG. 33, and an example procedure of the side information encoding unit 112 is shown in FIG. 34. The side information encoding unit 112 includes an LP coefficient calculation unit 511, a residual signal calculation unit 512, a pitch lag calculation unit 513, an adaptive codebook calculation unit 514, an adaptive codebook buffer 515, and a pitch lag encoding unit 516.

The LP coefficient calculation unit 511 is the same as the LP coefficient calculation unit 151 in example 1 shown in FIG. 8 and thus is not redundantly described.

The residual signal calculation unit 512 calculates a residual signal by the same processing as in Step 181 in example 1 shown in FIG. 11.

The pitch lag calculation unit 513 calculates a pitch lag for each sub-frame by calculating k that maximizes the following equation (Step 163 in FIG. 34). Note that u(n) indicates the adaptive codebook, and L' indicates the number of samples contained in one sub-frame.

$$T_p = \arg_k \max T_k$$

$$T_k = \frac{\sum_{n=0}^{L'-1} r(n)u(n-k)}{\sqrt{\sum_{n=0}^{L'-1} u(n-k)u(n-k)}} \quad \text{Equation 43}$$

The adaptive codebook calculation unit 514 calculates an adaptive codebook vector v'(n) from the pitch lag $T_p$ and the adaptive codebook u(n). The length of the adaptive codebook is $N_{adapt}$(Step 164 in FIG. 34).

$$v'(n)=u(n+N_{adapt}-T_p) \quad \text{Equation 44}$$

The adaptive codebook buffer 515 updates the state by the adaptive codebook vector v'(n) (Step 166 in FIG. 34).

$$u(n)=u(n+L')(0\leq n<N-L') \quad \text{Equation 45}$$

$$u(n+N-L')=v'(n)(0\leq n<L) \quad \text{Equation 46}$$

The pitch lag encoding unit 516 is the same as that in example 1 and thus not redundantly described (Step 169 in FIG. 34).

<Decoding End>

The audio signal receiving device includes the audio code buffer 121, the audio parameter decoding unit 122, the audio parameter missing processing unit 123, the audio synthesis unit 124, the side information decoding unit 125, and the side information accumulation unit 126, just like in example 1. The procedure of the audio signal receiving device is as shown in FIG. 7.

The operation of the audio code buffer 121 is the same as in example 1.

<When Packet is Correctly Received>

The operation of the audio parameter decoding unit 122 is the same as in the example 1.

The side information decoding unit 125 decodes the side information code, calculates a pitch lag $\hat{T}_p^{(j)}$ ($0\leq j<M_{la}$) and stores it into the side information accumulation unit 126. The side information decoding unit 125 decodes the side information code by using the decoding method corresponding to the encoding method used at the encoding end.

The audio synthesis unit 124 is the same as that of example 1.

<When Packet Loss is Detected>

The ISF prediction unit 191 of the audio parameter missing processing unit 123 (see FIG. 12) calculates an ISF parameter the same way as in the example 1.

Figure 35:
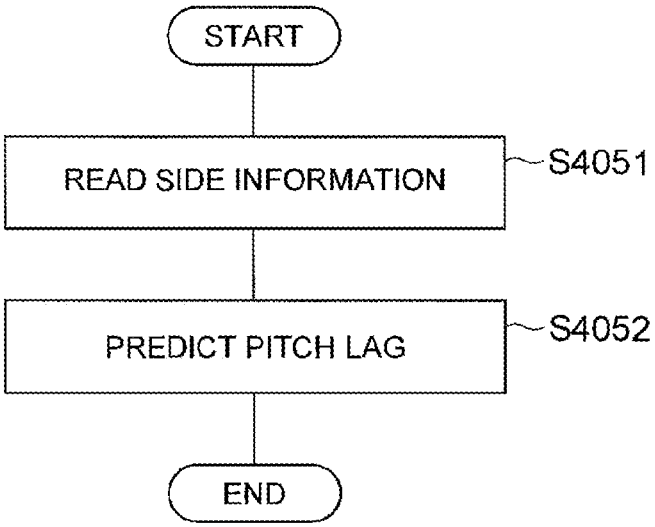
FIG. 35 is a view showing an example procedure of a pitch lag prediction unit in the example 4.

An example procedure of the pitch lag prediction unit 192 is shown in FIG. 35. The pitch lag prediction unit 192 reads the side information code from the side information accumulation unit 126 and obtains a pitch lag $\hat{T}_p^{(i)}$ ($0\leq i<M_{la}$) in the same manner as in example 1 (Step 4051 in FIG. 35). Further, the pitch lag prediction unit 192 outputs the pitch lag $\hat{T}_p^{(i)}$ ($M_{la}\leq i<M$) by using the pitch lag $\hat{T}_p^{(-j)}$ ($0\leq j<J$) used in the past decoding (Step 4052 in FIG. 35). The number of sub-frames contained in one frame is M, and the number of pitch lags contained in the side information is $M_{la}$. In the prediction of the pitch lag $\hat{T}_p^{(i)}$ ($M_{la}\leq i<M$), the procedure as described in ITU-T G.718 can be used (Step 1102 in FIG. 13), for example.

Figure 36:
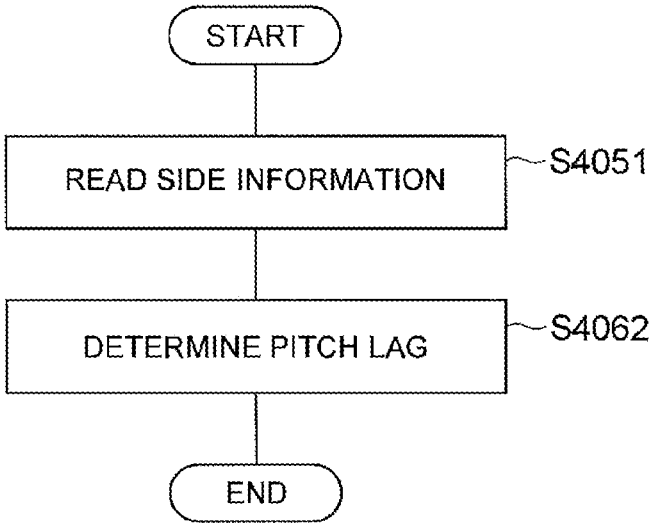
FIG. 36 is another view showing an example procedure of the pitch lag prediction unit in the example 4.

In the prediction of the pitch lag $\hat{T}_p^{(i)}$ ($M_{la}\leq i<M$), the pitch lag prediction unit 192 may predict the pitch lag $\hat{T}_p^{(i)}$ ($M_{la}\leq i<M$) by using the pitch lag $\hat{T}_p^{(-j)}$($1\leq j<J$) used in the past decoding and the pitch lag $\hat{T}_p^{(i)}$ ($0\leq i<M_{la}$). Further, $\hat{T}_p^{(i)}<\hat{T}_p^{(M_{la})}$ may be established. The procedure of the pitch lag prediction unit in this case is as shown in FIG. 36.

Figure 37:
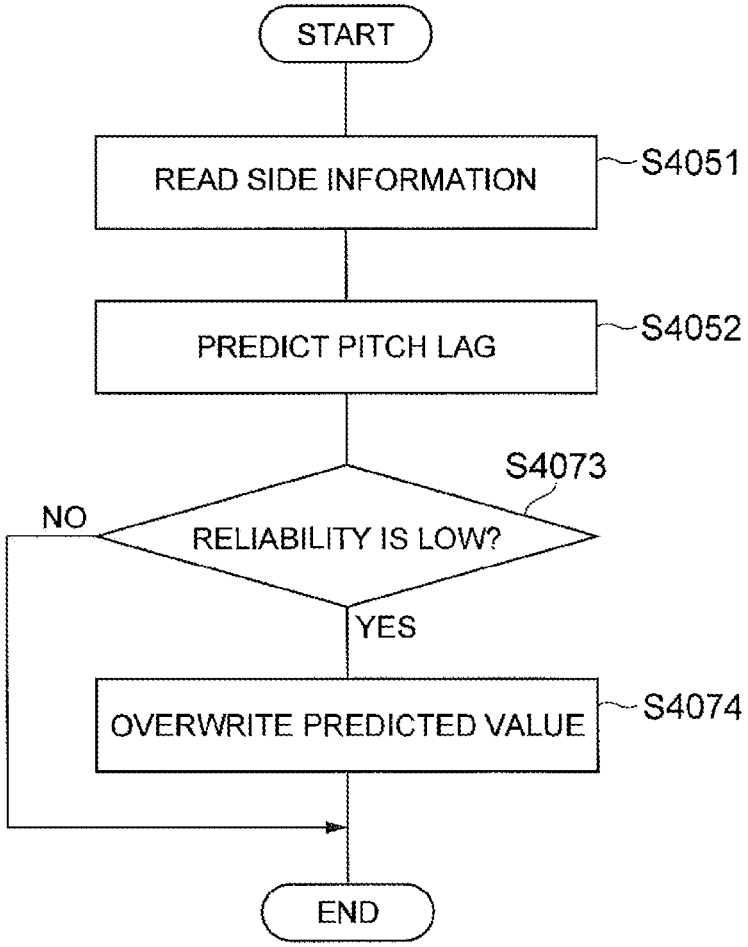
FIG. 37 is another view showing an example procedure of the pitch lag prediction unit in the example 4.

Further, the pitch lag prediction unit 192 may establish $\hat{T}_p^{(i)}=\hat{T}_p^{(M_{la})}$ only when the reliability of the pitch lag predicted value is low. The procedure of the pitch lag prediction unit in this case is shown in FIG. 37. Instruction information as to whether the predicated value is used, or the pitch lag $\hat{T}_p^{(M_{la})}$ obtained by the side information is used may be input to the adaptive codebook calculation unit 154.

The adaptive codebook gain prediction unit 193 and the fixed codebook gain prediction unit 194 are the same as those of the example 1.

The noise signal generation unit 195 is the same as that of the example 1.

The audio synthesis unit 124 synthesizes, from the parameters output from the audio parameter missing processing unit 123, an audio signal corresponding to the frame to be encoded.

The LP coefficient calculation unit 1121 of the audio synthesis unit 124 (see FIG. 15) obtains an LP coefficient in the same manner as in example 1 (Step S11301 in FIG. 16).

The adaptive codebook calculation unit 1123 calculates an adaptive codebook vector in the same manner as in example 1. The adaptive codebook calculation unit 1123 may perform filtering on the adaptive codebook vector or may not perform filtering. Specifically, the adaptive codebook vector is calculated using the following equation. The filtering coefficient is $f_i$.

$$v(n)=f_{-1}v'(n-1)+f_0v'(n)+f_1v'(n+1) \quad \text{Equation 47}$$

In the case of decoding a value that does not indicate filtering, v(n)=v'(n) is established (adaptive codebook calculation step A).

The adaptive codebook calculation unit 1123 may calculate an adaptive codebook vector in the following procedure (adaptive codebook calculation step B).

An initial adaptive codebook vector is calculated using the pitch lag and the adaptive codebook 1122.

$$v(n)=f_{-1}v'(n-1)+f_0v'(n)+f_1v'(n+1) \quad \text{Equation 48}$$

v(n)=v'(n) may be established according to a design policy.

Then, glottal pulse synchronization is applied to the initial adaptive codebook vector. For the glottal pulse synchronization, a similar procedure as in the case where a pulse position is not available as described, for example, in section 7.11.2.5 in ITU-T G.718 can be used. Note that, however, u(n) in ITU-T G.718 can correspond to: v(n) in the described embodiment(s), and extrapolated pitch corresponds to $\hat{T}_p^{(M-1)}$ in the described embodiment(s), and the last reliable pitch($T_c$) corresponds to $\hat{T}_p^{(M_{la}-1)}$ in the described embodiment(s).

Figure 38:
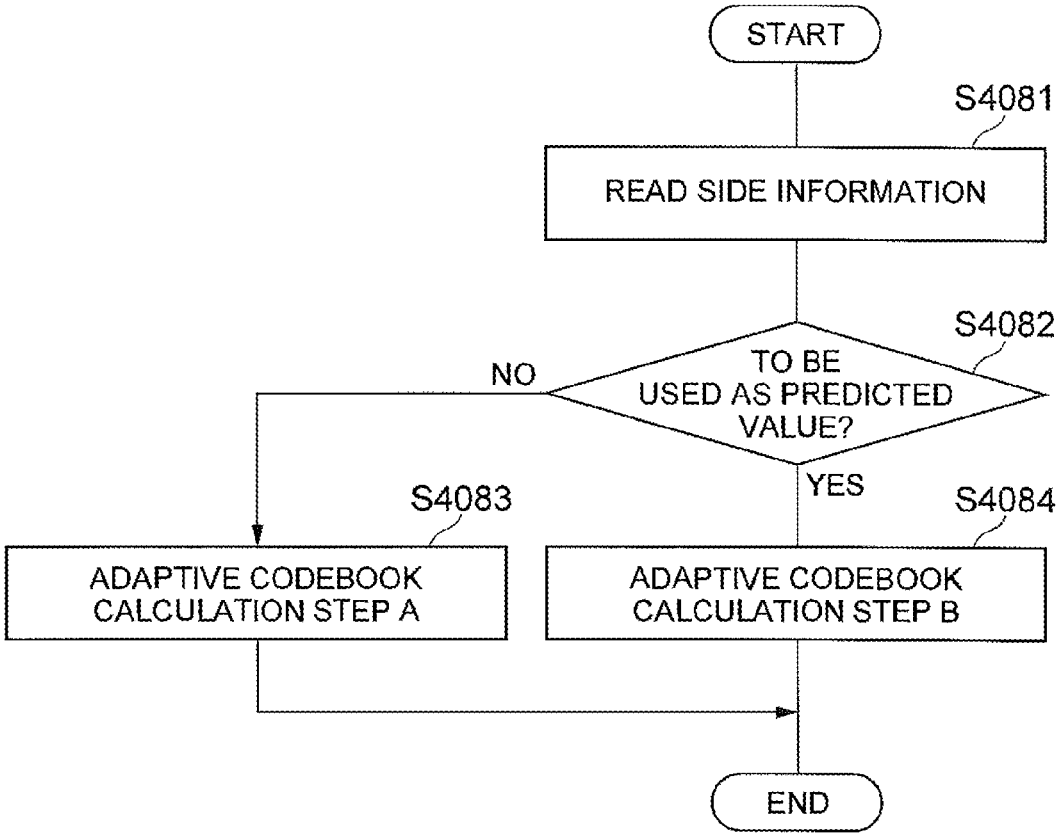
FIG. 38 is a view showing an example procedure of an adaptive codebook calculation unit in the example 4.

Further, in the case where the pitch lag prediction unit 192 outputs the above-described instruction information for the predicated value, when the instruction information indicates that the pitch lag transmitted as the side information should not be used as the predicated value (NO in Step 4082 in FIG. 38), the adaptive codebook calculation unit 1123 may use the above-described adaptive codebook calculation step A, and if it is indicated that the pitch value should be used (YES in Step 4082 in FIG. 38), the adaptive codebook calculation unit 1123 may use the above-described adaptive codebook calculation step B. The procedure of the adaptive codebook calculation unit 1123 in this case is shown in the example of FIG. 38.

The excitation vector synthesis unit 1124 outputs an excitation vector in the same manner as in example 1 (Step 11306 in FIG. 16).

The post filter 1125 performs post processing on the synthesis signal in the same manner as in the example 1.

The adaptive codebook 1122 updates the state by using the excitation signal vector in the same manner as in the example 1 (Step 11308 in FIG. 16).

The synthesis filter 1126 synthesizes a decoded signal in the same manner as in the example 1 (Step 11309 in FIG. 16).

The perceptual weighting inverse filter 1127 applies an perceptual weighting inverse filter in the same manner as in the example 1.

The audio parameter missing processing unit 123 stores the audio parameters (ISF parameter, pitch lag, adaptive codebook gain, fixed codebook gain) used in the audio synthesis unit 124 into the buffer in the same manner as in the example 1 (Step 145 in FIG. 7).

Example 5

In this embodiment, a configuration is described in which a pitch lag is transmitted as side information only in a specific frame class, and otherwise a pitch lag is not transmitted.

<Transmitting End>

In the audio signal transmitting device, an input audio signal is sent to the audio encoding unit 111.

The audio encoding unit 111 in this example calculates an index representing the characteristics of a frame to be encoded and transmits the index to the side information encoding unit 112. The other operations are the same as in example 1.

Figure 39:
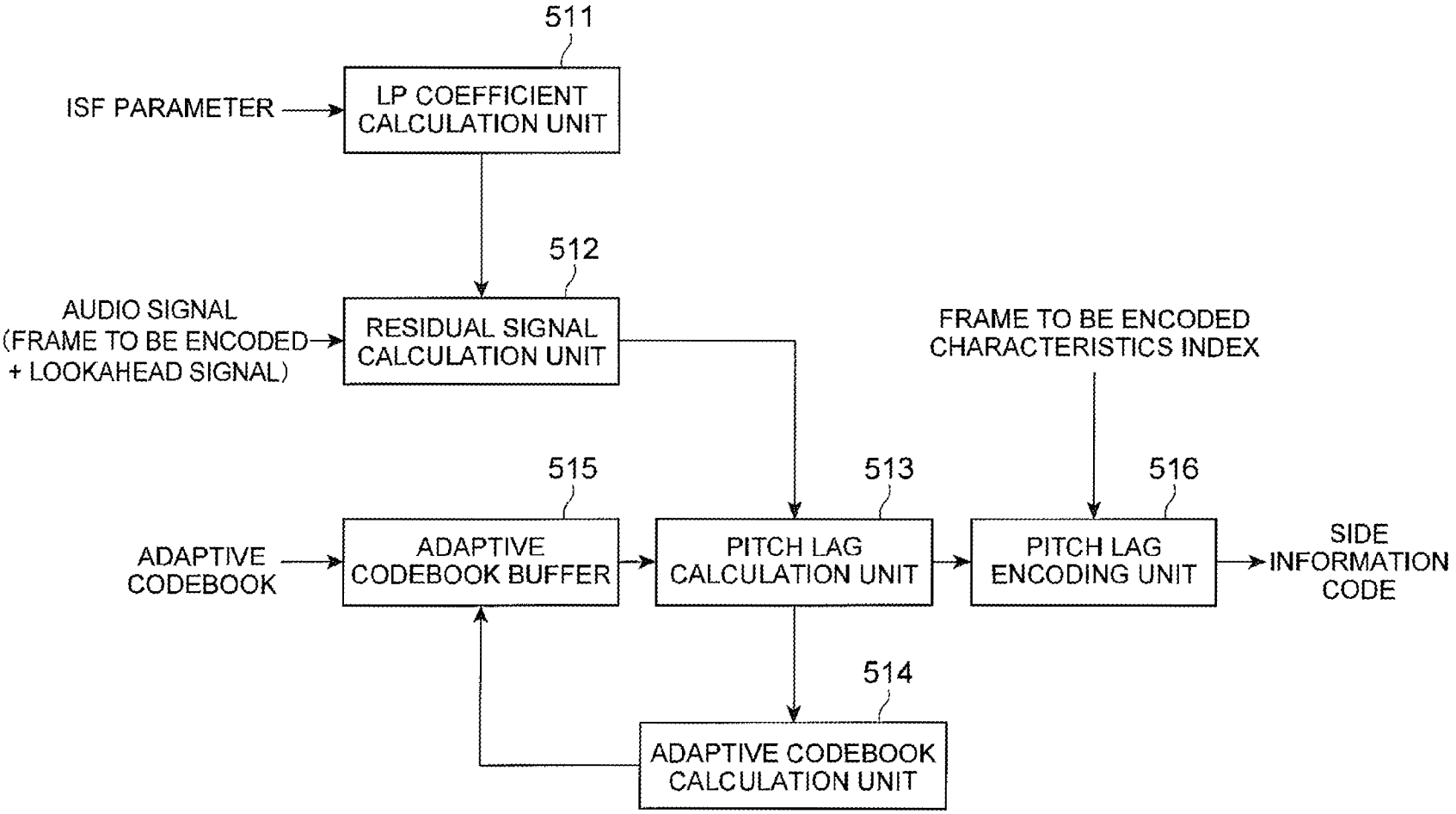
FIG. 39 is a view showing a functional configuration example of a side information encoding unit in an example 5 of the audio coding system.

In the side information encoding unit 112, a difference from the examples 1 to 4 is only with regard to the pitch lag encoding unit 158, and therefore the operation of the pitch lag encoding unit 158 is described hereinbelow. The configuration of the side information encoding unit 112 in the example 5 is shown in FIG. 39.

Figure 40:
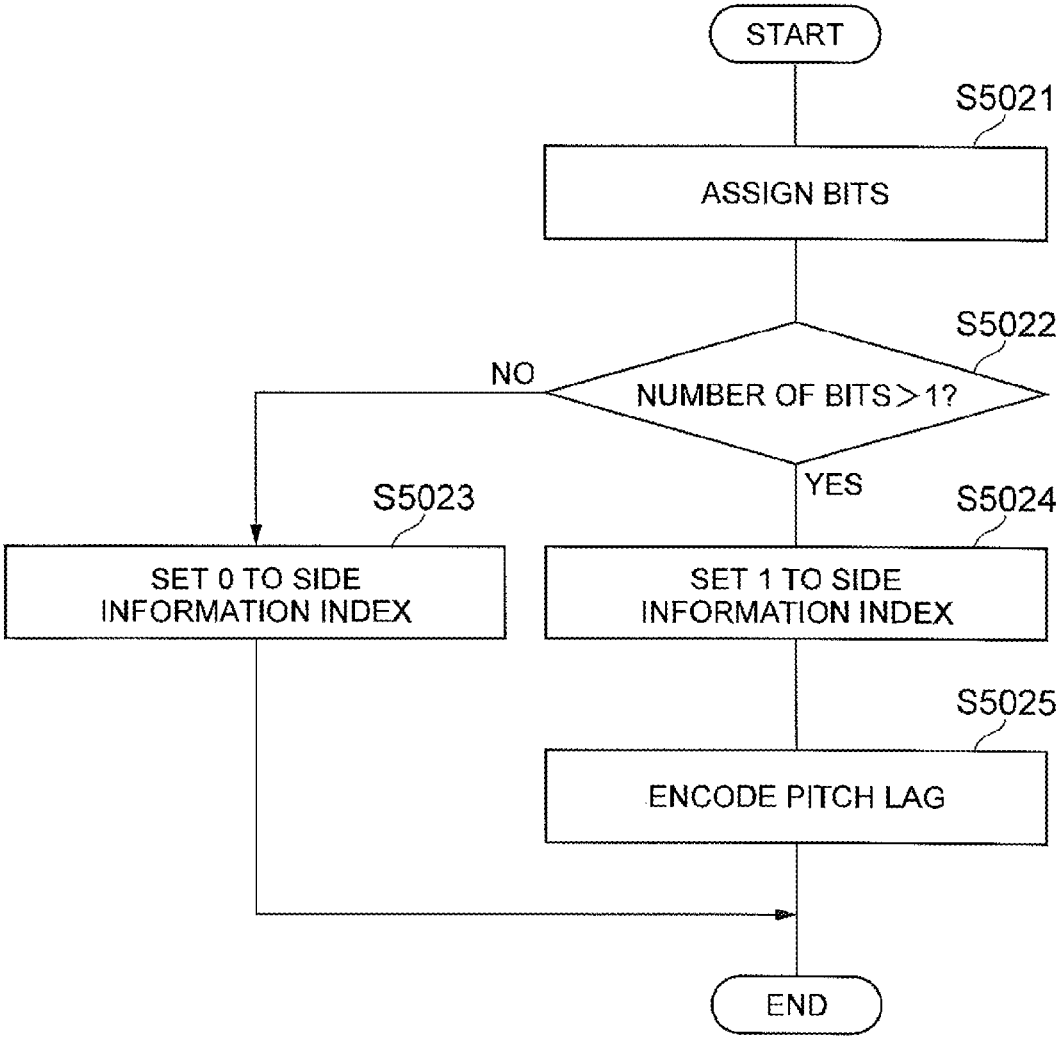
FIG. 40 is a view showing an example procedure of a pitch lag encoding unit in the example 5.

The procedure of the pitch lag encoding unit 158 is shown in the example of FIG. 40. The pitch lag encoding unit 158 reads the index representing the characteristics of the frame to be encoded (Step 5021 in FIG. 40) and, when the index representing the characteristics of the frame to be encoded is equal to a predetermined value, the pitch lag encoding unit 158 determines the number of bits to be assigned to the side information as B bits (B>1). On the other hand, when the index representing the characteristics of the frame to be encoded is different from a predetermined value, the pitch lag encoding unit 158 determines the number of bits to be assigned to the side information as 1 bit (Step 5022 in FIG. 40).

When the number of bits to be assigned to the side information is 1 bit (No in Step 5022 in FIG. 40), a value indicating non-transmission of the side information, is used as the side information code, and is set to the side information index (Step 5023 in FIG. 40).

On the other hand, when the number of bits to be assigned to the side information is B bits (Yes in Step 5022 in FIG. 40), a value indicating transmission of the side information is set to the side information index (Step 5024 in FIG. 40), and further, a code of B−1 bits obtained by encoding the pitch lag by the method described in example 1 is added, for use as the side information code (Step 5025 in FIG. 40).

<Decoding End>

The audio signal receiving device includes the audio code buffer 121, the audio parameter decoding unit 122, the audio parameter missing processing unit 123, the audio synthesis unit 124, the side information decoding unit 125, and the side information accumulation unit 126, just like in example 1. The procedure of the audio signal receiving device is as shown in FIG. 7.

The operation of the audio code buffer 121 is the same as in example 1.

<When Packet is Correctly Received>

The operation of the audio parameter decoding unit 122 is the same as in example 1.

Figure 41:
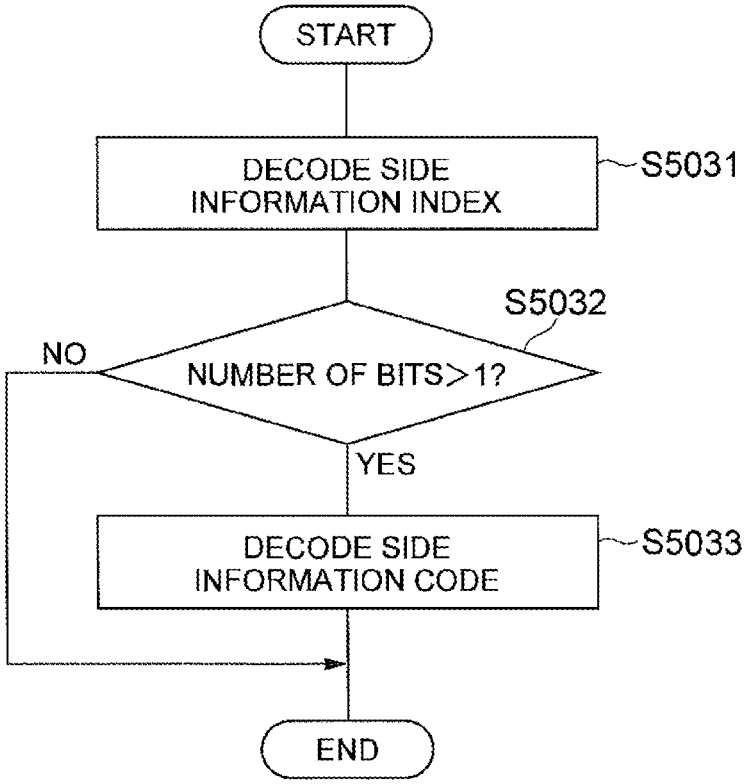
FIG. 41 is a view showing an example procedure of a side information decoding unit in the example 5.

The procedure of the side information decoding unit 125 is shown in the example of FIG. 41. The side information decoding unit 125 decodes the side information index contained in the side information code first (Step 5031 in FIG. 41). When the side information index indicates non-transmission of the side information, the side information decoding unit 125 does not perform any further decoding operations. Also, the side information decoding unit 125 stores the value of the side information index in the side information accumulation unit 126 (Step 5032 in FIG. 41).

On the other hand, when the side information index indicates transmission of the side information, the side information decoding unit 125 further performs decoding of B−1 bits and calculates a pitch lag $\hat{T}_p^{(j)}$ ($0 \le j < M_{la}$) and stores the calculated pitch lag in the side information accumulation unit 126 (Step 5033 in FIG. 41). Further, the side information decoding unit 125 stores the value of the side information index into the side information accumulation unit 126. Note that the decoding of the side information of B−1 bits is the same operation as the side information decoding unit 125 in example 1.

The audio synthesis unit 124 is the same as that of example 1.

<When Packet Loss is Detected>

The ISF prediction unit 191 of the audio parameter missing processing unit 123 (see FIG. 12) calculates an ISF parameter the same way as in example 1.

Figure 42:
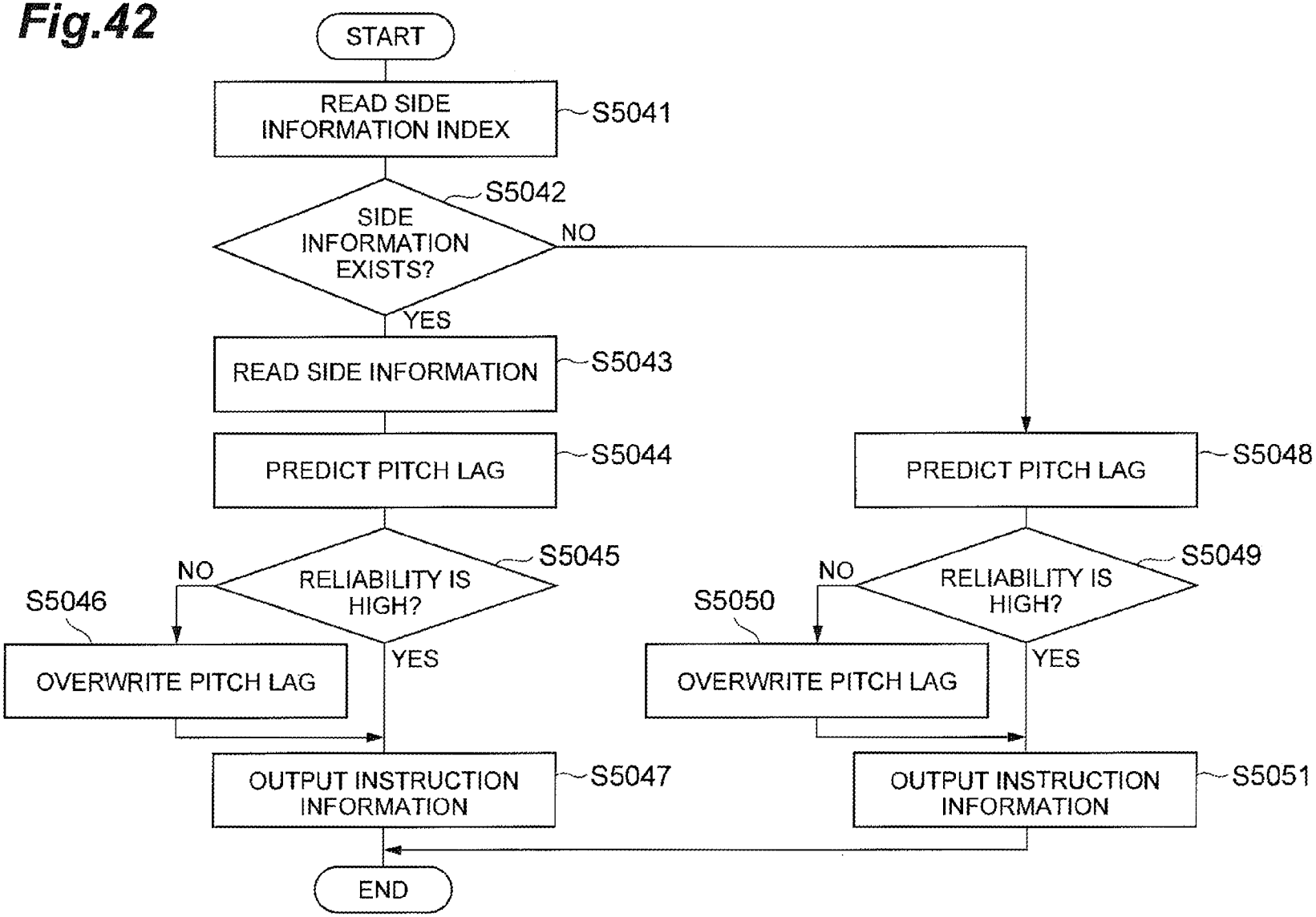
FIG. 42 is a view showing an example procedure of a pitch lag prediction unit in the example 5.

The procedure of the pitch lag prediction unit 192 is shown in the example of FIG. 42. The pitch lag prediction unit 192 reads the side information index from the side information accumulation unit 126 (Step 5041 in FIG. 42) and checks whether it is the value indicating transmission of the side information (Step 5042 in FIG. 42).

<When the Side Information Index is a Value Indicating Transmission of Side Information>

In the same manner as in example 1, the side information code is read from the side information accumulation unit 126 to obtain a pitch lag $\hat{T}_p^{(i)}$ ($0 \le i < M_{la}$) (Step 5043 in FIG. 42). Further, the pitch lag $\hat{T}_p^{(i)}$ ($M_{la} \le i < M$) is output by using the pitch lag $\hat{T}_p^{(-j)}$ ($0 \le j < J$) used in the past decoding and $\hat{T}_p^{(i)}$ ($0 \le i < M_{la}$) obtained as the side information (Step 5044 in FIG. 42). The number of sub-frames contained in one frame is M, and the number of pitch lags contained in the side information is $M_{la}$. In the prediction of the pitch lag $\hat{T}_p^{(i)}$ ($M_{la} \le i < M$), the procedure as described in ITU-T G.718 can be used (Step 1102 in FIG. 13), for example. Further, $\hat{T}_p^{(i)} = \hat{T}_p^{(M_{la})}$ may be established.

Further, the pitch lag prediction unit 192 may establish $\hat{T}_p^{(i)} = \hat{T}_p^{(M_{la})}$ only when the reliability of the pitch lag predicted value is low, and otherwise set the predicted value to $\hat{T}_p^{(i)}$ (Step 5046 in FIG. 42). Further, pitch lag instruction information indicating whether the predicated value is used, or the pitch lag $\hat{T}_p^{(M_{la})}$ obtained by the side information is used, may be input into the adaptive codebook calculation unit 1123.

<When the Side Information Index is a Value Indicating Non-Transmission of Side Information>

In the prediction of the pitch lag $\hat{T}_p^{(i)}$ ($M_{la} \le i < M$), the pitch lag prediction unit 192 predicts the pitch lag $\hat{T}_p^{(i)}$ ($0 \le i < M$) by using the pitch lag $\hat{T}_p^{(-j)}$ ($1 \le j < J$) used in the past decoding (Step 5048 in FIG. 42).

Further, the pitch lag prediction unit 192 may establish $\hat{T}_p^{(i)} = \hat{T}_p^{(-1)}$ only when the reliability of the pitch lag predicted value is low (Step 5049 in FIG. 42), and the pitch lag prediction unit 192 can otherwise set the predicted value to $\hat{T}_p^{(i)}$. Further, pitch lag instruction information indicating whether the predicated value is used, or the pitch lag $\hat{T}_p^{(-1)}$ used in past decoding is used, is input to the adaptive codebook calculation unit 1123 (Step 5050 in FIG. 42).

The adaptive codebook gain prediction unit 193 and the fixed codebook gain prediction unit 194 are the same as those of example 1.

The noise signal generation unit 195 is the same as that of the example 1.

The audio synthesis unit 124 synthesizes, from the parameters output from the audio parameter missing processing unit 123, an audio signal which corresponds to the frame to be encoded.

The LP coefficient calculation unit 1121 of the audio synthesis unit 124 (see FIG. 15) obtains an LP coefficient in the same manner as in example 1 (Step S11301 in FIG. 16).

Figure 43:
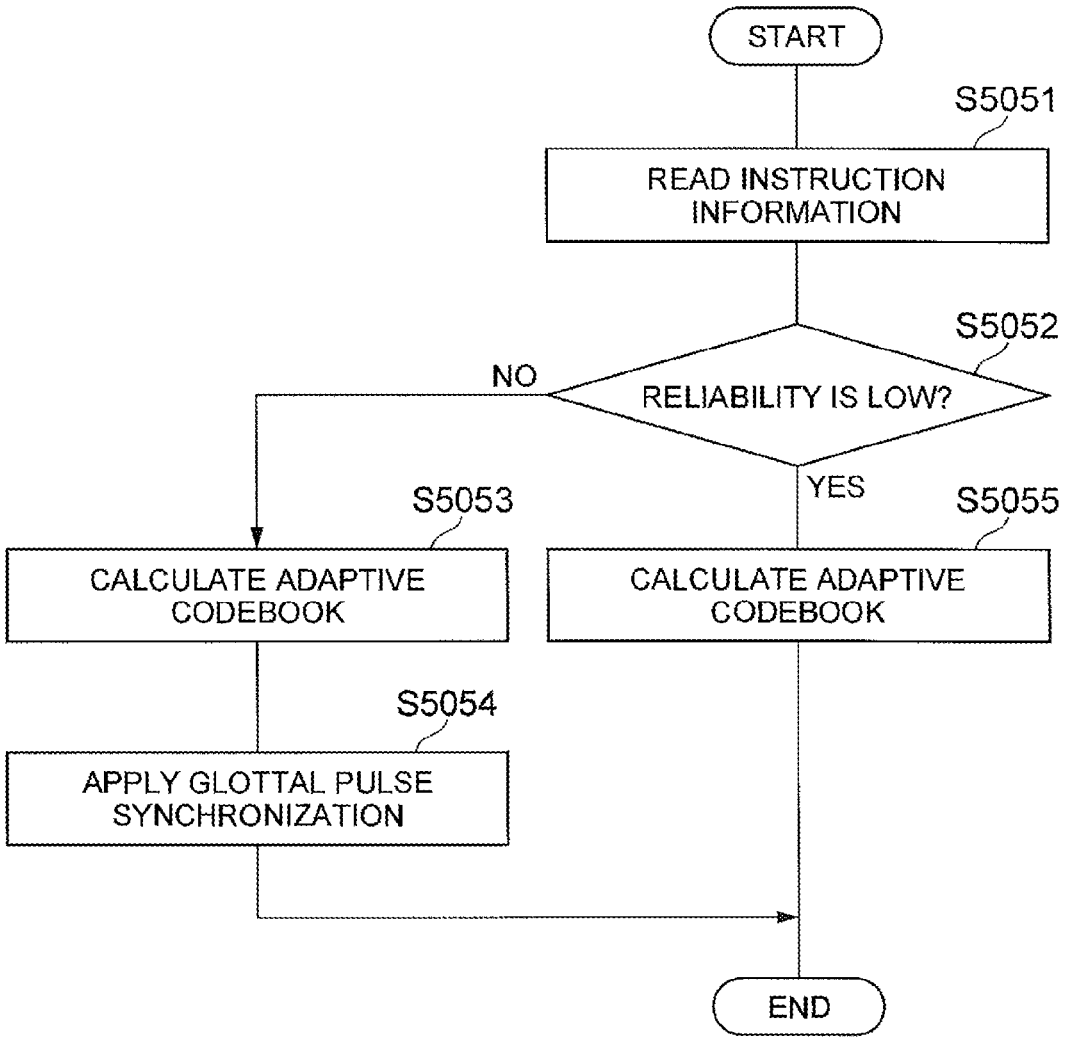
FIG. 43 is a view showing an example procedure of an adaptive codebook calculation unit in the example 5.

The procedure of the adaptive codebook calculation unit 1123 is shown in the example of FIG. 43. The adaptive codebook calculation unit 1123 calculates an adaptive codebook vector in the same manner as in example 1. First, by referring to the pitch lag instruction information (Step 5051 in FIG. 43), when the reliability of the predicted value is low (YES in Step 5052 in FIG. 43), the adaptive codebook vector is calculated using the following equation (Step 5055 in FIG. 43). The filtering coefficient is $f_i$.

$$v(n)=f_{-1}v'(n-1)+f_0v'(n)+f_1v'(n+1) \quad \text{Equation 49}$$

Note that v(n)=v'(n) may be established according to the design policy.

By referring to the pitch lag instruction information, when the reliability of the predicted value is high (NO in Step 5052 in FIG. 43), the adaptive codebook calculation unit 1123 calculates the adaptive codebook vector by the following procedure.

First, the initial adaptive codebook vector is calculated using the pitch lag and the adaptive codebook 1122 (Step 5053 in FIG. 43).

$$v(n)=f_{-1}v'(n-1)+f_0v'(n)+f_1v'(n+1) \quad \text{Equation 50}$$

v(n)=v'(n) may be established according to the design policy.

Then, glottal pulse synchronization is applied to the initial adaptive codebook vector. For the glottal pulse synchronization, a similar procedure can be used as in the example of the case where a pulse position is not available in section 7.11.2.5 in ITU-T G.718 (Step 5054 in FIG. 43). Note however, that u(n) in ITU-T G.718 can correspond to: v(n) in the described embodiment(s), extrapolated pitch corresponds to $\hat{T}_p^{(M-1)}$ in the described embodiment(s), and the last reliable pitch($T_c$) corresponds to $\hat{T}_p^{(-1)}$ in the described embodiment(s).

The excitation vector synthesis unit 1124 outputs an excitation signal vector in the same manner as in the example 1 (Step 11306 in FIG. 16).

The post filter 1125 performs post processing on the synthesis signal in the same manner as in example 1.

The adaptive codebook 1122 updates the state using the excitation signal vector in the same manner as in the example 1 (Step 11308 in FIG. 16).

The synthesis filter 1126 synthesizes a decoded signal in the same manner as in example 1 (Step 11309 in FIG. 16).

The perceptual weighting inverse filter 1127 applies an perceptual weighting inverse filter in the same manner as in example 1.

The audio parameter missing processing unit 123 stores the audio parameters (ISF parameter, pitch lag, adaptive codebook gain, fixed codebook gain) used in the audio synthesis unit 124 into the buffer in the same manner as in example 1 (Step 145 in FIG. 7).

REFERENCE SIGNS LIST

60, 80 . . . storage medium, 61, 81 . . . program storage area, 70 . . . audio encoding program, 90 . . . audio decoding program, 111 . . . audio encoding unit, 112 . . . side information encoding unit, 121, 231 . . . audio code buffer, 122, 232 . . . audio parameter decoding unit, 123, 233 . . . audio parameter missing processing unit, 124, 234 . . . audio synthesis unit, 125, 235 . . . side information decoding unit, 126, 236 . . . side information accumulation unit, 151, 511, 1121 . . . LP coefficient calculation unit, 152, 2012 . . . target signal calculation unit, 153, 513, 2013 . . . pitch lag calculation unit, 154, 1123, 514, 2014, 2313 . . . adaptive codebook calculation unit, 155, 1124, 2314 . . . excitation vector synthesis unit, 156, 315, 515, 2019 . . . adaptive codebook buffer, 157, 1126, 2018, 2316 . . . synthesis filter, 158, 516 . . . pitch lag encoding unit, 191 . . . ISF prediction unit, 192 . . . pitch lag prediction unit, 193 . . . adaptive codebook gain prediction unit, 194 . . . fixed codebook gain prediction unit, 195 . . . noise signal generation unit, 211 . . . main encoding unit, 212 . . . side information encoding unit, 213, 238 . . . concealment signal accumulation unit, 214 . . . error signal encoding unit, 237 . . . error signal decoding unit, 311 . . . LP coefficient calculation unit, 312 . . . pitch lag prediction unit, 313 . . . pitch lag selection unit, 314 . . . pitch lag encoding unit, 512 . . . residual signal calculation unit, 700 . . . audio encoding module, 701 . . . side information encoding module, 900 . . . audio parameter decoding module, 901 . . . audio parameter missing processing module, 902 . . . audio synthesis module, 903 . . . side information decoding module, 1128 . . . side information output determination unit, 1122, 2312 . . . adaptive codebook, 1125 . . . post filter, 1127 . . . perceptual weighting inverse filter, 2011 . . . ISF encoding unit, 2015 . . . fixed codebook calculation unit, 2016 . . . gain calculation unit, 2017 . . . excitation vector calculation unit, 2211 . . . ISF decoding unit, 2212 . . . pitch lag decoding unit, 2213 . . . gain decoding unit, 2214 . . . fixed codebook decoding unit, 2318 . . . look-ahead excitation vector synthesis unit

The invention claimed is:

1. An audio encoding method by an audio encoding device for encoding an audio signal, comprising:

an audio encoding step of encoding an audio signal;

side information encoding steps of calculating a pitch lag as side information from a look-ahead signal, the pitch lag for calculating a predicted value of an audio parameter and encoding the side information, wherein the side information contains information indicative of availability of the pitch lag as side information;

including the side information in a first packet for transmission only when the first packet is in a specific frame class; and making the side information available for decoding a second packet transmitted after the first packet.

2. The audio encoding method according to claim 1, wherein a decoding side that receives the side information does not use the side information when information indicative of unavailability of the pitch lag as side information is received.

3. The audio encoding method according to claim 1, further comprising including a flag in the side information, the flag comprising information indicative of availability of the side information.

4. The audio encoding method according to claim 1, wherein the pitch lag as the side information includes information indicative of the pitch lag.

5. An audio coding device for coding an audio signal, the audio coding device comprising:

an audio encoder configured to code the audio signal;

a side information encoder configured to calculate a pitch lag as side information, the pitch lag calculated from a look-ahead signal for calculating a predicted value of an audio parameter, and encoding the side information, wherein the side information contains information indicative of availability of the pitch lag as side information, and wherein the side information is only included in a first packet, for transmission by the encoder to a decoder, in response to the first packet being in a specific frame class; and wherein the encoder is configured to make the side information available at the decoder for decoding a second packet transmitted by the encoder to the decoder after the first packet.

6. The audio coding device according to claim 5, wherein the encoder is configured to include a flag in the side information, the flag comprising information indicative of availability of the side information.

7. The audio coding device according to claim 5, wherein a decoding device that receives the side information does not use the side information in response to the information indicative of availability of the pitch lag as side information indicating unavailability of pitch lag as side information.

* * * * *